US005147970A

United States Patent [19]

Obata

[11] Patent Number: 5,147,970

[45] Date of Patent: Sep. 15, 1992

[54] ELECTRONIC MUSICAL INSTRUMENT FOR GENERATING MUSICAL TONES ON THE BASIS OF CHARACTERISTICS OF INPUT WAVEFORM SIGNAL

[75] Inventor: Katsuhiko Obata, Tachikawa, Japan

[73] Assignee: Casio Computer Co., Ltd., Tokyo, Japan

[21] Appl. No.: 558,818

[22] Filed: Jul. 27, 1990

[30] Foreign Application Priority Data

Aug. 11, 1989 [JP] Japan ..... 1-208643
Aug. 11, 1989 [JP] Japan ..... 1-208644

[51] Int. Cl.[5] ..... G10H 1/02; G10H 1/20; G10H 3/18

[52] U.S. Cl. ..... 84/603; 84/616; 84/625; 84/627; 84/735; 84/738

[58] Field of Search ..... 84/616, 627, 654, 660, 84/663, 681, 702, 703, 726, 727, 735, 736, 738, 741

[56] References Cited

U.S. PATENT DOCUMENTS

| | | | |
|---|---|---|---|
| 4,117,757 | 10/1978 | Akamatu | 84/654 |
| 4,606,255 | 8/1986 | Hayashi et al. | 84/644 |
| 4,633,748 | 1/1987 | Takashima et al. | 84/603 |
| 4,688,464 | 8/1987 | Gibson et al. | 84/454 |
| 4,706,537 | 11/1987 | Oguri | 84/746 |
| 4,757,737 | 7/1988 | Conti | 84/681 |
| 4,893,539 | 1/1990 | Nishimoto | 84/663 |
| 4,909,121 | 3/1990 | Usa et al. | 84/606 |
| 5,022,304 | 6/1991 | Masaki | 84/607 |
| 5,048,391 | 9/1991 | Uchiyama et al. | 84/654 |

FOREIGN PATENT DOCUMENTS

| | | |
|---|---|---|
| 55-55398 | 4/1980 | Japan . |
| 55-87196 | 7/1980 | Japan . |
| 55-152597 | 11/1980 | Japan . |
| 55-162132 | 11/1980 | Japan . |
| 55-159495 | 12/1980 | Japan . |
| 57-37074 | 8/1982 | Japan . |
| 57-58672 | 12/1982 | Japan . |
| 61-26090 | 2/1986 | Japan . |
| 61-51793 | 11/1986 | Japan . |
| 62-20871 | 5/1987 | Japan . |
| 62-163099 | 7/1987 | Japan . |

*Primary Examiner*—William M. Shoop, Jr.
*Assistant Examiner*—Brian Sircus
*Attorney, Agent, or Firm*—Frishauf, Holtz, Goodman & Woodward

[57] ABSTRACT

A vibration of a string is picked up by a pickup to be converted to an electric signal. A pitch extracting circuit obtains pitch data expressing a pitch or a duration of the string vibration from the electric signal. A musical tone generating circuit generates a musical tone having a corresponding tone pitch in accordance with the pitch data. An envelope extracting circuit extracts an envelope from the eletric signal detected by the pickup and supplies a signal expressing the envelope to a multiplier. The extracted envelope signal is multiplied to the musical tone signal by a multiplier after a predetermined timing has been past. In other case, the extracted envelope signal is mixed with a synthe-envelope signal at a desired ratio, thereafter the mixed envelope signal is imparted to the musical tone signal by multiplying processing.

8 Claims, 32 Drawing Sheets

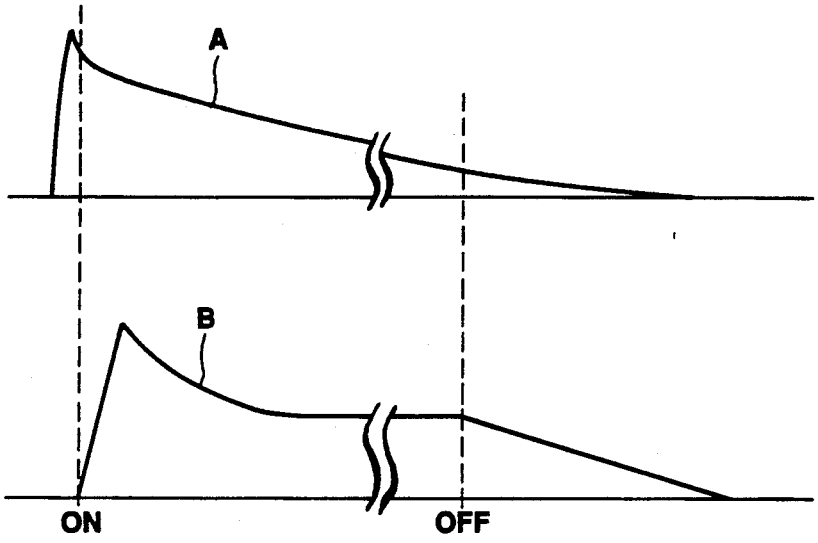
FIG.1A *(PRIOR ART)*
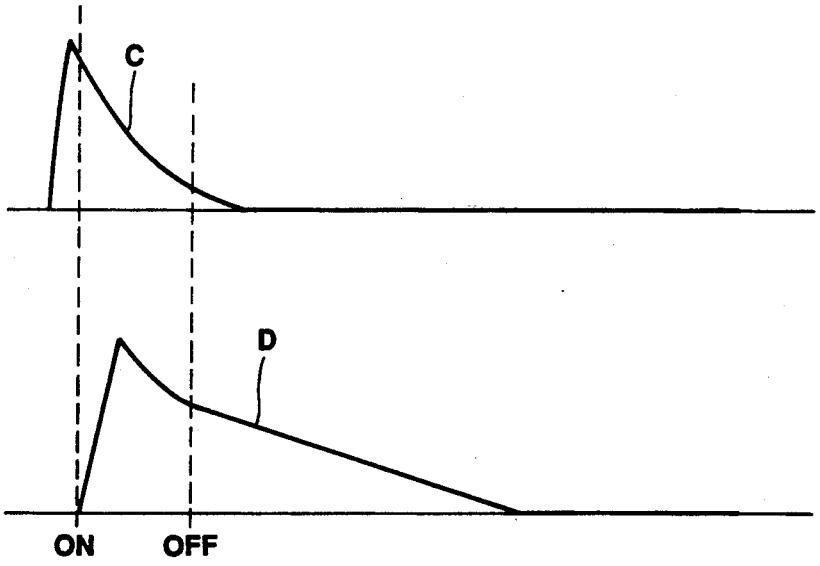
FIG.1B *(PRIOR ART)*

| SET VALUE | FACTOR FOR MULTIPLIER 2013 | FACTOR FOR MULTIPLIER 2014 |
|---|---|---|
| 0 | 1.0 | 0 |
| 1 | 0.8 | 0.2 |
| 2 | 0.6 | 0.4 |
| 3 | 0.4 | 0.6 |
| 4 | 0.2 | 0.8 |
| 5 | 0 | 1.0 |

FIG.22B

ELECTRONIC MUSICAL INSTRUMENT FOR GENERATING MUSICAL TONES ON THE BASIS OF CHARACTERISTICS OF INPUT WAVEFORM SIGNAL

BACKGROUND OF THE INVENTION

1. Field of the Invention

The present invention relates to electronic musical instruments of a synthesizer type such as an electronic guitar, other electronic stringed instruments and the like, and more particularly to a technique for an electronic musical instrument for controlling an envelope of a musical tone to be generated.

2. Description of the Related Art

Recently, electronic musical instruments have been developed wherein a vibration of a plucked string is detected as an electric waveform signal, and a musical tone generating circuit comprising digital circuits and/or analog circuits is controlled in accordance with the detected waveform signal, and thereby a musical tone is synthesized and is acoustically generated.

In the other case, the above waveform signal can be electrically detected from a human voice or an acoustic signal generated by playing an acoustic instrument. There are following articles disclosing such a technique:

(a) U.S. Pat. No. 4,117,757 (issued on Oct. 3, 1978), inventor: Akamatu.

This patent discloses an electronic circuit for forming a waveform signal in which "1" and "0" sequentially inverted at positive and negative peak points of an input waveform signal. This waveform signal is converted to a rectangular wave signal, and its frequency corresponds to a pitch of the input waveform signal.

(b) U.S. Pat. No. 4,606,255 (issued on Aug. 19, 1986), inventor: Hayashi et al.

This patent discloses a guitar synthesizer. A pitch is extracted for each string to obtain a corresponding voltage signal, and a musical tone signal is generated by voltage control.

(c) U.S. Pat. No. 4,644,748 (issued on Jan. 6, 1987), inventor: Takashima et al.

This patent discloses a technique for converting an acoustic signal input through a microphone into a digital signal, and extracting a pitch by digital processing.

(d) U.S. Pat. No. 4,688,464 (issued on Aug. 25, 1987), inventor: Gibson et al.

This patent discloses a technique for extracting a pitch in accordance with time intervals crossing three threshold levels, i.e., high, middle, and low threshold levels of an input waveform signal.

(e) Japanese Patent Publication No. 57-37074 (published on Aug. 7, 1982), applicant: Roland Kabushiki Kaisha.

(f) Japanese Patent Publication No. 57-58672 (published on Dec. 10, 1982), applicant: Roland Kabushiki Kaisha.

The contents of these two patents correspond to the above-mentioned patent (a), U.S. Pat. No. 4,117,757, and disclose techniques for generating a rectangular wave having a frequency corresponding to a pitch of an input waveform signal.

(g) Japanese Patent Disclosure (Kokai) No. 55-55398 (disclosed on Apr. 23, 1980), applicant: Toshiba Corp.

This patent application discloses a technique for generating a rectangular wave having a frequency corresponding to a pitch of an input waveform signal as in the patent (a), U.S. Pat. No. 4,117,757.

(h) Japanese Patent Disclosure (Kokai) No. 55-87196 (disclosed on Jul. 1, 1980), applicant: Nippon Gakki Seizo Kabushiki Kaisha.

This prior-art invention discloses a technique for generating a fundamental wave pulse having a period corresponding to a pitch in accordance with a output from a pickup of a guitar, counting the pulse by an interval counter to obtain period data, and converting the period data into digital frequency data.

(i) Japanese Patent Disclosure (Kokai) No. 55-159495 (disclosed on Dec. 11, 1980), applicant: Nippon Gakki Seizo Kabushiki Kaisha.

This prior-art invention discloses a technique wherein when an extracted pitch is not varied, a musical tone is started to generate. When two adjacent periods substantially coincide with each other, a coincidence signal is output, and start of tone generation is instructed in accordance with the coincidence signal.

(j) Japanese Utility Model Disclosure (Kokai) No. 55-152597 (disclosed on Nov. 4, 1980), applicant: Nippon Gakki Seizo Kabushiki Kaisha.

This prior-art device discloses a technique wherein a vibration of a string is extracted by an optical pickup, and the vibration of the string is excited by a pickup signal to obtain a vibration sustain effect.

(k) Japanese Utility Model Disclosure (Kokai) No. 55-162132 (disclosed on Nov. 20, 1980), applicant: Keio Gikken Kougyo Kabushiki Kaisha.

This prior-art device discloses a technique wherein a detector detects a next zero-cross point of positive and negative peak points of an input waveform signal, and a flip-flop is set/reset in response to each point detection to generate a frequency signal corresponding to a pitch.

(l) Japanese Patent Publication No. 61-51793 (published on Nov. 10, 1986), applicant: Nippon Gakki Seizo Kabushiki Kaisha.

This patent is a publication of the invention (h), and has the same gist as the content of the invention (i). That is, digital frequency data is generated upon detection of a substantial coincidence between two adjacent periods.

(m) Japanese Utility Model Publication No. 62-20871 (published on May 27, 1987), applicant: Fuji Roland Kabushiki Kaisha.

This is a Japanese publication corresponding to the invention (b), U.S. Pat. No. 4,606,255.

(n) Japanese Patent Disclosure (Kokai) No. 61-26090 (disclosed on Feb. 5, 1986), applicant: Seikou Denshi Kougyo Kabushiki Kaisha.

This prior-art invention discloses a technique for detecting a pitch from an input waveform signal, sequentially writing the detected pitch in a memory, and obtaining accurate pitch data later by executing an arithmetic operation.

(o) Japanese Patent Disclosure (Kokai) No. 62-163099 (disclosed on Jul. 18, 1987), applicant: Fuji Gen Gakki Seizo Kabushiki Kaisha.

This prior-art invention relates to a guitar controller for a guitar synthesizer, wherein frequency changing methods are switched in accordance with monophonic or polyphonic tones generated. More specifically, when a monophonic tone is generated, a picked-up vibration period is continuously reflected to determine the frequency of the musical sound to be generated. When a polyphonic tone is generated, the vibration period is reflected at chromatic scale steps to determine the same.

Furthermore, the following U.S. patent applications disclosing an electronic stringed instrument and a relating electronic equipment thereto associated with the present invention assigned to the present assignee have been filed.

(p) U.S. Ser. No. 112,780 (field on Oct. 22, 1987), inventor: Uchiyama et al.

This prior-art invention discloses a technique for measuring a time period between positive and negative peak points or between zero-cross points associated with these peak points to extract a pitch of an input waveform signal based on the measured time period, and a technique for performing various control operations in accordance with the obtained pitch.

(q) U.S. Ser No. 184,099 (filed on Apr. 20, 1988), inventor: Iba et al.

In this prior-art invention, a musical tone parameter such as a timbre is designated by a fret operation and a picking operation of a string. In order to detect an operated fret, a pitch extraction technique, and a fret switch detection technique is used.

(r) U.S. Ser. No. 256,398 (filed on Oct. 7, 1988), inventor: Iba et al.

This prior-art invention discloses a technique for performing musical tone generation control in units of strings, changing characteristics of an output musical tone in accordance with a plucking strength of a string, or controlling an effector or pan (sound localization).

(s) U.S. Ser. No. 252,914 (filed on Oct. 3, 1988), inventor: Uchiyama

In this prior-art invention, a pitch extraction circuit comprising a digital circuit in place of a conventional analog circuit, and integration of the electronic circuit can be facilitated.

(t) U.S. Ser. No. 256,400 (filed on Oct. 11, 1988) Inventor: Matsumoto

This prior-art invention discloses an electronic apparatus for extracting a pitch from an input waveform signal and generating a musical tone having the corresponding tone pitch, and discloses a technique for changing a tone pitch of an output tone along with a change of the input waveform signal in pitch without accompanying an unnecessary variation in interval.

(u) U.S. Ser. No. 282,510 (filed on Dec. 9, 1988), inventor: Obata

In this prior-art invention, even if a pitch is unstably extracted at the beginning of tone generation, a musical tone having a stable pitch can be generated from the beginning. Start of musical tone generation is chromatically instructed on the basis of a pitch extracted by a pitch extraction system.

(v) U.S. Ser. No. 290,981 (filed on Dec. 28, 1988), inventor: Murata et al.

In this prior-art invention, strings are completely electronically tuned. Before a performance, a reference pitch is determined by plucking at a specific fret, and a tone pitch of a musical tone to be generated is determined on the basis of period data obtained by plucking at a designated fret using the reference pitch.

(w) U.S. Ser. No. 329,418 (filed on Mar. 27, 1989), Inventor: Obata

In this prior-art invention, a signal intensity of an input waveform signal at its leading edge and a variation ratio of the signal intensity are detected and tone volume or timbre of a musical tone can be independently controlled in accordance with the two parameters. This technique, for example, in an electronic stringed instrument, allows to change only timbre of the musical tone without changing its tone volume by shifting a string plucking position.

(x) U.S. Ser. No. 362,830 (filed on Jun. 7, 1989) inventor: Katou

In this prior-art invention, characteristics of a musical tone, such as timbre, tone volume, tone pitch and the like are controlled on the basis of variation in a pitch frequency and thereby an abundant performance expression is realized.

As described above, according to the conventional technique, the form of the tone volume envelope of a musical tone to be generated is previously determined by selection of timbre of the musical tone and remains the same. Only the level of the whole tone volume envelope changes depending on the amplitude level of the input waveform signal at the leading edge.

Therefore, for example, even when a guitar operation is performed to abruptly change the envelope of the string vibration of an electronic stringed instrument, the envelope of a musical tone is determined regardless of the above guitar operation. Accordingly, a performance effect desired by the guitar player can not be obtained and the above guitar operation can cause sound offensive to the ear.

When the player plucks a string of an electronic musical instrument, the envelope of the string vibration has a characteristic shown at A in FIG. 1A, and the envelope of the musical tone to be generated has a characteristic shown at B in FIG. 1A. In FIG. 1A, a symbol "ON" indicates a timing at which sound generation of a musical tone is started when the level of the string vibration shown at A in FIG. 1A exceeds a predetermined value. Similarly, a symbol "OFF" indicates a timing at which an instruction to stop sounding is given when the level of the string vibration shown at A in FIG. 1A becomes equal to or less than a predetermined value. That is, the envelope of the musical tone to be generated decreases gradually after the OFF timing.

In this case, when the player performs a muting operation to compulsorily cease the string vibration by holding the string with the palm of his hand, while the string vibration has not adequately decreased after the string is plucked, the envelope of the string vibration shows a characteristic to rapidly decrease right after a strong attack, as shown at C in FIG. 1B. On the other hand, the envelope of the musical tone to be generated keeps an attenuating sound having considerable large volume for a long time even after the OFF timing. Therefore, staccato sounds are not generated and a unique nuance of the muting operation is lost.

Therefore, the following invention relating to other envelope control technology has been developed.

(y) U.S. Ser. No. 370,336 (filed on Jun. 22, 1989), inventor: Uchiyama et al.

In this prior-art invention, an envelope of a musical tone to be generated can be controlled in accordance with an envelope of an input waveform and thereby an effect of the envelope of the input waveform is further imparted to a predetermined peculiar effect of the envelope of the musical tone.

When the player of, for example, an electronic guitar performs the muting operation to compulsorily cease the string vibration after plucking a string, the whole envelope of the input waveform signal is characterized to rapidly decrease as shown at E in FIG. 1(C). Then, even though the variation of the envelope of the musical tone signal output from the musical tone generator has a characteristic as shown at F in FIG. 1C, the variation of the envelope of the musical tone signal output from the musical tone generator can be characterized by the tendency to abruptly decrease as shown at G in FIG. 1C because of being multiplied by the characteristic as shown at E in FIG. 1C. Thus, the performance effect by the muting operation can be easily obtained, and the player can modify the envelope of the musical tone as the expects by his operation of the instrument.

However, the attack portion of the musical tone signal as shown at F in FIG. 1C is also multiplied by the envelope of the input waveform signal as shown at E in FIG. 1C. In general, the characteristic of the attack portion of the musical tone includes important elements for defining timbre and the like of a musical tone. As the attack portion of the envelope characteristic is modified as shown at G in FIG. 1C as a result of the multiplication, a fact that sound characteristics of the musical tone originally generated from the musical tone generator peculiar to an electronic musical instrument is modified, causes trouble.

Furthermore, when reflecting the envelop of the input waveform upon the musical tone signal as shown at G in FIG. 1C, the musical tone signal is multiplied by an extracted envelope data from the input waveform at the same rate. Therefore, if the influence of the envelope of the input waveform is too strong, the envelope of the musical tone signal changes too abruptly. Otherwise, the envelope of the input waveform signal scarcely affect the envelope of the musical tone signal to be generated. Accordingly, the player cannot control an imparting level of the effect of the envelope based on the input waveform signal at will, thereby he is difficult to obtain a desired musical tone.

SUMMARY OF THE INVENTION

The present invention has been made in consideration of the above situation, and has as its first object to provide an electronic musical instrument in which an envelope of a musical tone to be generated can be controlled in accordance with an envelope of an input waveform without destroying a characteristic of the musical tone peculiar to the electronic musical instrument, thereby a performance effect as expected by a player can be obtained.

The second object of the present invention is to provide an electronic musical instrument in which an imparting level of the effect of an envelope of an input waveform to a musical tone signal can be controlled freely, thereby a performance effect as expected by a player can be obtained.

That is, according to one aspect of the present invention, there is provided an electronic musical instrument comprising envelope extraction means for extracting an envelope signal of an input waveform signal, musical tone signal generation means for generating a musical tone signal, envelope control means for controlling to impart the envelope signal extracted by said envelope extraction means to the musical tone signal generated by said musical tone signal generation means from a predetermined timing after a generation start of said musical tone signal.

Furthermore, according to another aspect of the present invention, there is provided an electronic musical instrument comprising envelope extraction means for extracting an envelope signal of an input waveform signal, musical tone signal generation means for generating a musical tone signal, envelope signal generation means for generating a preset envelope signal, mixing means for mixing the envelope signal extracted from said envelope extraction means and said preset envelope signal generated from said envelope signal generation means at a desired mixing ratio, and envelope control means for controlling an envelope of said musical tone signal generated from said musical tone signal generation means in accordance with a mixed envelope signal obtained by said mixing means.

More specifically, the electronic musical instrument of the present invention is realized as an electronic guitar and the like in which a string vibration is detected as an input waveform by a sensor or a pickup and a musical tone is controlled on the basis of the detected input waveform.

The envelope extraction means is preferably realized by a combination of the following means: maximum peak value detection means for detecting a maximum peak value of a digital waveform signal at its leading edge, which signal is obtained by digitizing an input waveform signal, effective peak value detection means for sequentially detecting effective peak values of said digital waveform signal after its leading edge, and envelope signal calculation means for sequentially calculating means values of an effective peak values sequentially detected by said effective peak value detection means and the previous or preceding effective peak values, and for sequentially outputting the mean values as the envelope signal.

As the musical tone generation means, various types of means such as a digital sound source means and an analog sound source means can be employed. For example, the musical tone generating means employing digital circuits may be realized by a combination of the following means: memory for storing a digital musical tone waveform, waveform read out means for reading out digital musical tone waveforms from said memory at address intervals corresponding to a sound pitch on the basis of an instruction for starting sound generation and a sound pitch control, and sound generation means for converting the read-out digital musical tone waveform signal to an analog waveform signal, and for generating sound based on the amplified analog waveform signal. In addition to this, a waveform generation may be effected by employing technique such as a sine wave synthesis, a frequency modulation (FM), a phase modulation and the like.

The envelope control means, for example, controls the envelope of the musical tone signal generated from the musical tone signal generation means in accordance with an envelope signal extracted by said envelope extracting means from a predetermined timing after the starting of the musical tone signal generation. The envelope control means may be realized by multiplying means for multiplying the musical tone signal generated from the musical tone signal generation means by values of the ratio which are sequentially obtained by dividing the envelope values calculated by the envelope signal calculation means after the predetermined timing is passed, by the envelope value at the predetermined timing. In this arrangement, a value, for example, 1.0 is multiplied by said multiplying means, so that the musical tone signal is not modified.

In above construction, the musical tone signal generation means may include an envelope generation means for imparting an envelope character such as attack, decay, sustain, release and the like, to the musical tone signal generated, and means for setting as said predetermined timing, a timing when the envelope characteristic imparted by the envelope generation means, is changed into the sustain phase.

As described above, according to one aspect of the present invention, when a musical tone signal is generated from a musical tone generation means, the musical tone generation means generates a musical tone signal without modifying in an attack portion prior to a predetermined timing (e.g., sustain starting point), thereby keeping characteristics of a musical tone such as timbre. In general, a sound starting portion (i.e., attack portion) of a musical tone has an important element for defining characteristics of the musical tone, such as timbre and the like. Therefore the musical tone signal generation means outputs the musical tone signal as it is so that the characteristics thereof may be maintained.

After the predetermined timing, an envelope control means controls an envelope of a musical tone signal generated from the musical tone signal generation means in accordance with an envelope signal extracted from an input waveform signal.

Accordingly, when the player of, for example, an electronic guitar performs the muting operation to compulsorily cease the string vibration after plucking a string, the timbre of a musical tone signal (synthesizer sound) is maintained in an attack portion immediately after the start of sounding. Thereafter, the envelope control means imparts an envelope characteristic of the input waveform signal which is abruptly decreasing in accordance with the muting operation to the musical tone signal and thereby the player can change the envelope of the musical tone as he expects by his operation of the instrument.

Furthermore, according to another aspect of the present invention, there is provided a mixing means for mixing an envelope signal of an input envelope waveform signal which is extracted by an envelope extracting means, and a preset envelope waveform signal which is generated from an envelope signal generation means at a desired mixing ratio. The mixing means, for example, is realized by a combination of the following means: first multiplying means for multiplying an envelope signal of the input waveform signal extracted by an envelope extracting means by a first preselected and desired factor, second multiplying means for multiplying a preset envelope signal generated from the envelope signal generation means by a second preselected and desired factor, and adding means for adding the outputs from the first and second multiplying means to generate a mixed envelope signal. The mixing ratio can be set by manual operation of a user, or automatically set in accordance with timbre selection. The mixing ratio may be changed in accordance with a pitch or note range of the musical tone, and may be changed time-dependently. Further modification may be realized as to the mixing means.

An envelope control means is further provided for controlling an envelope of a musical tone signal generated from a musical tone generation means in accordance with the mixed envelope signal obtained by the mixing means. The envelope control means is, for example, realized as a multiplying means which multiplies the musical tone signal generated from the musical tone generation means by the mixed envelope signal.

In an electronic stringed instrument, an envelope signal derived from the envelope extracting means directly corresponds to an envelope characteristic of an input waveform signal which is changed on a real time basis in accordance with a vibration of a string plucked by a player.

On the other hand, the preset envelope signal generated by the envelope signal generation means has an envelope characteristic of, for example, a synthesized sound which is preset by a user.

The mixing means mixes two kinds of the envelope signal at a desired ratio to output a mixing envelope signal.

The envelope control means controls the envelope of the musical tone signal generated from the musical tone signal generation means based on the mixed envelope signal obtained as explained above.

Accordingly, a player of, for example, an electronic guitar can select the mixing ratio of two kinds of the envelope signal previous to a musical performance so that an envelope of the musical tone may be changed at a plurality of steps between a preselected synthesizer sound envelope and an envelope directly corresponding to a string vibration of an electronic guitar.

BRIEF DESCRIPTION OF THE DRAWINGS

The above and other objects and features of the present invention will be apparent from the description of the preferred embodiment taken in conjunction with the accompanying drawings, in which:

FIGS. 1A to 1C are charts showing disadvantages of conventional technique;

FIGS. 22A and 22B are charts for explaining an operation of this embodiment;

DETAILED DESCRIPTION OF THE PREFERRED EMBODIMENTS

An embodiment of the present invention will now be described in detail.

In the following description, items are classified in the order of underlined captions enclosed in symbols { }, ( ), and < >.

{Arrangement of the First Embodiment of the Present Invention}

This first embodiment is realized as an electronic guitar, wherein six metal strings are kept taut on a body, and a desired string is picked while pressing a fret (finger board) arranged below the metal strings so as to make a performance. Note that its outer appearance will be omitted.

Figure 2:
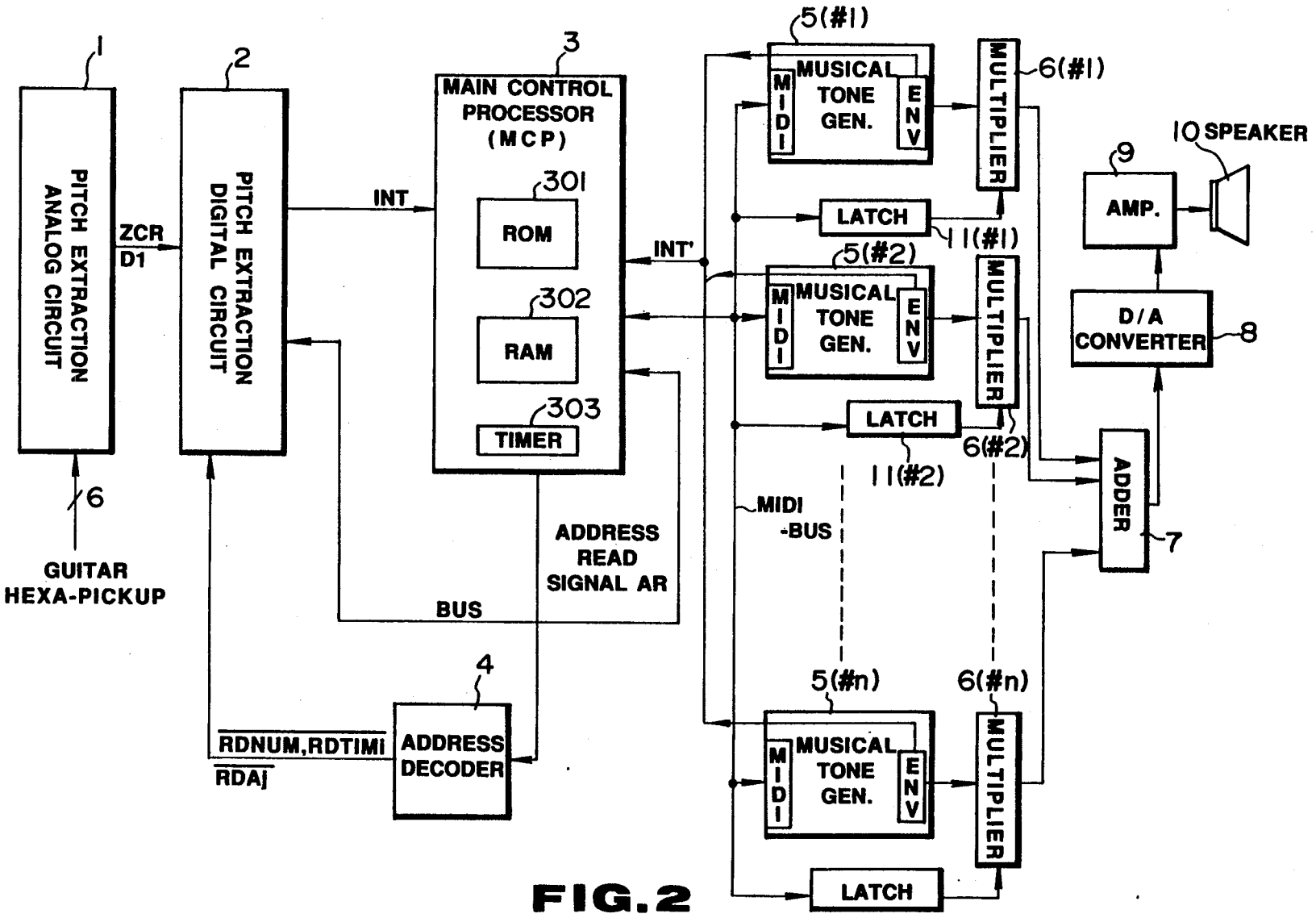
FIG. 2 is a block diagram showing the overall arrangement of first embodiment of the electronic musical instrument according to the present invention.

FIG. 2 is a block diagram showing the overall arrangement of this embodiment.

Pitch extraction analog circuit 1 is connected with each of the six strings (not shown). Hexa-pickups convert vibrations of the corresponding strings into electrical signals. These signals pass through low-pass filters (not shown) to remove harmonic components thereof thereby obtaining 6 waveform signals Wi (i=1 to 6). Furthermore, circuit 1 generates a zero-cross pulse signal Zi (i=1 to 6) which goes H (High) or L (Low) every time the sign of the amplitude of each waveform signal Wi is changed to positive or negative. These 6 waveform signals Wi are converted to a digital output (time-divisional waveform signal) D1 through corresponding A/D converters (not shown) or the like. These 6 zero-cross signals Zi are converted to a time-divisional serial zero-cross signal ZCR. These digital signals are then output.

A pitch extraction digital circuit 2 comprises a peak detector 201, a time constant conversion controller 202, a peak value fatching circuit 203, and a zero-cross time fetching circuit 204. These circuits shown in FIG. 3 time-divisionally process data for the six strings on the basis of the time-divisional serial zero-cross signal ZCR and the digital output D1 corresponding to data of the six strings. In the following description, processing for one string will be described for the sake of easy understanding, and the serial zero-cross signal ZCR and the digital output D1 will be described as signals for one stiring. However, time-divisional processing for the six strings is performed unless otherwise specified.

Figure 3:
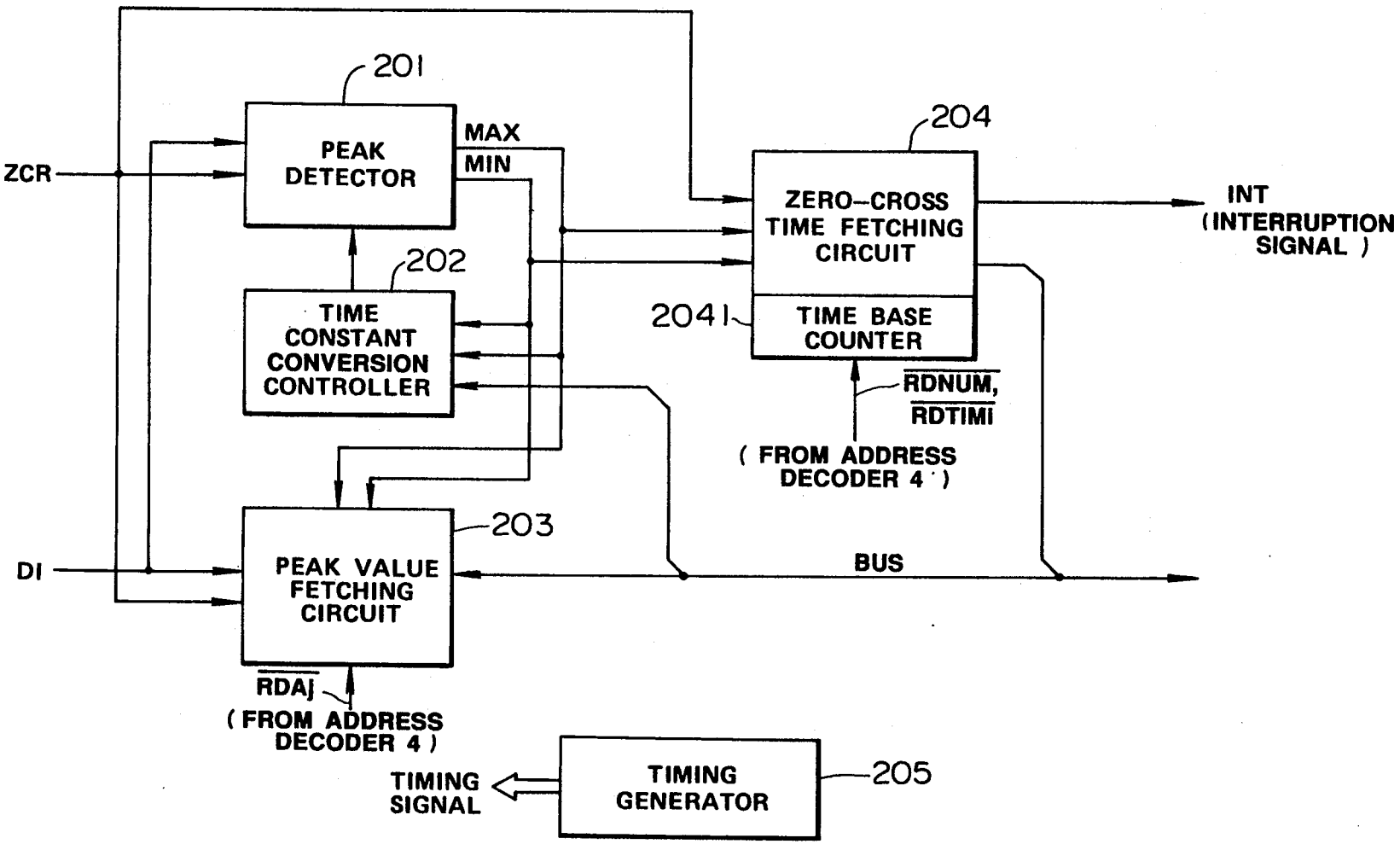
FIG. 3 is a block diagram of a pitch extraction digital circuit in FIG. 2.

In FIG. 3, the peak detector 201 detects maximum and minimum peak points of the digital output D1 on the basis of the serial zero-cross signal ZCR and the digital output D1. Although not shown, the detector 201 includes a peak hold circuit for holding an absolute value of a previous peak value while substracting (attenuating) it. The peak detector 201 detects a timing of a peak value by using a peak hold signal output from the peak hold circuit as a threshold value. That is, the peak detector 201 detects the after preceding detection of the peak value timing when the absolute value of the digital output D1 exceeds the threshold value after the next serial zero-cross signal ZCR is generated. Note that timing detection of the peak value is executed for positive and negative signs of the digital output D1. At the detection timing of the peak value, the detector 201 outputs a maximum peak value detection signal MAX in the case of positive sign, and outputs a minimum peak value detection signal MIN in the case of the negative sign. Note that these signals are time-divisional signals for the six strings, as a matter of course.

The time constant conversion controller 202 is a circuit for changing an attenuation factor of the peak hold circuit in the peak detector 201, and is operated in accordance with the maximum and minimum peak detection signals MAX and MIN under control of a main control processor (to be referred to as an MCP hereinafter) 3 shown in FIG. 2. This operation will be described later.

The peak value fatching circuit 203 demultiplexes the digital output D1 time-divisionally sent from the peak extraction analog circuits 1 into peak values corresponding to the strings, and holds their peak values in accordance with the peak value detection signals MAX and MIN from the peak detector 201. The circuit 203 sequentially outputs to the MCP 3 through a BUS the maximum or minimum peak value for a string accessed by the MCP 3 (FIG. 2) through an address decoder 4 (FIG. 2). The peak value fetching circuit 203 can output an instantaneous value of a vibration of each string in addition to the peak values.

The zero-cross time fetching circuit 204 latches an output from a time-base counter 2041 common to the strings at a zero-cross timing of each string, strictly, at a zero-cross point immediately after a passage timing of the maximum and minimum peak determined by the maximum and minimum peak value detection signals MAX and MIN output from the peak detector 201 in accordance with the serial zero-cross signal ZCR from the pitch extraction analog circuits 1 (FIG. 2). When this latch operation is performed, the zero-cross time fetching circuit 204 outputs an interruption signal INT to the MCP 3 shown in FIG. 2. Thus, the circuit 204 sequentially outputs a number of string of which vibration has been past through a zero-cross point, the latched zero-cross time and positive/negative data corresponding to the string (to be described later) to the MCP 3 through the bus BUS in accordance with a control signal (to be described later) output from the MCP 3 through the address decoder 4 (FIG. 2).

A timing generator 205 shown in FIG. 3 outputs timing signals for processing operations of the circuits shown in FIGS. 2 and 3.

Referring again to FIG. 2, the MCP 3 has memories, e.g., a ROM 301 and a RAM 302, and also has a timer 303. The ROM 301 comprises a nonvolatile memory for storing various musical tone control program (to be described later), and the RAM 302 comprises a rewritable memory used as a work area for various variables and data during control operation. The timer 303 is used for note-off (muting) processing (to be described later). The address decoder 4 shown in FIG. 2 supplies a string number read signal $\overline{\text{RDNUM}}$ and then a time read signal $\overline{\text{RDTIMi}}$ (i=1 to 6) to the zero-cross time fetching circuit 204 in accordance with an address read signal AR generated by the MCP 3 (FIG. 2) after the interruption signal INT is generated by the zero-cross time fetching circuit 204 (FIG. 3). Similarly, the decoder 4 outputs a waveform read signal $\overline{RDAj}$ (j=1 to 18) to the peak value fatching circuit 203 (FIG. 3). These operations will be described later in detail.

A musical tone generator 5 (#1 to #n) is provided with an interface (Musical Instrument Digital Interface) MIDI at its input side and is connected to the MCP 3 through a bus MIDI-BUS for transmitting the musical tone control data. Each of the generator 5 can generate one kind musical tone signal and the generator 5 as a whole can generate n kind musical tone signals at the same time. In each of the tone generator 5, an envelope generator ENV is provided for controlling an envelope of tone volume or timbre of the musical tone signal to be generated. Each envelope generator ENV outputs an interrupt signal INT' to MCP 3 when the envelope output therefrom has been passed through a sustain start point. This will be described later.

A multiplier 6 (#1 to #n) is capable of receiving n envelope signals corresponding to each musical tone through the above bus MIDI-BUS or other bus (not shown) and multiplies each musical tone signal output from the musical tone generator 5 (#1 to #n) by the above corresponding envelope signal.

An adder 7 serves to add in a digital fashion n musical tone signals output from the above multiplier 6 (#1 to #n) to obtain one digital signal.

The output signal of the adder 7 is converted to an analog signal by a D/A converter 8, and is amplified by an amplifier 9 and thereafter is acoustically output through a speaker 10.

Note that the above-mentioned operation by n musical tone generators 5 (#1 to #n) and n multipliers (#1 to #n) can be performed in n time-divisional processing by one musical tone generator and one multiplier and thereby n musical tones can be generated. The construction of the time-divisional processing tone generator is will known, and need not to be explained further.

{General Operation of This Embodiment}

The operation of the embodiment with the above arrangement will now be described.

A general operation of this embodiment will be described first.

Figure 1C:
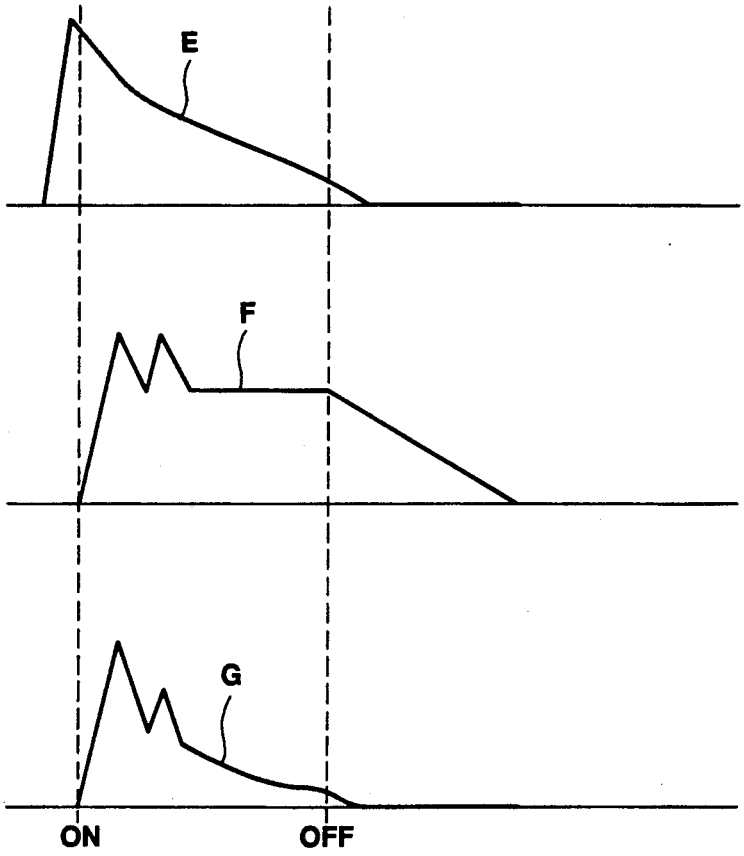
FIG. 1C (PRIOR ART)
Figure 11:
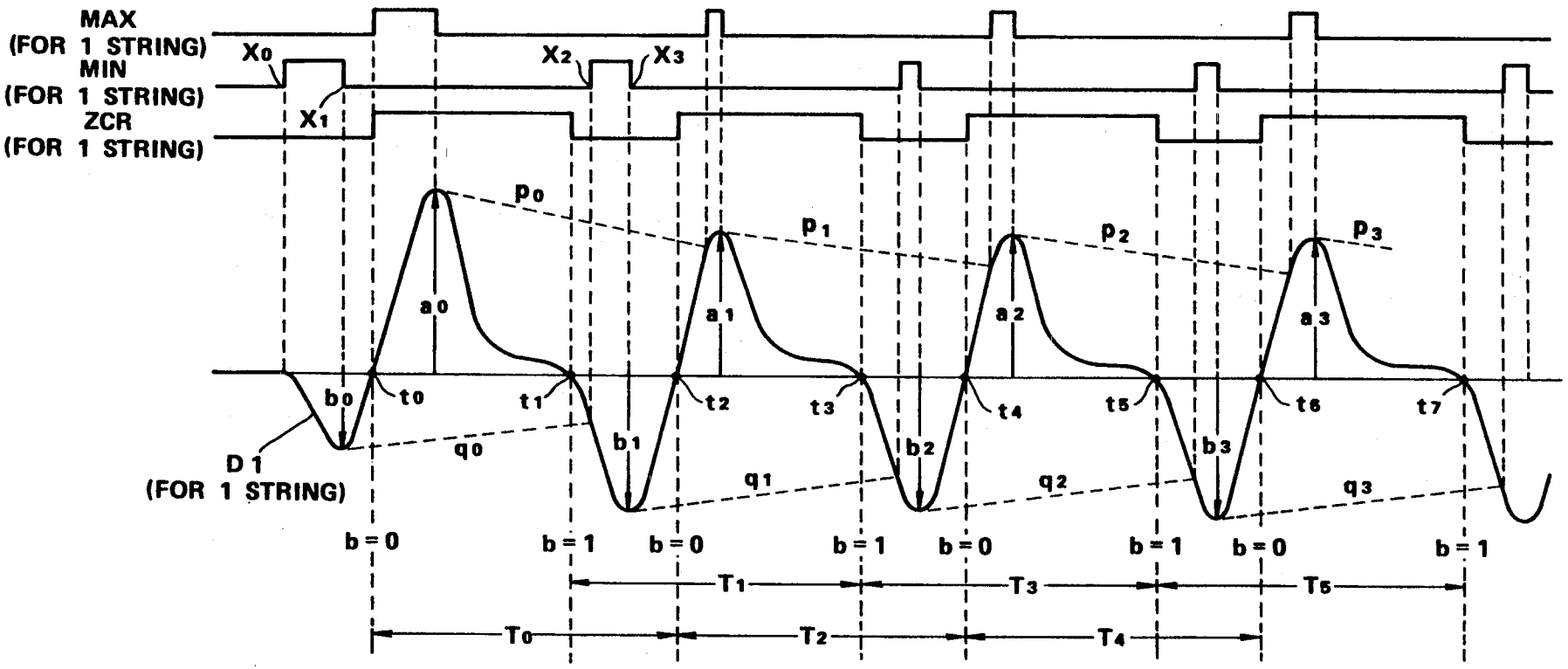
FIG. 11 is a chart for explaining a schematic operation of this embodiment.

A waveform D1 in FIG. 11 represents the digital output D1 for one string output from the pitch extraction analog circuit 1 shown in FIG. 1 in an analog manner. This output waveform signal is a digital signal, which is obtained from an electrical signal detected by the corresponding pickup when one of the six strings of the guitar (not shown) is plucked. The waveform signal has pitch periods indicated by $T_0$ to $T_5$ in FIG. 11 in accordance with a position where the string is pressed on a fret (finger board) (not shown).

In this embodiment, the pitch periods $T_0$ to $T_5$ and the like are extracted in real time, so that the MCP 3 generates corresponding tone pitch data and causes the musical tone generator 501 shown in FIG. 2 to generate a musical tone having the tone pitch. Therefore, when a player changes a tension of the string using a tremolo arm (not shown), the pitch period (fundamental period) of the digital output D1 is changed accordingly, and tone pitch data is also changed accordingly. As a result, an abundant expression can be added to a musical tone.

In this embodiment, peak values $a_0$ to $a_3$ or $b_0$ to $b_3$ of the digital output D1 shown in FIG. 11 are detected, and particularly, the MCP 3 of FIG. 2 generates tone volume data based on the maximum peak value $a_0$ at the leading edge (upon plucking a string) and transfers the tone volume data to the musical tone generator 5. Thus, a musical tone having tone volume corresponding to a string plucking strength can be generated.

Figure 12:
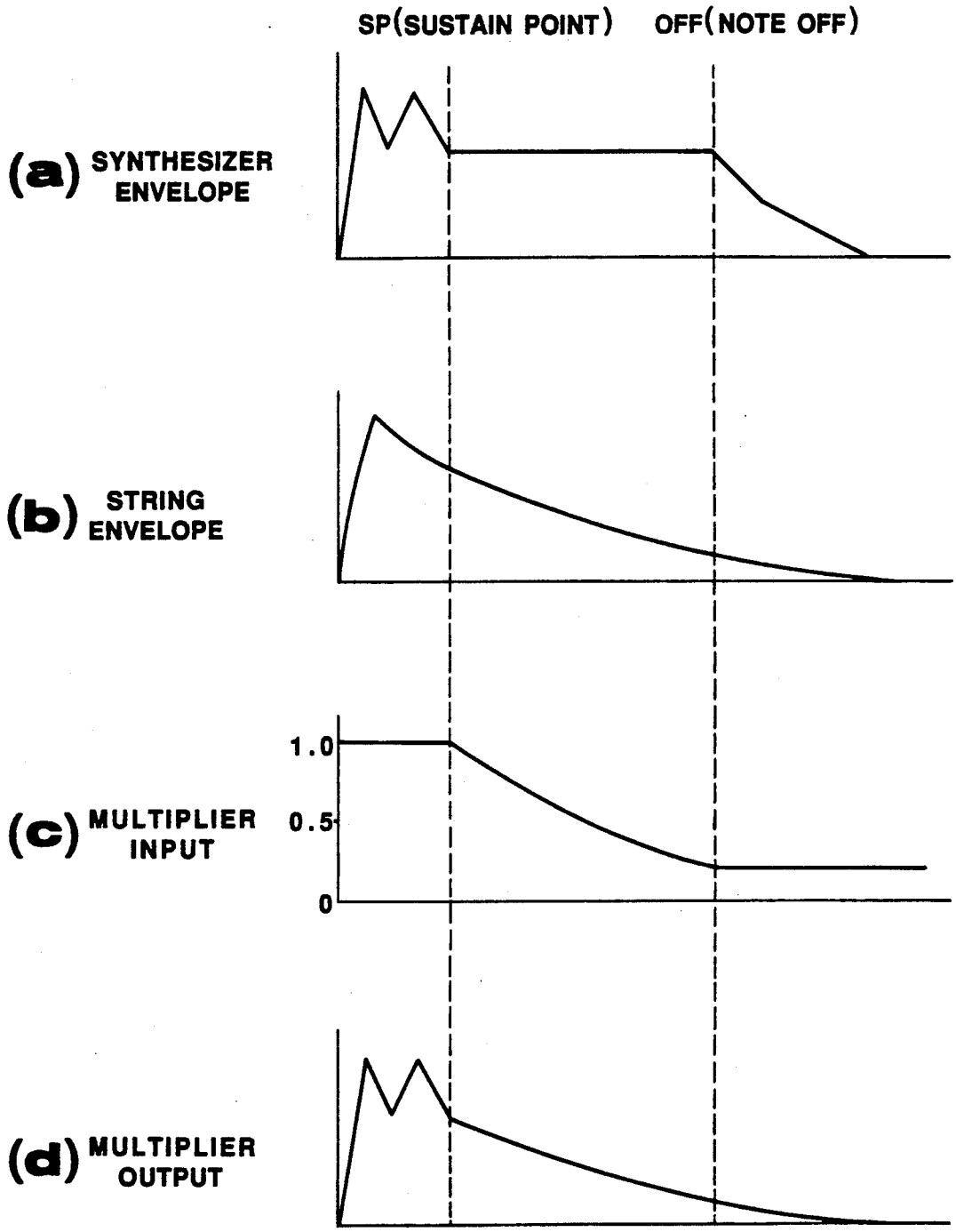
FIG. 12 is a chart for explaining an operation of this embodiments.

The envelope of a musical tone to be generated is most concerned with the present invention. The musical tone signal generated from each of the musical tone generator 5 (#1 to #n) has an envelope, for example, as shown in FIG. 12(*a*) (horizontal axis represents time, and longitudinal axis represents amplitude) under control of the envelope generator ENV included in the musical tone generator 5. Hereinafter this envelope is referred to as a synthe-envelope. In FIG. 12(*a*) SP shows a sustain point (or sustain start point) at which a sustain of the envelope is started, and OFF shows a note-off timing at which a note-off (muting) instruction of a musical tone is outputted.

On the contrary, an envelope of the digital output D1 supplied through hexa-pick ups is shown in FIG. 12(*b*). Hereinafter this envelope is referred to as a string envelope.

When starting a musical tone generation, a value 1.0 is supplied through MIDI-BUS from HCP 3 and set in a corresponding latch 11 so that an input of the multiplier 6 becomes a value 1.0 as shown in FIG. 12(*c*). Accordingly, an attack portion of the envelope of the musical tone signal output from the multiplier 6 maintains a synthe-envelope shown in FIG. 12(*a*). A beginning portion of FIG. 12(*d*) shows this attack character of the envelope.

When the envelope of the musical tone signal generated from the musical tone generator 5 shown in FIG. 2 becomes a sustain state at the sustain point SP, corresponding envelope generator ENV outputs an interrupt signal INT' to MCP 3. Note that, the interrupt signal INT' includes an information designating which envelope generator ENV of musical tone generators 5 (#1 to #n) interrupts a process of MCP 3.

In accordance with the interrupt signal INT', MCP 3 shown in FIG. 2 supplies a value 1.0 to corresponding latch 11 at the sustain point SP, and thereafter successively supplies values which changes based on the string envelope shown in FIG. 12(*b*). Accordingly, an input of the corresponding multiplier 6 varies as shown in FIG. 12(*c*) after the sustain point SP. Note that, the string envelope is detected as a mean value of current peak value and preceding peak value having the same polarity of a digital output D1 supplied from the pitch extraction digital circuit 2 shown in FIG. 2.

Therefore, as shown in the latter half of FIG. 12(*d*) the envelope characteristic of a musical tone signal output from the corresponding multiplier 6 shown in FIG. 2 has a string envelope characteristic shown in FIG. 12(*b*).

According to the above-mentioned operation, a musical tone signal output from the multiplier 6 maintains an envelope characteristic of the musical tone signal generated from the musical tone generator 5 in an attack state immediately after the tone generation start, thereby generating a sound having characteristics of the so-called synthesizer sound. Since an attack portion of a sound generally has an important element for defining a timbre characteristic and the like, it is possible to keep characteristics of the sound by using the envelope of the original synthesizer sound only in the attack state. On the contrary, a string envelope characteristic obtained from the digital output D1 is imparted after the sustain point SP. Therefore, when a player performs the muting operation to compulsorily cease the string vibration by holding the string with the palm of his hand while the vibration of the plucked string has not yet decreased adequately, the vibration represented by the digital output D1 decreases abruptly. The variations of the envelope of the digital output D1 can be imparted to the musical tone signal obtained from the multiplier 6, thereby obtaining the performance effect by the muting operation easily.

Furthermore, after a note-off timing OFF of the digital output D1 is detected by MCP 3, the corresponding latch 11 shown in FIG. 2 maintains a data stored previous to the note-off operation. Therefore, an input of the multiplier 6 becomes a constant value as shown at last portion in FIG. 12(*c*).

Therefore, the variations of the envelope of the musical tone signal output from the corresponding multiplier 6 are determined by the reduced variations of the envelope of the musical tone signal generated from the corresponding musical tone generator 5.

When the player performs the muting operation, the variation of the whole envelope of the digital output D1 is characterized to rapidly decrease as shown at E in FIG. 12. Then, even though the variation of the envelope of the musical tone signal output from the musical tone generator 5 (anyone of generators #1 to #n) has a characteristic as shown at F in FIG. 12, the variation of the envelope of each musical tone output from the multiplier 6 (anyone of multipliers #1 to #n) can be characterized by the tendency to abruptly decrease as shown at G in FIG. 12 in accordance with the variation characteristic of the envelope of the above digital output D1. Thus, the performance effect by the muting operation can be easily obtained.

Since the above-mentioned operation is achieved by time-divisional processing for the time-divisional digital output D1 for the six strings of the guitar, a plurality of the latches 11 (#1 to #n) and the multipliers 6 (#1 to #n) are controlled in accordance with individual interrupt signals INT' from the envelope generators ENV (#1 to #n) in parallel to simultaneously and acoustically generate musical tones for the six strings through the speaker 10 in FIG. 2. These musical tones can be set to have desired tone volumes and timbres, and various effects can be electronically imparted thereto. Therefore, a great performance effect can be obtained.

{Operation of Pitch Extraction Digital Circuit}

An operation of this embodiment for realizing the above-mentioned operation will be described in detail below.

(General Operation)

The operation of the pitch extraction digital circuit 2 shown in FIG. 2 or 3 will be described below. The following description will be made for one string, and the serial zero-cross signal ZCR, the digital output D1, and the maximum and minimum peak value detection signals MAX and MIN will be described for one string. However, in practice, time-divisional processing is performed for the six strings.

The circuit 2 extracts the peak values $a_0$ to $a_3$ or $b_0$ to $b_3$, and at the same time, extracts zero-cross times $t_1$ to $t_7$ immediately after the corresponding peak values from the digital output D1 shown in FIG. 11 for each of the strings. Furthermore, the circuit 2 extracts data indicating "1" or "0" in accordance with whether the peak value immediately before the corresponding zero-cross time is negative or positive, and supplies the extracted data to the MCP 3 shown in FIG. 2. Based on these data, the MCP3 extracts the pitch periods $T_0$ to $T_5$ shown in FIG. 11 from intervals of the zero-cross times, generates various musical tone data described above, and performs error processing, note-off (muting) processing, relative-on/off processing, and the like as needed, as will be described later.

(Detailed Operation)

For this purpose, in the peak detector 201 shown in FIG. 3, in response to the digital output D1 input as shown in FIG. 11, the minimum peak value detection signal MIN goes to H level at a timing $x_0$ when the absolute value of the output D1 exceeds 0 is a portion taking a negative value.

In response to this signal, the peak value fetching circuit 203 shown in FIG. 3 detects a minimum peak value (negative peak value) $b_0$ (absolute value) from the separately input digital output D1 at a timing $x_1$ immediately after the minimum peak value detection signal MIN goes to N level, and holds the value in an internal latch (not shown). At the same time, the circuit 203 sets the minimum peak value detection signal MIN at L level.

The serial zero-cross signal ZCR shown in FIG. 11 is input from the pitch extraction analog circuit 1 shown in FIG. 2 to the zero-cross time fatching circuit 204 shown in FIG. 3. This signal is obtained as follows. That is, a comparator (not shown) in the pitch extraction analog circuit 1 determines a positive or negative level of the digital output D1, and outputs an H- or L-level binary digital signal according to the determination result.

The zero-cross time fetching circuit 204 latches time $t_0$ (FIG. 11) counted by the time-base counter 2041 shown in FIG. 3 at an edge timing when the serial zero-cross signal ZCR changes immediately after the minimum peak value detection signal MIN output from the peak detector 201 goes to H level at the timing $x_0$ i.e., the zero-cross timing of the digital output D1. Note that a positive/negative flag of "1" or "0" indicating that an immediately preceding peak value is positive or negative (0 for minimum peak value $b_0$) is added to the most significant bit (MSB) of this latch data.

The zero-cross time fetching circuit 204 outputs the interruption signal INT to the MCP 3 shown in FIG. 2 upon completion of the above-mentioned operation. Thus, when the interruption signal INT is generated, the peak value fetching circuit 203 shown in FIG. 3 holds the minimum peak value $b_0$ (absolute value), and the zero-cross time fetching circuit 204 latches zero-cross time including the positive/negative flag immediately after the minimum peak value $b_0$ is generated.

After the interruption signal INT is output, the MCP 3 in FIG. 2 makes access (to be described later) through the address decoder 4, so that the zero-cross time including the positive/negative flag and the minimum peak value $b_0$ are transferred to the MCP 3 through the bus BUS. Note that since the abovementioned processing is achieved by the time-divisional processing for the six strings, the zero-cross time fetching circuit 204 outputs data indicating an interrupted string number to the MCP 3 before the respective data are output.

In the peak detector 201 shown in FIG. 3, the internal peak hold circuit (not shown) holds the minimum peak value $b_0$ (absolute value) shown in FIG. 11, and outputs a peak hold signal $q_0$ shown in FIG. 11. In response to this signal, the peak detector 201 again sets the minimum peak value detection signal MIN at H level using the peak hold signal (absolute value) as a threshold value at a timing $x_2$ when the absolute value exceeds the threshold value on the negative side of the digital output D1.

The peak value fetching circuit 203 in FIG. 3 holds the next minimum peak value $b_1$ (absolute value) at a timing $x_3$ immediately after the minimum peak value detection signal MIN goes to H level in the same manner as described above. The zero-cross time fetching circuit 204 in FIG. 3 latches zero cross time $t_2$ including the positive/negative flag (0 in this case) immediately after the minimum peak value $b_1$ is generated. The held value and the latched time are transferred to the MCP 3 after the interruption signal INT is generated.

Detection of the maximum peak values $a_0$ to $a_3$, and the like, detection of zero-cross times $t_1$, $t_3$, $t_5$, $t_7$ and the like, and output operations of peak hold signals $p_0$ to $p_3$, and the like on the positive side of the digital output D1 are executed in the same manner as the detection of the minimum peak values $b_0$ to $b_3$ (absolute values), and the like, the zero-cross times $t_0$, $t_2$, $t_4$, $t_6$, and the like, and output operations of the peak hold signals $q_0$ to $q_3$, and the like on the negative side of the digital output D1 shown in FIG. 11. Note that in this case, the peak detector 201 outputs the maximum peak value detection signal MAX, as shown in FIG. 11. The peak value fetching circuit 203 and the zero-cross time fetching circuit 204 shown in FIG. 3 latch the maximum peak values $a_0$ to $a_3$, and the like, and zero-cross times $t_1$, $t_3$, $t_5$, $t_7$ and the like including the positive/negative flag (1 in this case because of a positive peak) respectively.

With the above-mentioned operations, the zero-cross time fetching circuit 204 shown in FIG. 3 outputs the interruption signal INT to the MCP 3 shown in FIG. 2 at each of the zero-cross times $t_0$ to $t_7$ shown in FIG. 11, and pairs of minimum or maximum peak values (absolute values) and zero-cross times, such as $b_0$ and $t_0$, $a_0$ and $t_1$, $b_1$ and $t_2$, $a_1$ and $t_3$, . . . , are output to the MCP 3 at the corresponding times based on the interruption signal INT. In the MCP 3, determination of the minimum peak value (negative peak value) or maximum peak value (positive peak value) can be performed by the positive/negative flag added to the NSB of the zero-cross time.

In addition to the above-mentioned operation, the peak value fetching circuit 203 can arbitrarily output an instantaneous value of the digital output D1 upon accessing from the MCP 3. This operation will be described later.

The attenuation factor (time constant) of each of the peak hold signals $p_0$ to $p_3$, $q_0$ to $q_3$, and the like shown in FIG. 11 generated by the peak hold circuit in the peak detector 201 in FIG. 3 are changed by the time constant conversion controller 202 in FIG. 3 under control of the MCP 3.

Basically, the time constant is changed so that the peak hold signal is immediately attenuated after one pitch period of the digital output D1 has passed. Pitch period data in this case is set in a time constant conversion register CHTRR (to be described later) in the time constant conversion controller 202 through the bus BUS after the MCP 3 in FIG. 2 extracts the pitch periods as will be described later. Thus, the time constant conversion controller 202 compares the content of an internal counter (not shown) for each string with the pitch period data set in the time constant conversion register CHTRR from the MCP 3. When a coincidence output is generated after the pitch period has passed, the controller 202 sends a time constant change signal to the peak detector 201. With this operation, the peak hold circuit is immediately attenuated after one pitch period has passed, and hence, a peak of the next pitch period can be appropriately detected.

When the next maximum or minimum peak value detection signal MAX or MIN is detected by the peak detector 201 before one pitch period passes, the internal counter is reset in response to the trailing edge of the signal, and the next peak hold signal is generated.

A vibration period of each string is widely changed depending on a position where a player presses the string on the fret. Therefore, at the leading edge of the waveform of the digital output D1 corresponding to each string, in order to quickly detect the vibration of the waveform, the peak hold signal is set to be immediately attenuated in a highest tone period of each string. Immediately thereafter, the peak hold signal is set to be immediately attenuated in an open string period (lowest tone period) of each string so as not to pick up an overtone of each pitch period. After the pitch period is effectively extracted, the peak hold signal is set to be immediately attenuated in the corresponding pitch period so as to follow a change in pitch period of each string of the digital output D1 by the performance operation.

Furthermore, in the pitch detector 201, whether the peak hold control is to be performed for the positive or negative peak value is determined in accordance with the H- or L-level serial zero-cross signal ZCR (FIG. 11).

{Operation of MCP}

With the above operation, the MCP 3 shown in FIG. 2 performs pitch extraction and extraction of parameters associated with a tone volume and a timbre on the basis of the maximum or minimum peak value, the zero-cross time, and the positive/negative flag indicating a positive or negative peak value supplied from the pitch extraction digital circuit 2 shown in FIG. 2, thereby generating musical tone control data for controlling the musical tone generator 5 (generators #1 to #n). Note that the MCP 3 executes the operation flow charts shown in FIGS. 4 to 10C in accordance with the programs stored in the ROM 301, as will be described below.

(Description of Variables)

Variables used in the control programs shown in the operation flow charts of FIGS. 4 to 10C (to be described later) will be described below.

AD . . . input amplitude value (instantaneous value) obtained by directly reading the input waveform D1 to the pitch extraction digital circuit 2 in FIG. 2

AMP (0,1) . . . positive or negative old peak value

AMRL1 . . . old amplitude value (peak value) stored in an amplitude register and used for a "relative-off" check. The "relative-off" operation means muting operation on the basis of immediate attenuation of the peak value, and corresponds to muting processing when a fret operation is finished, thereby becoming an open string status.

AMRL2 . . . amplitude value (peak value) before the old amplitude value stored in the amplitude register and used for the relative off operation. The value AMRL1 is input as this value.
CHTIM . . . period corresponding to a highest tone fret (22nd fret in this embodiment)
CHTIO . . . period corresponding to an open string fret
CHTRR . . . time constant conversion register arranged in the time constant conversion controller 202 (FIG. 3)
DUB . . . flag indicating that waveforms in the same direction (positive/negative direction) are successively input
FOFR . . . relative-off counter
GENVO . . . envelope data at a sustain point
GENV . . . envelope data
HNC . . . waveform number counter
MT . . . flag (positive=1, negative=0) indicating a side for which pitch extraction is to be performed
NCHLV . . . no change level (constant)
OFTIM . . . off time (corresponding to an open string period of the corresponding string)
OFPT . . . normally off check start flag
ONF . . . note-on flag
RIV . . . flag for switching a processing route in STEP 4 (to be described later)
ROFCT . . . constant for determining the number of times of relative-off check
S . . . flag designating before the sustain point (S=0), or after it (S=1)
STEP . . . register (taking a value between 0 to 5) for designating a flow operation of the MCP 3
TF . . . valid old zero-cross time data
TFN(0,1) . . . old zero-cross time data immediately after a positive or negative peak value
TFR . . . time storing register
THLIM . . . upper limit frequency (constant)
TLLIM . . . lower limit frequency (constant)
TP(0,1) . . . positive or negative old period data
TRLAB(0,1). . . positive or negative absolute trigger level (note-on threshold value)
TRLRL . . . threshold value for relative-on operation (restart of tone generation)
TRLRS . . . resonance removal threshold value
TTLIM . . . lower limit frequency upon triggering
TTP . . . previously extracted period data
TTR . . . period register
TTU . . . constant (product of 17/32 and present period data tt)
TTW . . . constant (product of 31/16 and present period dat tt)
VEL . . . data for determining a velocity, and determined by the maximum peak value of the waveform at the beginning of tone generation (string vibration)
x . . . flag indicating an abnormal or normal state
b . . . present positive/negative flag stored in a working register b (1 for the next zero point of a positive peak; 0 for the next zero point a negative peak)
c . . . present peak value stored in a working register C
e . . . peak value before the old peak value, stored in a working register E
h . . . period data extracted in a period before the immediately preceding period, which is stored in a working register H
t . . . present zero-cross time stored in a working register TO
tt . . . present period data stored in a working register TOTO (Operation of Interruption Processing Routine)

Figure 4:
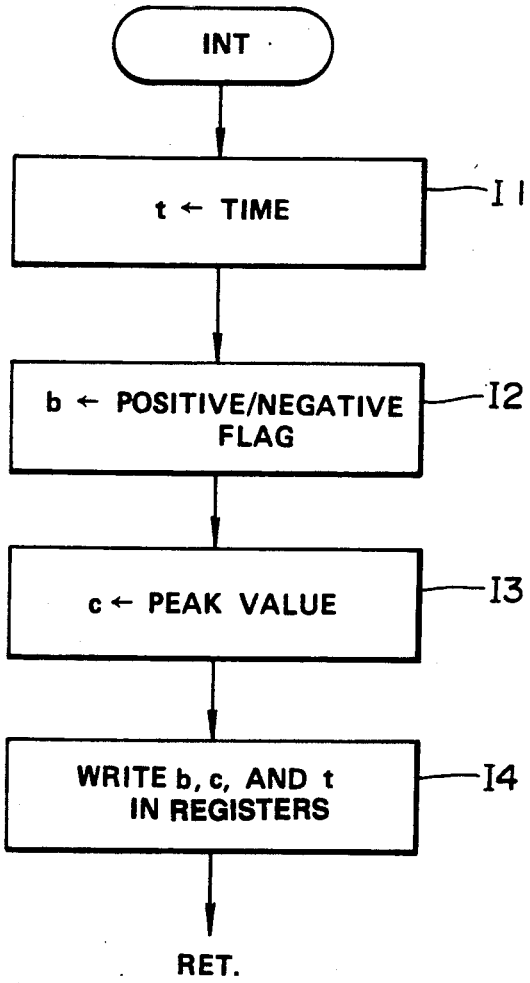
FIG. 4 is an operation flow chart of an interruption processing routine of MCP.

FIG. 4 is an operation flow chart of an interruption processing routine showing a processing to be executed when an interruption is performed in response to the interruption signal INT from the zero-cross time fetching circuit 204 (FIG. 3) in the pitch extraction digital circuit 2.

As described above, when the interruption signal INT is output from the zero-cross time fetching circuit 204, the peak value fetching circuit 203 in FIG. 3 holds the maximum or minimum peak value (absolute value), and the zero-cross time fetching circuit 204 latches the zero-cross time immediately after the corresponding peak value is generated and the positive/negative flag indicating "1" when the immediately preceding peak value is the maximum (positive) peak value and "0" when it is the minimum (negative) peak value.

In Step I1 in FIG. 4, the MCP 3 sets a predetermined address read signal AR in the address decoder 4, and causes the zero-cross time fetching circuit 204 in FIG. 3 to output the string number read signal $\overline{\text{RDNUM}}$. The circuit 204 thus outputs, to the MCP 3 through the bus BUS, the string number data indicating a string number for which the interruption occurs. Subsequently, the MCP 3 sets another address read signal AR in the address decoder 4, and causes the zero-cross time fetching circuit 204 to output a signal corresponding to the string number of the time read signals RDTIM1 to RDTIM6. The circuit 204 outputs, to the MCP 3 through the bus BUS, zero-cross time data set in a latch corresponding to the string number by the output time read signal $\overline{\text{RDTIMi}}$ (i=1 to 6). This time data is set as the present zero-cross time t, as shown in step I1 in FIG. 4.

In step I2 in FIG. 4, as has been described in Section "Operation of Pitch Extraction Digital Circuit", the positive/negative flag added to the MSB of the zero-cross time data is extracted, and is set as the present positive/negative flag b.

Thereafter, in step I3 in FIG. 4, the MCP 3 causes the peak value fetching circuit 203 in FIG. 3 to output a peak value read signal $\overline{\text{RDAj}}$ (j=1 to 12) through the address decoder 4 in the same manner as described above. Note that since the circuit 203 includes 12 latches (not shown) for holding maximum and minimum peak values for the six strings, the MCP 3 causes the address decoder 4 to selectively output the peak value read signal $\overline{\text{RDAj}}$ on the basis of the string number and the positive/negative flag b. Thus, the maximum or minimum peak value (absolute value) set in the latch designated by the peak value read signal $\overline{\text{RDAj}}$ is output from the circuit 203 to the MCP 3 through the bus BUS. This peak value is set as the present peak value c, as shown in step I3 in FIG. 4.

After the above operations, in step I4 in FIG. 4, the values t, c, and b obtained as described above are set in registers TO, C and B (not shown). Every time the interruption processing is executed, a set of the zero-cross time data, the peak value data (absolute value), and the positive/negative flag data indicating the peak polarity is set in these registers. In a main routine (to be described later), processing for data associated with each string is performed.

The registers TO, C and B are arranged six each in correspondence with the six strings. The MCP 3 in FIG. 2 keeps data at its RAM 302, which data indicates for which string each musical tone generators (#1 to #n) and each multiplier 6 (#1 to #n) are executing a sounding operation and an envelope control operation. Musical tone control processing and envelope control processing to be described with reference to FIGS. 5 to 10 are time-divisionally performed for six strings. The MCP 3 executes processing for the musical tone generator 5 and multiplier 6 corresponding to the above registers TO, C and B which correspond to a string to which the interruption occurs. Hereinafter, unless otherwise specified, the above operation is executed.

(Operation of Main Routine)

Figure 5:
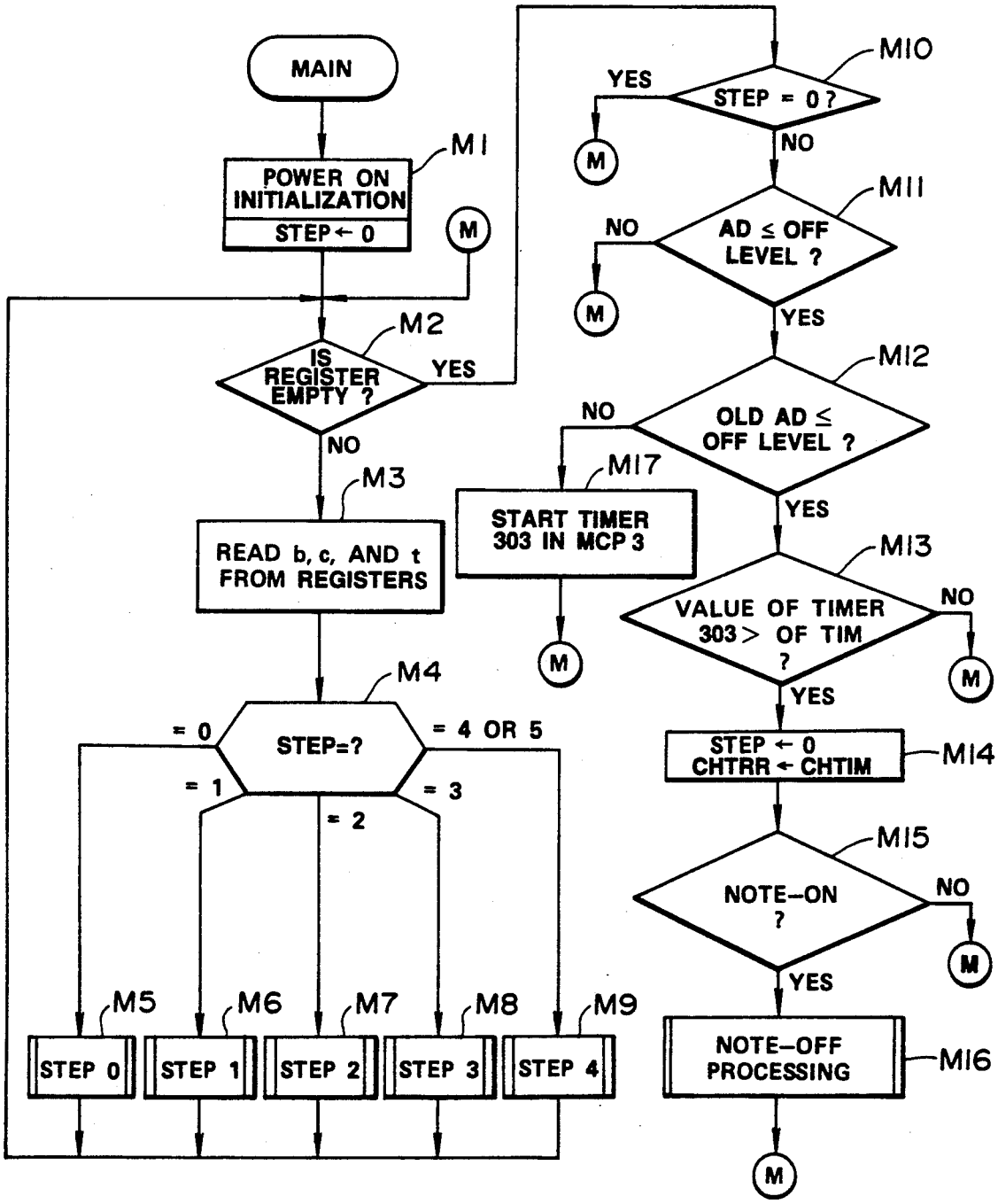
FIG. 5 is an operation flow chart of a main routine of MCP.

FIG. 5 is an operation flow chart showing main routine processing. In this routine, initialization after power-on, note-off (muting) processing of a musical tone, and selection processing of operations of STEP 0 to STEP 4 (or 5) are performed. In this embodiment, as will be described later, musical tone control processing is performed according to the processing concept named "STEP", that is, musical tone control is performed in the order of STEP 0→STEP 1→STEP 2→STEP 3→STEP 4 (→STEP 5)→STEP 0, as will be described later.

<Basic Operation>

In FIG. 5, when a power switch is turned on, various registers and flags are initialized in step M1, and the register STEP is set to be "0". In this case, as has been described in the description of the time constant conversion controller 202 (FIG. 3) in Section "Operation of Pitch Extraction Digital Circuit", the MCP 3 sets the highest tone fret period CHTIM in the time constant conversion register CHTRR in the time constant conversion controller 202 through the bus BUS, so that the peak detector 201 (FIG. 3) can quickly detect a vibration at the leading edge of the waveform of the digital output D1. Thus, control is performed so that the peak hold signal ($P_0$ or $q_0$ in FIG. 11) output from the peak hold circuit in the peak detector 201 is immediately attenuated in the highest tone period time.

Subsequently, in step M2 in FIG. 5, it is checked if the register described in Section "Operation of Interruption Processing Routine" is empty. If NO in step M2, the flow advances to step M3, and the contents of the registers B, C and TO are read. In step M4, the value of the register STEP is checked. Processing operations of STEP 0, STEP 1, STEP 2, STEP 3 and STEP 4 are sequentially executed in steps M5, M6, M7, M8 and M9. Note that updating to the next STEP is performed in the processing of STEP 0 to STEP 4, as will be described later.

<Note-Off Operation>

If it is determined in step M2 that the register is empty, i.e., YES in step M2, the control advances to processing in steps M10 to M16. In these steps, normal note-off algorithm processing is performed. In this note-off algorithm, if a state wherein the peak value of the digital output D1 (FIG. 2) is equal to or smaller than an OFF level is continued for a predetermined off time, a note-off operation is performed.

It is checked in step M10 if STEP=0. If Yes in step M10, the note-off operation need not be performed since an initial state wherein no musical tone is generated is detected. Thus, the flow returns to step M2. If NO in step M10 the flow advances to step M11.

In step M11, the input peak value (instantaneous value) AD of digital output D1 at that time is directly read. This can be achieved as follows. The MCP 3 supplies one of the peak value read signals RDA13 to RDA18 to the peak value fetching circuit 203 (FIG. 3) through the address decoder 4, so that the circuit 203 outputs the present instantaneous value of the digital output D1 to the MCP 3 through the bus BUS. It is then checked if this value AD is equal to or smaller than a preset OFF level. If NO in step M11 the flow returns to step M2 since the note-off operation need not be performed. However, if YES in step M11, the flow advances to step M12.

It is checked in step M12 if the old input peak value AD is equal to or smaller than the OFF level. If NO in step M12, the flow advances to step M17, and the timer 303 in the MCP 3 is started. The flow then returns to step M2. When the control comes again to this processing, since YES is obtained in step M12, the flow advances to step M13 to check if the value of the timer 303 is equal to the off time OFTIM. As the off time OFTIM, the open string fret period CHTIO of a string subjected to processing is set. If NO in step M13, the flow returns to step M2 to repeat the above-mentioned processing. If YES in step M13, the flow advances to step M14, and data "0" is written in the register STEP and the highest tone fret period CHTIM is set in the time constant conversion register CHTRR. Thereafter, the flow advances to step M16 via step M15 (to be described later). More specifically, when the level of the digital output D1 becomes attenuated, if the input peak vaue AD equal to or smaller than the OFF level is kept unchanged for a time period corresponding to the off time OFTIM, it can be determined that no digital output D1 is input and a plucking operation of a string is stopped. Thus, the flow then advances to step M16, and note-off processing is performed.

In step M16, the MCP 3 sends a note-off instruction to the musical tone generator 5 (any one of #1 to #5) (FIG. 2), thus stopping generation of a musical tone. In this manner, when the note off processing is performed, the flow must return to STEP 0.

In a normal state, YES is obtained in step M15. However, with processing to be described below, the register STEP may take a value other than 0 even when a generation instruction of a musical tone is not performed (caused by, e.g., a noise input). In this case, the flow returns to step M2 after processing in steps M14 and M15, so that the register STEP can be initialized to STEP 0.

(Processing Operation in STEP 0)

Each routine branching from the main routine shown in FIG. 5 and performing the corresponding processing will be described below.

Figure 6:
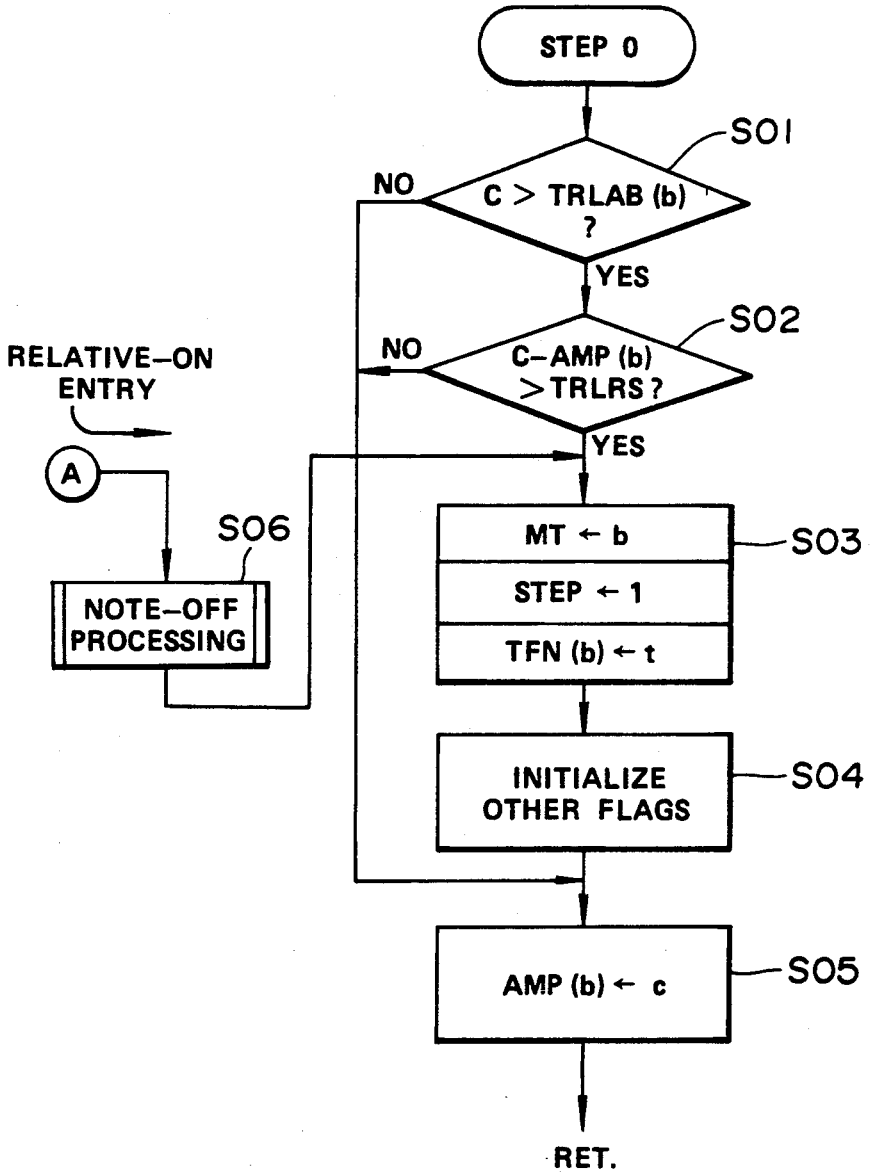
FIG. 6 is an operation flow chart of processing STEP 0 shown in FIG. 5.
Figure 13:
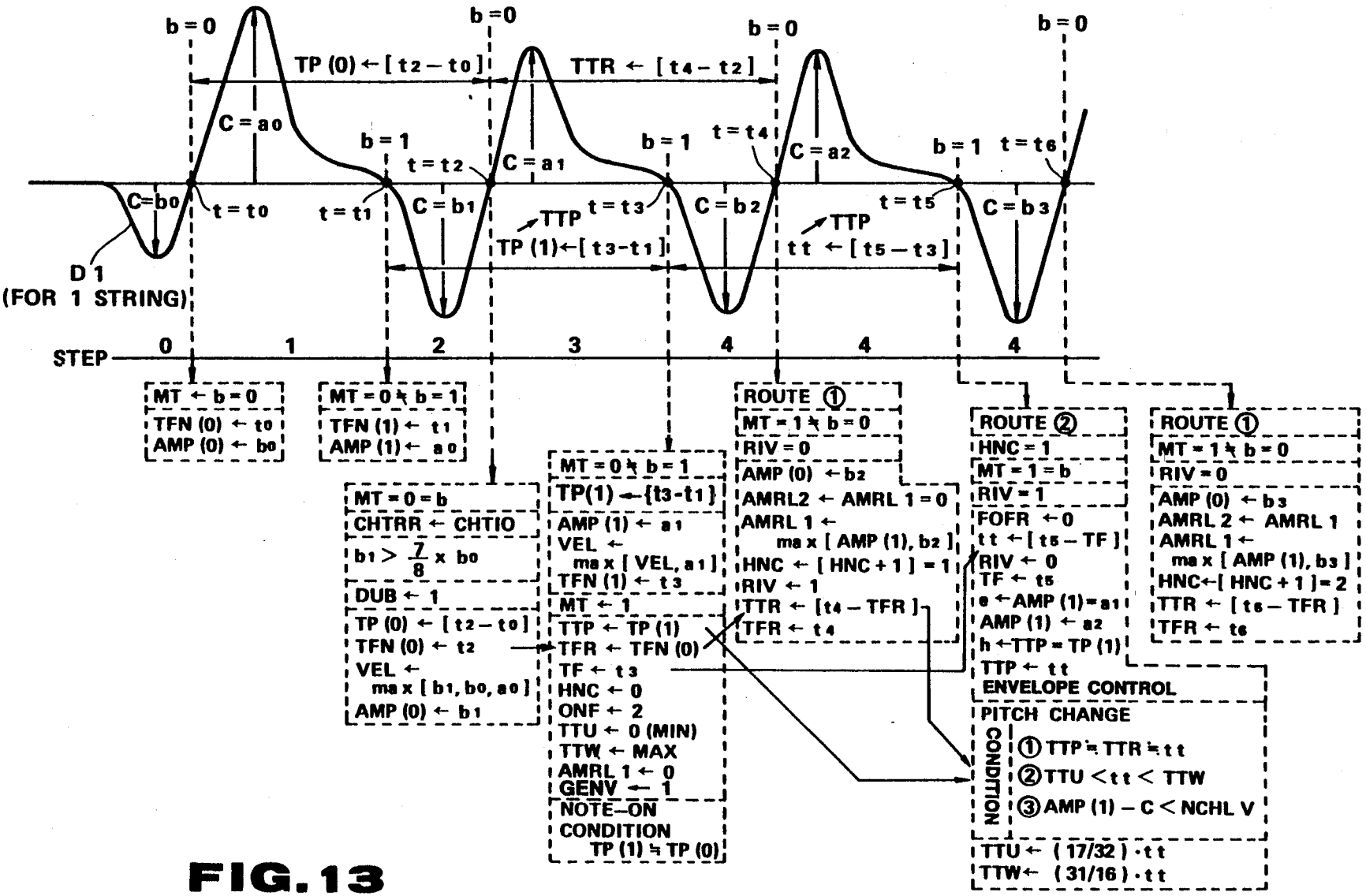
FIG. 13 is a chart for explaining a basic operation of this embodiment.

FIG. 6 is an operation flow chart of processing in STEP 0 as step M5 in the main routine shown in FIG. 5. In this processing, initialization for pitch extraction processing, and the like, and transition processing to next STEP 1 are performed. A description will be made with reference to the chart of FIG. 13 for explaining the basic operation. Note that a waveform in FIG. 13 is the same as that in FIG. 11.

<Basic Operation>

Now, the main routine shown in FIG. 5 waits for data input to the registers TO, C, and B upon interruption from the pitch extraction digital circuit 2 (FIG. 2) by repeating the loop of steps M2 and M10, as has been described in Section "Operation of Interruption Processing Routine".

When data is input and the contents of the registers are read in step M3 in FIG. 5, the flow advances to step M5 via step M4, i.e., the control transits to STEP 0 in FIG. 6. In this state, for example, as shown in FIG. 13, the present zero-cross time $t=t_0$, the positive/negative flag $b=0$, and the present peak value is the minimum peak value $c=b_0$ (absolute value) since $b=0$. Note that in FIG. 13, b and $b_0$ to $b_3$ and the like are different symbols.

It is checked in step S01 in FIG. 6 if the present peak value c is larger than the absolute trigger level (positive threshold value for note-on operation) TRLAB(b). This checking operation is executed for positive and negative polarities on the basis of the value of the present positive/negative flag b. The positive absolute trigger level TRLAB(1) and the negative absolute trigger level TRLAB(0) can be set to be different values according to an experience in consideration of a case wherein an offset is superposed on the digital output D1 (FIG. 2). In an ideal system, these trigger levels can be the same value. In FIG. 13, the present minimum peak value $c=b_0$ (absolute value) is compared with TRLAB(b)=TRLAB(0), and yields $c=b_0>$TRLAB(0), that is, YES is obtained in step S01.

After step S02 (to be described later), processing in step S03 is executed. The present positive/negative flag b is written in a flag MT, and data "1" written in the register STEP to prepare for transition to the next step. Furthermore, the present zero-cross time t is set as old zero-cross time data TFN(b) for the following processing. In FIG. 13, MT=b=0, and TFN(b)=TFN(0)=$t=t_0$.

In step S04, flags (excluding constants) other than the flags described in the Section "Description of Variables" are initialized.

In step S05, the present peak value c is set as an old peak value AMP(b) (absolute value) for the following processing, and the flow returns to step M2 in the main routine in FIG. 5. In FIG. 13, AMP(b)=AMP(0)=$c=b_0$.

With the above processing, in FIG. 13, the present positive/negative flag $b=0$ of the register B is written in the flag MT, the present zero-cross time data $t=t_0$ of the register TO is written as the negative old zero-cross time data TFN(0), and the present minimum peak value $c=b_0$ of the register C is written as the negative old peak value AMP(0), as indicated between STEP 0 and STEP 1.

<Resonance Removal Operation>

Note that it is determined in step S01 in FIG. 6 that the present peak value c is equal to or smaller than the absolute trigger level TRLAB(b), the control does not transit to the note-on processing. In this case, only the present peak value c is set as the old peak value AMP(b) in step S05, and the flow returns to the main routine shown in FIG. 5. However, when one string is plucked and another string is resonated, the vibration level of the another string is gradually increased. YES is then obtained in step S01 in FIG. 6, and the flow advances to the processing in step S02. However, in this case, since no regular plucking operation is performed, it is not proper that the control transits to the note-on operation. Thus, in the processing in step S02, the resonance is removed. More specifically, in this case, since the present peak value c is not almost increased as compared to the old peak value AMP(b), when a difference c−AMP(b) is not larger than the resonance removal threshold value TRLRS, it is determined that the resonance state occurs. Thus, the control does not transit to the note-on processing, and the present peak value c is set in the old peak value AMP(b) in step S05, and the flow returns to the main routine in FIG. 5. On the other hand, when a regular plucking operation is performed, as shown in FIG. 13, a waveform rises immediately, and the difference c−AMP(b) of the peak values exceeds the resonance removal threshold value TRLRS, and the flow advances from step S02 to step S03, as described above.

<Relative on Entry Operation>

In FIG. 6, a node A corresponds to a relative-on (tone regeneration start) entry, and the flow jumps from the flow in STEP 4 (to be described later) to step S06. In step S06, the present output musical tone is muted, and the flow advances to step S03 to start tone regeneration. Processing for starting tone regeneration is the same as that when normal tone generation is started, as described above. Note-off processing in step S06 is the same as that in step M16 in FIG. 5.

(Processing Operation in STEP 1)

Figure 7:
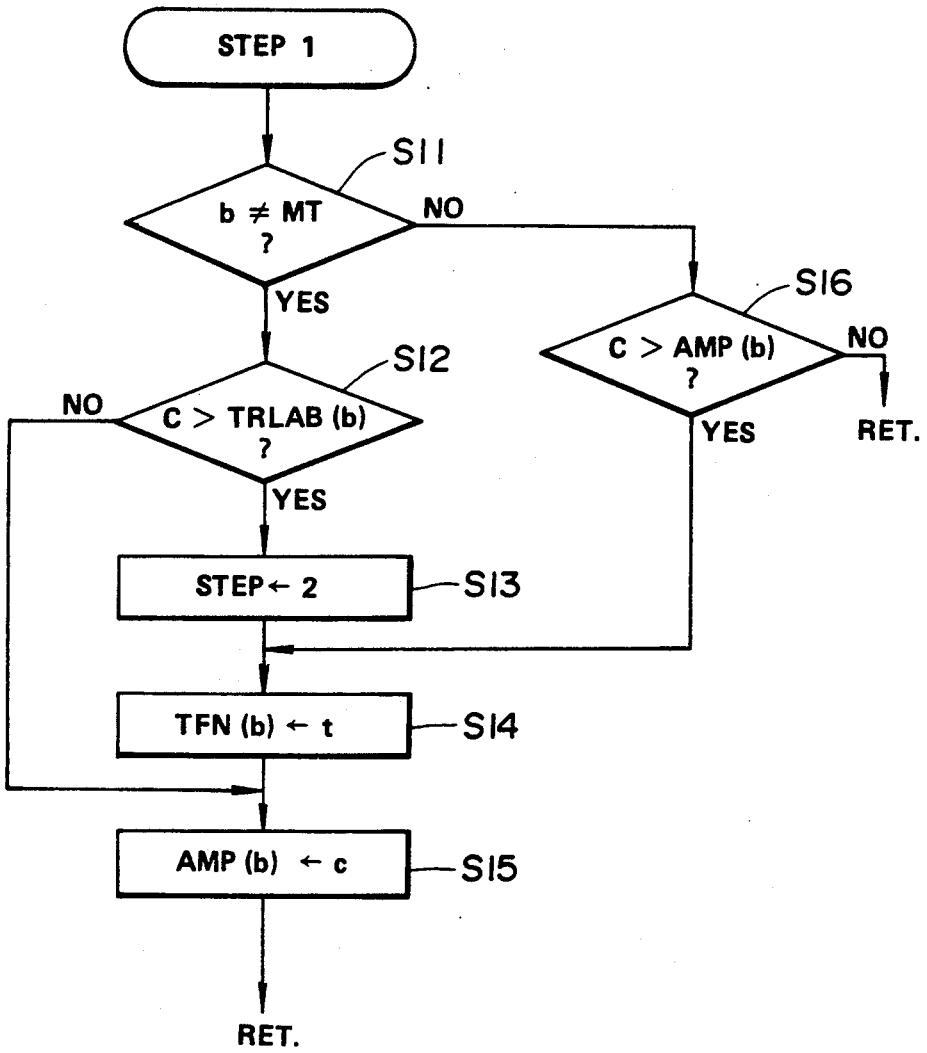
FIG. 7 is an operation flow chart of processing STEP 1 shown in FIG. 5.

FIG. 7 is an operation flow chart of processing in STEP 1 as step M6 in the main routine shown in FIG. 5. In this processing, initialization for pitch extraction processing after STEP 0, transition processing to following STEP 0 or repetition processing (error processing) when an abnormal waveform is input, and the like are performed.

<Basic Operation>

After initialization for the first data is performed in STEP 0, the main routine shown in FIG. 5 waits for data input to the registers TO, C, and B upon interruption for the second time from the pitch extraction digital circuit 2 (FIG. 2) by repeating the loop of step M2→M10→M11→M2.

When data is input and the contents of the registers are read in step M3 in FIG. 5, the flow advances to step M6, i.e., STEP 1 in FIG. 7 via step M4. In this state, for example, as shown in FIG. 13, the present zero-cross time $t=t_1$, the present positive/negative flag $b=1$, and the present peak value is the maximum peak value, $c=a_0$ since $b=1$.

After step S11 in FIG. 7 (to be described later), it is checked in step S12 if the present peak value c is larger than the absolute trigger level TRLAB(b), in the same manner as has been described in a description of step S01 in FIG. 6 in Section "Processing Operation in STEP 0". In FIG. 13, the present maximum peak value, $c=a_0$ is compared with TRLAB(b)=TRLAB(1) and the result is $c=a_0>$TRLAB(1). that is YES is obtained in step S12.

In step S13, data "2" is written in the register STEP to prepare for transition to the next step. In step S1, the present zero-cross time t of the register TO is set as old zero-cross time data TFN(b) for the following processing. In step S15, the present peak value c of the register C is set as the old peak value AMP(b) for the following processing, and the flow returns to the processing in step M2 of the main routine shown in FIG. 5. In FIG. 13, TFN(1)=$t=t_1$, and AMP(1)=$c=a_0$. Note that the content of the flag MT is not rewritten and is kept to be "0".

<Operation of Repetition Processing>

When the normal digital output D1 as shown in FIG. 13 is input, after the negative (minimum)/positive (maximum) peak value (absolute value) is extracted in STEP 0, other side peak value i.e., positive (maximum)/negative (minimum) peak value is extracted in STEP 1. Therefore, in step S11 in FIG. 7, since the present positive/negative flag b=1(0) is different from the flag MT=0(1) set in STEP 0, the flow advances to step S12, as described above.

Figure 14A:
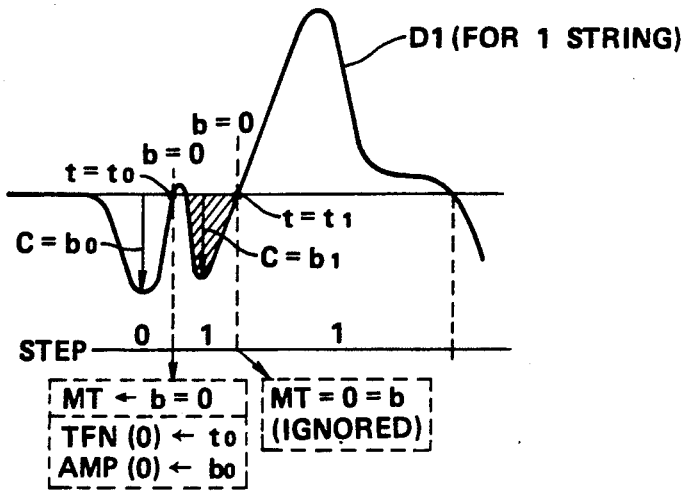
FIGS. 14A and 14B are charts for explaining repetition processing in STEP 1.
Figure 14B:
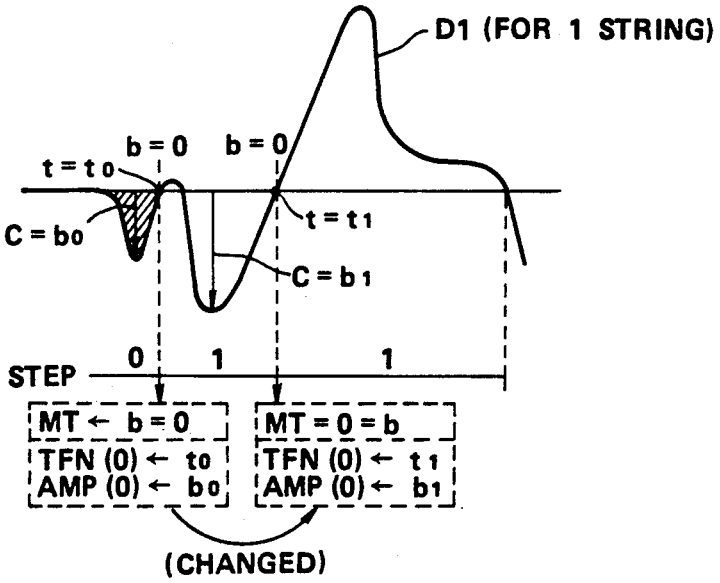

However, in some cases, a waveform shown in FIG. 14A or 14B may be input in STEP 1 after STEP 0. In this case, after the negative minimum peak value $b_0$ is extracted in STEP 0, the negative minimum peak value $b_1$ is repetitively extracted in STEP 1. Therefore, in step S11 in FIG. 7, the present positive/negative flag b=0, and coincides with the flag MT=0 set in STEP 0. In this case, the flow advances to step S16 in FIG. 7, and repetition processing (error processing) is executed.

It is checked in step S16 if the peak value c is larger than the old peak value AMP(b) having the same sign.

In the case of FIG. 14A, $c=b1>AMP(b-)=AMP(0)=b_0$ cannot be established. In this case, the present minimum peak value $b_1$ is ignored as an abnormal waveform (hatched portion), and the content of the register STEP is not updated. The flow returns to the processing in step M2 in the main routine shown in FIG. 5, and inputting of the next normal peak is waited for.

In the case of FIG. 14B, $c=b_1>AMP(b-)=AMP(0)=b0$ can be established. In this case, the minimum peak value $b_0$ extracted in the preceding STEP 0 is ignored as an abnormal waveform (hatched portion), and the contents of the negative old zero cross time data TFN(0) and negative old peak value AMP(0) set in STEP 0 and updated to the present zero-cross time t and the present peak value c in steps S14 and S15 in FIG. 7. More specifically, in FIG. 14B, $TFN(0)=t=t_1$ and $AMP(0)=c=b_1$. After the repetition processing, the content of the register STEP is not updated (without going through step S13 in FIG. 7), and the flow returns to the processing in step M2 of the main routine in FIG. 5. Thus, inputting of the next normal peak is waited for.

After the above-mentioned operation, when the normal peak value is input, the above-mentioned processing is performed in step S11→S12→S13→S14 →S15 in FIG. 7, and for example, when $t=t_1$, the control transits to the next processing of STEP 2, as shown in FIG. 13.

(Processing Operation in STEP 2)

Figure 8:
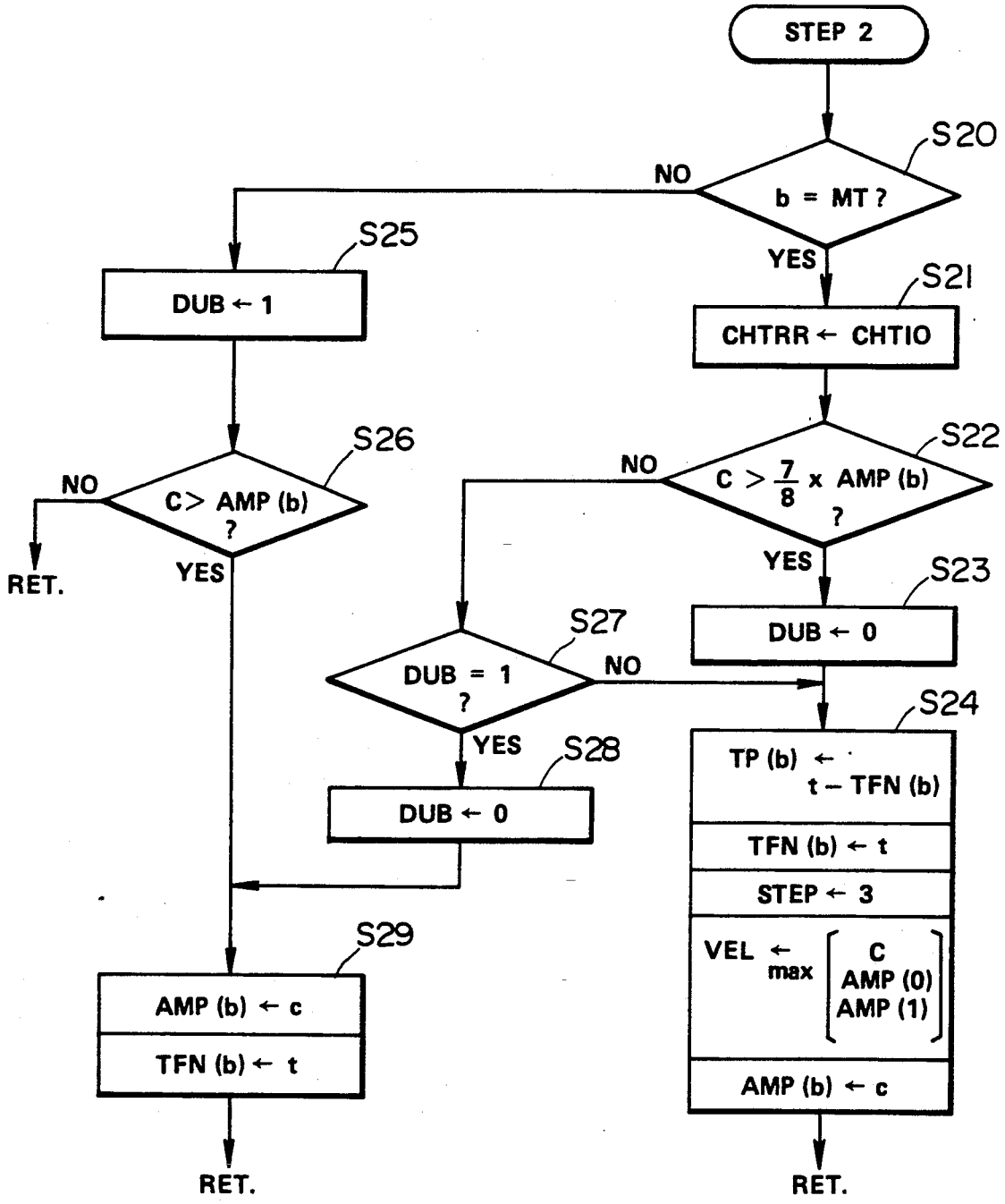
FIG. 8 is an operation flow chart of processing STEP 2 shown in FIG. 5.

FIG. 8 is an operation flow chart of the processing in STEP 2 as step M7 in the main routine of FIG. 5. In this processing, detection of a first pitch period for pitch extraction, setting of a velocity, transition processing to STEP 3 or error processing (repetition processing) when an abnormal waveform is input, and the like are executed.

<Basic Operation>

After the processing in STEP 1 is performed, the main routine shown in FIG. 5 waits for data input to the registers TO, C, and B upon interruption again from the pitch extraction digital circuit 2 (FIG. 2) by repeating the loop of step M2→M10→M11→M2.

When data is input and the contents of the registeres are read in step M3 in FIG. 5, the flow advances to step M7, i.e., STEP 2 in FIG. 8 via step M4. In this state, for example, as shown in FIG. 13, the present zero-cross time $t=t_2$, the present positive/negative flag b=0, and the present peak value is the minimum peak value, $c=b_1$since b=0.

After step S20 in FIG. 8 (to be described later), in step S21, the MCP 3 sets the open string fret period CHTIO of a string, which is presently subjected to processing, in the time constant conversion no register CHTRR in the time constant conversion controller 202 in FIG. 3 through the bus BUS. As has been described with reference to the time constant conversion controller 202 in Section "Operation of Pitch Extraction Digital Circuit", after the peak detector 201 (FIG. 3) detects a vibration at the leading edge of the waveform of the digital output D1, the peak hold signal (p1, q2, and the like in FIG. 11) output from the peak hold circuit in the peak detector 201 is immediately attenuated in the lapse of an open string period of each string, i.e., a lowest tone period CHTIO so that the detector 201 does not pick up an overtone of each pitch period.

It is checked in step S22 if the present peak value c is larger than a $\frac{7}{8}$ multiple of the old peak value AMP(b) having the same sign. As will be described later, since a waveform obtained by plucking a string is naturally attenuated, YES is obtained in step S22, and the flow advances to step S24 via step S23 (to be described later).

In step S24, {(present zero-cross time t)−(old zero-cross time data TFN(b) having the same sign)} is calculated to detect the first pitch period. The difference is set as old period data TP(b) so as to be used as a note-on (tone generation start) condition in STEP 3 (to be described later). In FIG. 13, $TP(0)=t-TFM(0)=t_2-t_0$.

In step S24, the present zero-cross time t is set as the old zero-cross time data TFN(b) for the following processing. In FIG. 13, TFN(0)=t=t2. Note that $TFN(0)=t_0$ set in STEP 0 is no longer necessary and is erased since the old period data $TP(b)=TP=t_0$ can be calculated.

In step S24, data "3" is written in the register STEP to prepare for transition to the next step.

Furthermore, in step S24, for the following processing, a largest one of the present peak value c, and the old peak values AMP(0) and AMP(1) is set as the velocity VEL. Note that the velocity VEL is used as a value for determining a tone volume of a musical tone, as will be described later in STEP 3. Similarly, the present peak value c is set as the old peak value AMP(b), and the flow returns to the processing in step M2 of the main routine shown in FIG. 5. In FIG. 13, VEL=max {c, AMP(0), AMP(1)}=max $\{b_1, b_0, a_0\}$, and hence, $AMP(0)=c=b_1$. Note that $AMP(0)=b_0$ set in STEP 0 is no longer necessary and is erased since the velocity VEL can be calculated.

<Operation of Repetition Processing>

When the normal digital output D1 as shown in FIG. 13 is input, after the positive (maximum)/negative (minimum) peak value is extracted in STEP 1, the other peak value i.e., negative (minimum)/positive (maximum) peak value is extracted in STEP 2. Therefore, in this case, the sign of the peak value in STEP 2 is opposite to that in STEP 1, and is the same as that in STEP 0. In step S20 in FIG. 8, the present positive/negative flag b=0(1) coincides with the flag MT=1(0) set in STEP 0, and the flow advances to step S21, as described above.

Figure 15A:
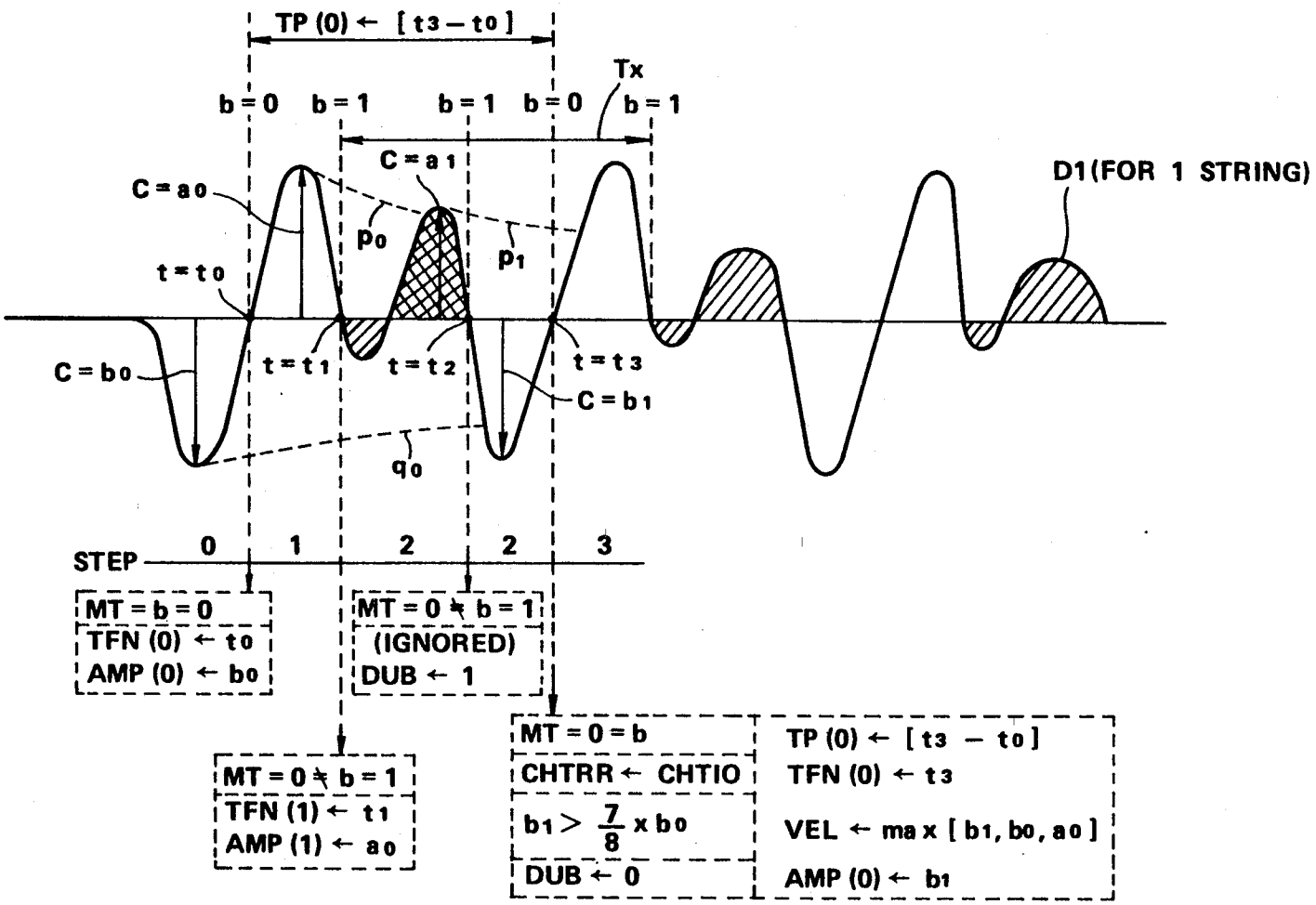
FIGS. 15A, 15B, and 15C are charts for explaining repetition processing in STEP 2.
Figure 15B:
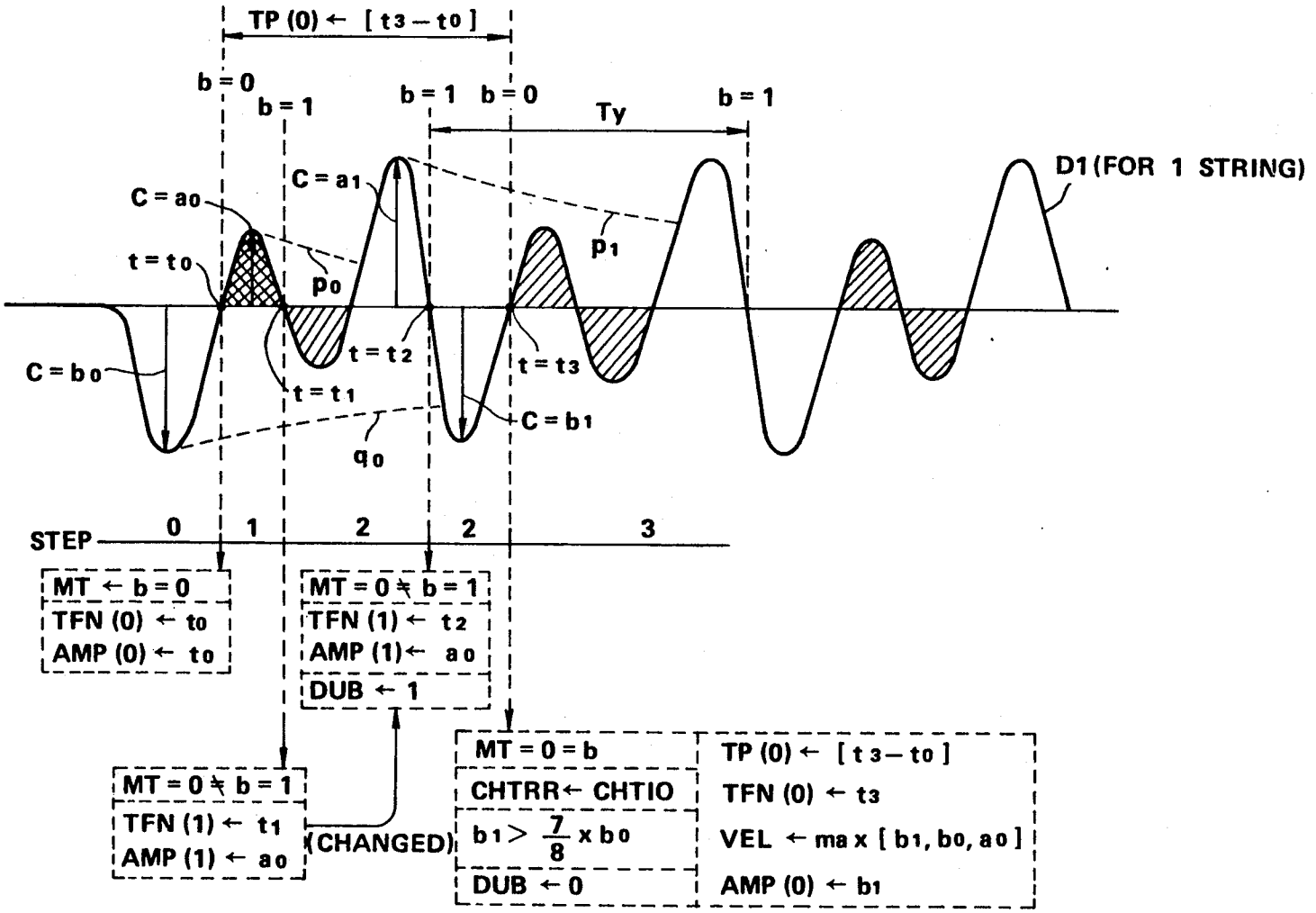

However, as has been described in the description of Sub-section "Operation of Repetition Processing" in Section "Processing Operation in STEP 1", waveforms may be repetitively input after STEP 1, as shown in FIG. 15A or 15B. In this case, after the positive (maximum) peak value $a_0$ is extracted in STEP 1, the positive (maximum) peak value $a_1$ is repetitively extracted in STEP 2. Therefore, in step S20 in FIG. 8, the present positive/negative flag $b=1$, and coincides with the flag $MT=0$ set in STEP 0. In this case, the flow advances to step S25 in FIG. 8, and repetition processing (error processing) is executed. Note that peaks indicated by simple hatching are not detected as peak values, as they do not exceed the peak hold signals $p_0$, $p_1$, $q_0$ shown in FIG. 15A or 15B generated from the peak hold circuit in the peak detector 201 shown in FIG. 3.

In step S25, the repetition flag DUB is set to be "1" (to be described later), and the flow then advances to step S26 to check if the present peak value c is larger than the old peak value AMP(b) having the same sign.

Assuming that STEP 2 is executed at $t=t_2$ after STEP 0 ($t=t_0$) and STEP 1 ($t=t_1$), $c=a_1>AMP(b)=AMP(1)=a_0$ cannot be established. More specifically. NO is obtained in step S26 in FIG. 8. In this case, the present peak value $a_1$ is ignored as an abnormal waveform (cross-hatched portion in FIG. 15A). Thus, the register STEP is not updated, and the flow returns to the processing in step M2 in the main routine shown in FIG. 5 to wait for the next normal peak. When the minimum peak value $c=b_1$ is input at $t=t_3$, YES is obtained in step S20 in FIG. 8, and the processing in step S21→S22→S23→S24 is executed in the same manner as in FIG. 13. At $t=t_3$ in FIG. 14A, the control transits to the next processing in STEP 3. Note that the old period data TP(0) set in step S24 in FIG. 8 corresponds to a difference between the present zero-cross time $t_3$ and the old zero-cross time $t_0$ set in STEP 0, as shown in FIG. 15A. The start point of the next period data $T_x$ calculated in STEP 3 (to be described later) corresponds to the old zero-cross time $TFN(1)=t_1$ set in STEP 1 since the cross-hatched peak ($c=a_1$) is ignored, as shown in FIG. 15A.

On the contrary, in FIG. 15B, $c=a_1>AMP(b)=AMP(1)=a_0$ can be established. That is, YES is obtained in step S26 in FIG. 8. In this case, the maximum peak value $a_0$ extracted in the preceding STEP 1 is ignored as an abnormal waveform (cross-hatched portion in FIG. 14B), and the contents of the old zero-cross time data TFN(1) and the positive old peak value AMP(1) are updated to the present zero-cross time t and the present peak value c in step S29 in FIG. 8. More specifically, in FIG. 15B, $TFN(1)=t=t_2$ and $AMP(1)=c=a_0$. After the repetition processing, the register STEP is not updated, and the flow returns to the processing in step M2 in the main routine shown in FIG. 5 to wait for inputting of the next normal peak value. Thereafter, the processing after the minimum peak value $c=b_1$ is input at $t=t_3$ is the same as that in FIG. 15A. However, since the peak (cross-hatched peak $c=a_0$ in FIG. 15B) extracted in STEP 1 is ignored and is updated to the peak $c=a_1$, the start point of the next period data $T_x$ of TP(0) calculated in STEP 3 (to be described later) corresponds to the old zero-cross time $TFN(1)=t_2$ set in the repetition processing in STEP 2, and is different from that in FIG. 15A.

As shown in FIG. 15A or 15B, when waveforms are repetitively input, a peak having a smaller peak value is ignored as an abnormal waveform, and error processing is executed.

A branch at step S22 in FIG. 8 for other cases of the repetition processing will be explained below.

When the processing in STEP 2 in FIG. 8 is executed, since a normal waveform obtained by picking a string is smoothly and naturally attenuated, the present peak value becomes larger than a $\frac{7}{8}$ multiple of the old peak value AMP(b) having the same sign in step S22, and YES is obtained in step S22. Thus, the flow advances to step S23.

In some cases, however, $c>(\frac{7}{8})\times AMP(b)$ cannot be established. In a first case, for example, when a string is plucked near the bridge, adjacent peaks of a waveform occured right after the leading edge of the waveform can be extremly different in level. In this case, although the waveform is normal, it is not smoothly attenuated, and NO may often be obtained in step S22. In this case, the processing in step S24 in FIG. 8 must be normally performed. Since the waveform is normal, the above-mentioned repetition does not occur, and the flow does not branch from step S20 to step S25 in FIG. 8. Therefore, the repetition flag DUB is kept to be "0". If $DUB=1$ is not established in step S27 in FIG. 8, the flow returns to step S24 regardless of the judgement result in step S22, and the processing described in Sub-section "Basic Operation" is executed. Note that the repetition flag DUB is initialized to 0 in the processing of step S04 in STEP 0 in FIG. 6.

In a second case, step S22 in FIG. 8 cannot be established when repetition of waveforms described above occurs. This case will be explained below with reference to FIG. 15C.

Figure 15C:
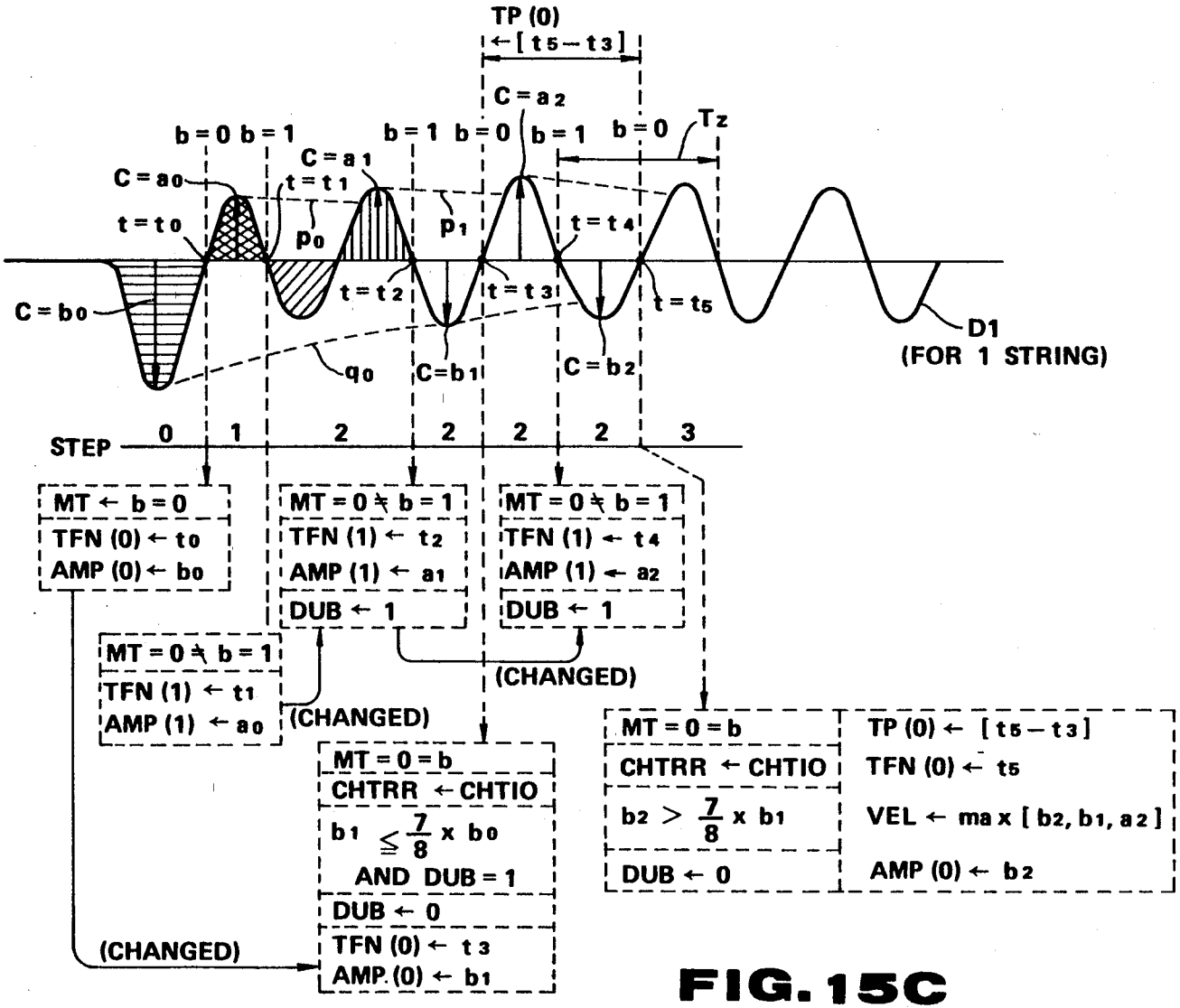

As shown in FIG. 15C, the repetition processing is performed at $t=t_2$ after the processing of STEP 0 ($t=t_0$) and STEP 1 ($t=t_1$), and the peak $c=a_0$ (cross-hatched peak in FIG. 14C) is removed while the peak $c=a_1$ (vertically hatched peak in FIG. 15C) is left, in the same manner as has been described in FIG. 15B. Note that the simple-hatched peak ($c=a_1$) is not originally detected as in FIG. 15A or 15B.

When the repetition occurs as described above, since the positive/negative flag becomes $b=0$ at the next $t=t_3$, as shown in FIG. 15C, it coincides with the flag $MT=0$ set in STEP 0. Therefore, the flow advances from step S20 to the processing in step S22 via step S21 in FIG. 8. However, the present minimum peak value $c=b_1$ detected at $t=t_3$ is much smaller than the old minimum peak value AMP(0) having the same sign due to repetition of the waveforms, and is largely attenuated. Therefore, as shown in FIG. 15C, NO may be obtained in step S22 in FIG. 8.

In this case, since the repetition processing is performed at $t=t_2$, the value of the repetition flag DUB is "1". Therefore, NO is obtained in step S27 in FIG. 8, and the flow advances to step S29 via step S28 (to be described later).

In step S29, in order to restart processing by acquiring a normal waveform after $t=t_3$ in FIG. 15C, the contents of the old zero-cross time data TFN(0) and the negative old peak value AMP(0) set in STEP 0 are updated to the present zero-cross time t and the present peak value c in step S29 in FIG. 8. More specifically, in FIG. 15C, $TFN(0)=t=t_3$ and $AMP(0)=c=b_1$. As a result, the horizontally hatched peak ($c=b_0$) in FIG. 15C is ignored. For the following processing, the repetition flag DUB is reset to "0" in step S28 in FIG. 8. After the above-mentioned operations, the content of the register STEP is not updated, and the flow returns to the processing in step M2 of the main routine in FIG. 5 to wait for the next peak input.

In the above case, as shown in FIG. 15C, STEP 2 in FIG. 8 is repeated at $t=t_4$ and $t=t_5$, and the control then transits to STEP 3. The repetitive operation of STEP 2 described above includes various patterns, and a detailed description thereof will be omitted. A normal waveform can be acquired as the entire control flow, and an operation is performed to effectively determine the data TFN(0), AMP(0), TFN(1), and AMP(1) used for next STEP 3. Thereafter, the control transits to STEP 3. Note that in the case shown in FIG. 15C, $tp(0)=t_5-t_3$, and the start point of the next period data $T_2$ calculated in STEP 3 (to be described later) corresponds to $TFN(1)=t_4$.

(Processing Operation in STEP 3)

Figure 9:
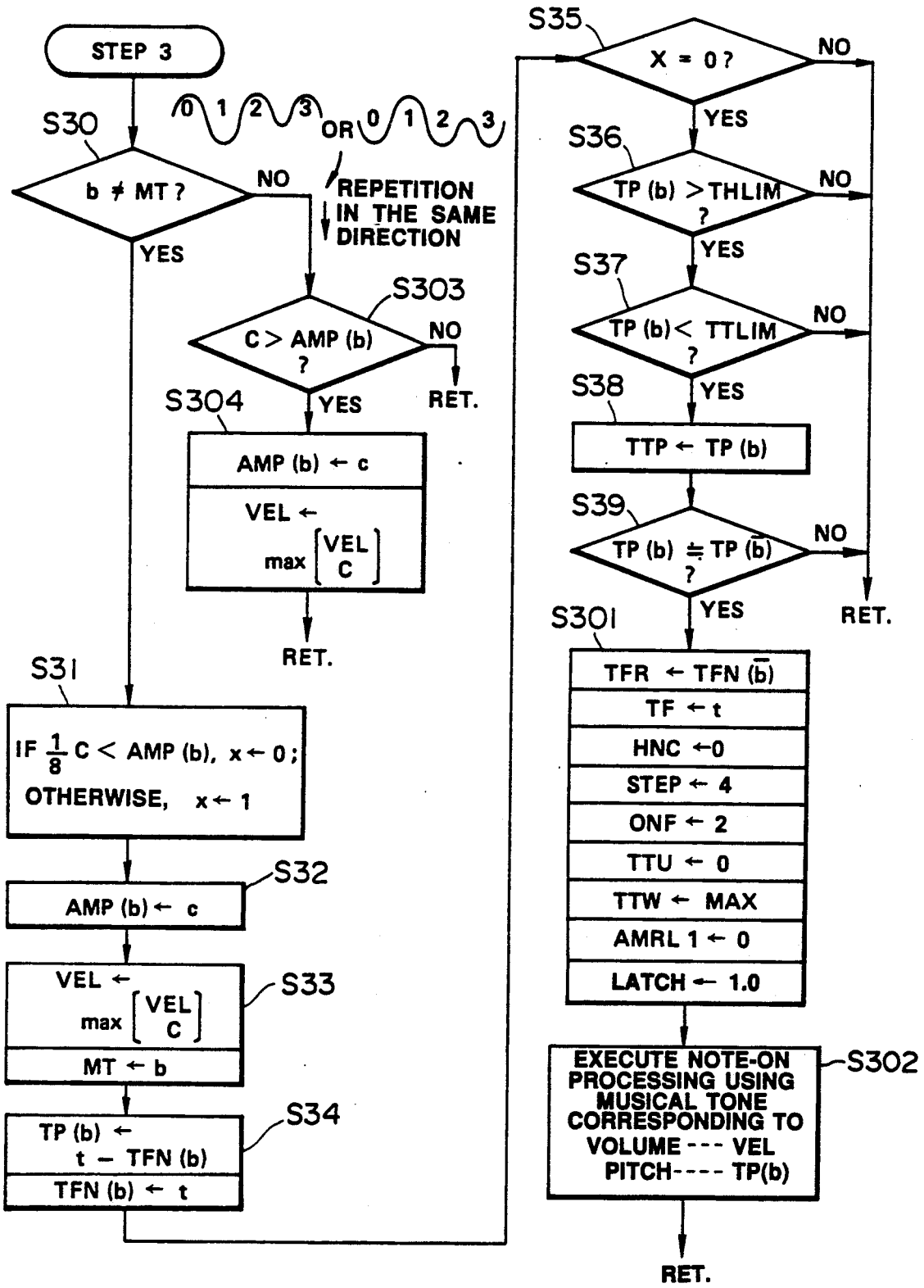
FIG. 9 is an operation flow chart of processing STEP 3 shown in FIG. 5.

FIG. 9 is an operation flow chart of processing in STEP 3 as step M8 in the main routine of FIG. 5. In this processing, note-on (tone generation start) processing, extraction of a pitch period for setting a pitch for note-on operation calculations of velocity, transition processing to STEP 4, error processing when an abnormal waveform is input, and the like are executed. Note that, as a process especially relating to the present invention, a data 1.0 is set in the latch 11 in FIG. 2 in Step S01.

<Basic Operation>

After the processing in STEP 3 is executed, the main routine shown in FIG. 5 waits for next data input to the registers TO, C, and B upon interruption again from the pitch extraction digital circuit 2 (FIG. 2) by repeating the loop of step M2→M10→M11→M2.

When data are input and the contents of the registers are read in steps M2 to M3 in FIG. 5, the flow advances to step M8, i.e., STEP 3 in FIG. 9 via step M4. In this state, as shown in FIG. 13, the present zero-cross time $t=t_3$, the present positive/negative flag $b=1$, and the present peak value is the maximum peak value, $c=a_1$ since $b=1$.

Note that after steps S30, S31 and S32 in FIG. 9 (to be described later), a tone volume parameter VEL is calculated in step S33. A largest one of the three previous peak values ($b_0$, $a_0$, and $b_1$ (absolute values) in FIG. 13) is stored in the velocity VEL in step S24 in FIG. 8, as has been described in Sub-section "Basic Operation" in Section "Processing Operation in STEP 2". In step S33 in FIG. 9, a larger value out of the velocity VEL and the present peak value c is selected, and is determined as the tone volume parameter VLM used when the musical tone generator 5 (predetermined one of #1 to #n) (FIG. 2) generates a musical tone. In FIG. 13, since $VEL=a_0$ and $c=a_1$, $VEL=\max[a_0, a_1]=a_0$.

After the above operation, the processing, MT←b, is executed in step S33 and the flow advances to step S34 in FIG. 9 (to be described later). In step S34, {(present zero-cross time t)−(old zero-cross time data TFN(b) having the same sing)} is calculated to detect a pitch period, and the detected period is set as old period data TP(b). In FIG. 13, $TP(1)=t_3-t_1$.

After steps S35 to S38 in FIG. 9 (to be described later), it is checked in step S39 if the old period data TP(b) calculated in step S34 is substantially equal to the old period data $TP(\bar{b})$ set in step S24 in FIG. 8 and having the different polarity from that of the above TP (b). If YES in step S39, since it can be determined that the pitch period can be started to be stably extracted, note-on processing is executed in step S302 via step S301 (to be described later). In FIG. 13, it is determined that the negative old period data $TP(1)=t_3-t_1$ is substantially equal to the positive old period data $TP(0)=t_2-t_0$. and the control transits to the note-on processing. Note that a case wherein NO is obtained in step S39 will be described later.

In step S302, corresponding tone volume data, and tone pitch data are generated on the basis of the tone volume parameter VEL calculated in step S33 in FIG. 9 and the old pitch period TP(b) extracted in step S34, and are output to the musical tone generator 5 (to the corresponding one out of #1 to #n) through the MIDI-BUS and the interface MIDI shown in FIG. 2. The generator 5 generates a musical tone having a tone volume, and tone pitch corresponding to the input data in real time. In this manner, in this embodiment, since note-on operation is performed in about 1.5 periods after the waveform rises, as indicated at $t=t_3$ in FIG. 13, a musical tone can be generated to satisfactorily follow the vibration waveform of a string.

In step 301, an operation especially relating to the present invention for setting a value 1.0 to the latch 11 in FIG. 2 is also executed. According to this operation, as has been described in Section "General Operation of this Embodiment", the musical tone signal output from the multiplier 6 shown in FIG. 2 maintains an envelope characteristic of the synthe-envelope imparted by the envelope generator ENV arranged in the musical tone generator 5 in an attack portion immediately after the note-on operation, thereby generating a sound having characteristics of the synthesizer sound from the tone generation.

Furthermore, parameters used in STEP 4 next are set in steps S38 and S301 in FIG. 9, and the flow returns via step S302 to the processing in step M2 of the main routine shown in FIG. 5. Thus, the control transits to the next STEP 4. More specifically, in step S38, the old period data TP(b) extracted in step S34 is set as the previously extracted period data TTP. In step S301, the old zero-cross time data $TFN(\bar{b})$ set in step S24 in STEP 2 of FIG. 8 is set in the time storing register TFR, the present zero-cross time data t is set as valid old zero-cross time data TF, a waveform number counter HNC is cleared to "0", the value of the register STEP is updated to "4", the note-on flag ONF is set to be "2" (sound generation state), the constant TTU is set to be "0" (minimum MIN), the constant TTW is set to be maximum MAX, and the old amplitude value AMRL1 for relative-off check is cleared to "0". These parameters will be described later in STEP 4.

<Operation When Period is Inappropriate>

When the old period data TP(b) is detected in step S34 in FIG. 9, the pitch period must be longer than a period generated when the corresponding string is plucked at its highest fret, and shorter than the open string period of the string.

As the constant, i.e., the upper limit frequency THLIM, a period of a pitch higher by 2 to 3 halftones than a pitch determined by the highest tone fret of a string which is presently subjected to processing, and as the constant, i.e., the lower limit frequency TTLIM, a period of a pitch lower by 5 halftones or less than a pitch determined by the open string state of the identical string is set. In steps S36 and S37 in FIG. 9, it is checked if the old period data TP(b) calculated in step S34 is larger than THLIM and is smaller than TTLIM.

If YES is obtained in both steps S36 and S37, the flow advances to step S39, and the period judgement processing described above is performed.

If NO in step S36 or S37, it is determined that the old period data TP(b) extracted in step S34 is inappropriate. Therefore, in this case, the flow returns from step S36 and S37 to the processing in step M2 in the main routine of FIG. 5, and STEP 3 is repeated.

If it is determined in step S39 in FIG. 9 that the old period data TP(b) calculated in step S34 is different from the old period data TP($\bar{b}$) having the different polarity, an overtone or the like may be accidentally extracted and an occurate pitch period fails to obtain. In this case, the pitch period cannot be stably extracted. Therefore, NO is obtained in step S39, and the flow returns to the processing in step M2 in the main routine of FIG. 5 to repeat STEP 3.

When STEP 3 is repeated with the above operations, in a normal waveform, the polarities of a newly detected peak via step M2 and M3 in FIG. 5 are alternately switched, and the value b is alternately inverted to be 0 and 1. In addition, in step S33 in FIG. 9, the value of the flag MT is alternately updated, and in step S34, new TP(b) is calculated and the content of TFN(b) is updated. Therefore, judgement in steps S36 and S37 is performed for the latest pitch period, and judgement in step S39 is performed for the latest pitch period and second latest pitch period (before about half a period) having the opposite polarity. When the pitch periods can be stably extracted, the control transits to the note-on processing.

In step S33 in FIG. 9, the velocity VEL is updated accordingly in correspondence with the newly detected peak.

<Operation of Noise Removal Processing>

Figure 16:
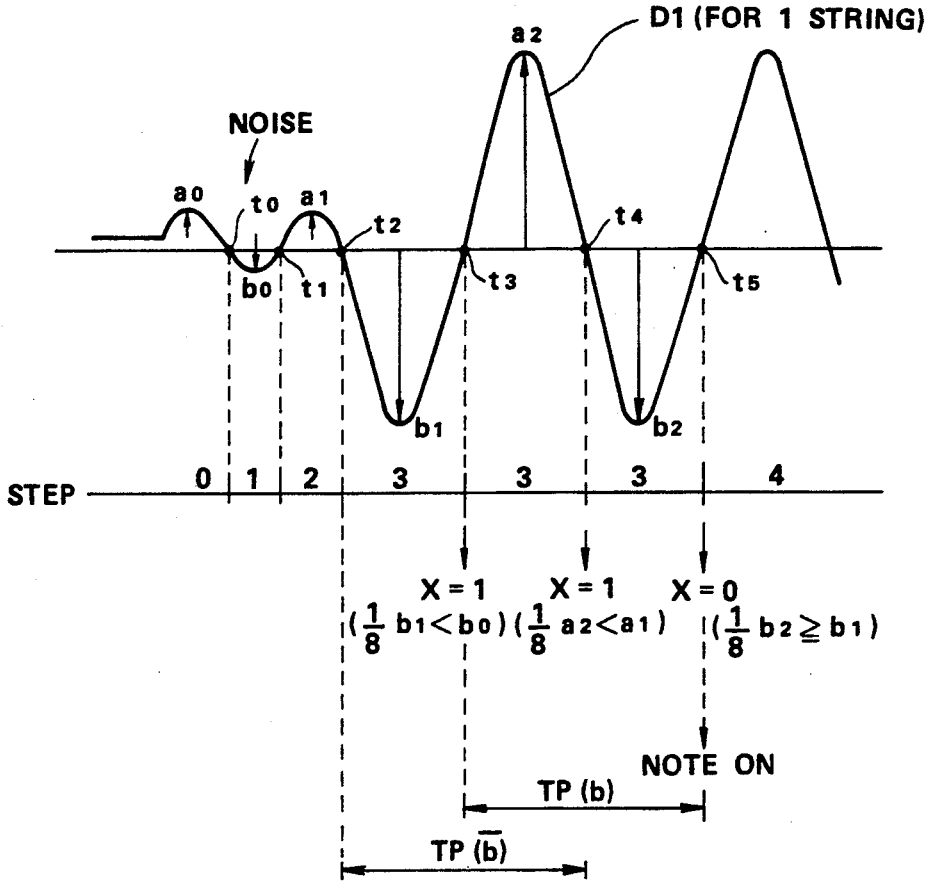
FIG. 16 is a chart for explaining noise removal processing operation in STEP 3.

The processing in step S31 in FIG. 9 is performed to cope with a case wherein a noise component appears in the leading edge portion waveform. Assume that peaks $a_0$, $b_1$, $a_1$, and the like caused by noise are accidentally detected in STEPs 0, 1 and 2, as shown in FIG. 16. If the periods of these noise components are detected and tone generation start is instructed, a quite unnatural musical tone is generated.

In step S31 in FIG. 9, when successive peak values are largely changed, it is determined that a noise component is generated, and the abnormal detection flag X is set to be "1". Thus, NO is obtained in step S35 so as to prevent note-on processing on the basis of the noise portion.

More specifically, normality is determined if a $\frac{1}{8}$ value of the present peak value c is smaller than the old peak value AMP(b) having the same sign, and the flag X is set to be "0"; otherwise, X=1 is set. If it is determined in step S35 that X is not set to be "0", the flow returns to the processing in step M2 in the main routine of FIG. 5 to repeat STEP 3. In this case, since the old peak value AMP(b) is sequentially updated in step S32 in FIG. 9, the processing in step S31 is performed for the latest peak value and the immediately preceding peak value having the same sign. When the successive peak values are free from a large change, the control transits to the note-on processing. In FIG. 16, both at $t=t_3$ and $t=t_4$, X=1 is determined in step S31. Therefore, the note-on processing is not performed. At $t=t_5$, since it is determined that at a normal peak is input for the first time, X=0 is determined in step S31, and the note-on processing is performed at t=t5. In this case, the successive pitch periods TP(b) and TP($\bar{b}$) have normal values.

<Operation of Repetition Processing>

The judgement processing in step S30 in FIG. 9 is performed for repetition processing. If the normal waveform D1 as shown in FIG. 13 is input, the present positive/negative flag b=1 at $t=t_3$ does not coincide with the flag MT=0, and the flow advances to step S31, as described above.

However, as has been described in Sub-section "Operation of Repetition Processing" in Section "Processing Operation in STEP 1" or "Processing Operation in STEP 2", when the waveforms are repetitively input, NO is obtained in step S30 in FIG. 9.

When the repeating peak value c is smaller than the old peak value AMP(b) having the same sign, NO is obtained in step S303 in FIG. 9, an the repeating peak is ignored. Thereafter, the flow returns to the processing in step M2 in FIG. 5 to repeat STEP 3, based on the same consideration as in FIG. 15A and the like.

In contrast to this, if the repeating peak value c is larger, YES is obtained in step S303, and the flow advances to the processing in step S304. In step S304, the old peak value is ignored. The content of the AMP(b) is updated to the present peak value c, and the velocity VEL is calculated again using the updated value. Thereafter, the flow returns to step M2 in FIG. 5 to repeat STEP 3, based on the same consideration as in FIG. 15B and the like.

When the normal peak is input after the above-mentioned processing, YES is obtained in step S30, and YES is obtained in steps S35, S36, S37 and S39. Thus, the note-on processing is performed, and generation of a musical tone is started.

(Processing Operation in STEP 4)

Figure 10A:
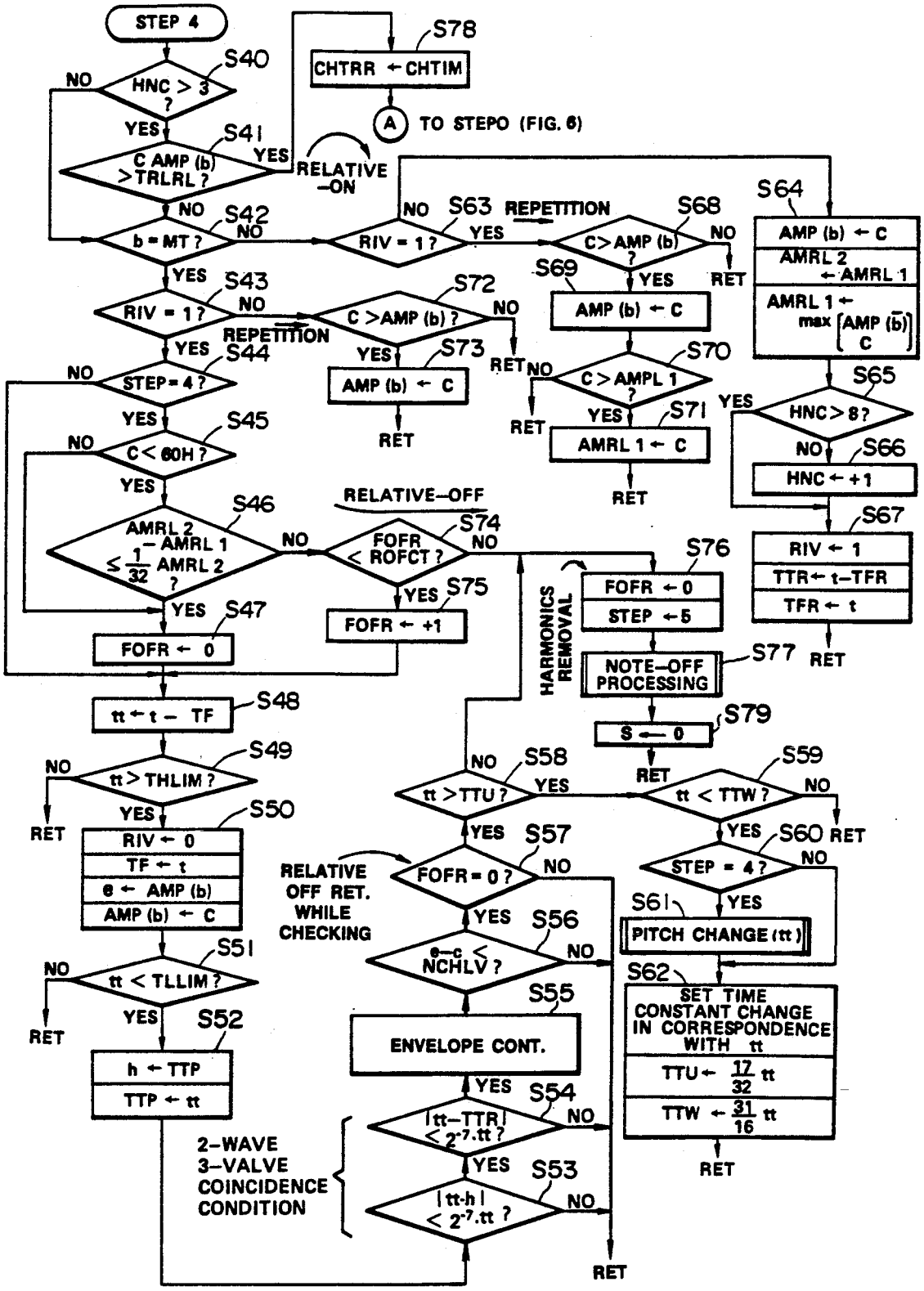
FIGS. 10A to 10C are operation flow charts of processing STEP 4 shown in FIG. 5.

FIG. 10A is an operation flow chart of processing in STEP 4 as step M9 in FIG. 5. In this processing, pitch extraction/change processing, envelope control processing directly relating to the present invention, relative-on/relative-off processing, processing when a pitch period is inappropriate, repetition processing, and the like are performed. The pitch extraction/change processing and the extraction processing of envelope data include a route ① for performing only pitch extraction and a route ② for actually changing a pitch and for extracting envelope data, and generally these routes are alternately repeated every time a new peak is input.

<Operation of Pitch Extraction Processing (Route ①)>

The route ① shown in steps S40, S41, S42, and S63 to S67 will be described first. In step S40, whether or not the waveform number counter HNC>3 is checked. If YES in step S40, the flow advances to step S41. It is checked in step S41 if the relative-on threshold value TRLRL<(present peak value c−old peak value AMP(b) having the same sign.). If NO in step S41, the flow advances to step S42 (a case of YES will be described later). It is then checked in step S42 if the present positive/negative flag b=flag MT, i.e., a pitch is to be changed. If YES in step S42, the flow advances to step S43.

However, in an initial state, the content of the waveform number counter NHC is 0 (see step S301 in FIG. 9). Thus, NO is obtained in step S40, and the flow advances to step S42. For example, when the waveform as shown in FIG. 13 is input, since b=0 and MT=1 (which latter is re-written in step S33 in STEP 3 in FIG. 9) at $t=t_4$, the flow advances from step S42 to step S63.

It is checked in step S63 if the register RIV=1 in order to check whether or not the peaks having the same polarity are repetitively input (repetition is detected). If YES in step S63 (peaks having the same polarity are repetitively input), the flow advances to step S68 to perform repetition processing (to be described later). If NO in step S63 (repetition is not detected), the flow advances to step S64, and the following processing is executed.

In step S64, the present peak value c is input as the old peak value AMP(b), and the old amplitude value AMRL1 is input as the amplitude value AMRL2 immediately preceding the old amplitude value AMRL1 for relative-off processing (to be described later). Note that the content of AMRL1 is initially set to be "0" (step S301 in STEP 3 in FIG. 9).

Furthermore, in step S64 a larger one of the old and present peak values AMP(b) and c having opposite signs is input as the old amplitude value AMRL1. More specifically, a larger one of the two, i.e., positive and negative peak values in a period is set in the amplitude value AMRL1.

It is checked in step S65 if the waveform number counter HNC>8. The waveform number counter (zero-cross counter not at a pitch change side) HNC is incremented by 1. Therefore, the upper limit of the waveform number counter NHC is 9. After the processing in step S65 or S66, the flow advances to step S67. In step S67, the register RIV is set to be "1", the content of the time storing register TFR is substracted from the present zero-cross time t, and the difference is input to the period register TTR. The period register TTR indicates the period data $TTR=t-TFR=t_4-t_2$ in FIG. 13. The present zero-cross time t is saved in the time storing register TFR, and thereafter, the flow returns to the processing in step M2 in the main routine of FIG. 5.

As described above, in the route ①, the following processing is executed according to FIG. 13. More specifically, $MT=1\neq b$, RIV=0, $AMP(0)\leftarrow c=b_2$, $AMRL2\leftarrow AMRL1=0$, $AMRL1\leftarrow \max\{AMP(1)=a_1, c=b_2$ (a larger one of them)}, $HNC\leftarrow(HNC+1)=1$, $RIV\leftarrow 1$, $TTR\leftarrow(t-TFR)=(t_4-t_2)$, and $TFR\leftarrow t=t_4$. Therefore, a time data difference of time data from the old zero-cross time $t=t_2$ (change point from STEP 2→STEP 3) to the present zero-cross time $t=t_4$, i.e., period data is set in the period register TTR. The flow then returns to the processing in step M2 in the main routine of FIG. 5 to wait for the next peak input.

<Operation of Pitch Change Processing (route ②)>

A case will be described below wherein the control advances to the route ② shown in steps S40 to S62. Since the waveform number counter HNC=1 (step S66), the flow advances from step S40 to step S42 (step S40 will be described later).

YES is obtained in step S42 since MT=1 and b=1 in FIG. 13, and the flow advances to step S43.

It is checked in step S43 if the register RIV=1. Since the register RIV has already been set to be "1" in the route ① (step S67), YES is obtained in step S43, and the flow advances to step S44. Repetition processing performed when NO is obtained in step S43 will be described later.

It is checked in step S44 if the register STEP=4. If YES in step S44, the flow advances to step S45 (a case of NO will be described later). It is checked in step S45 if the present peak value c<60H (H indicates the hexadecimal notation). If a large peak value is input, NO is obtained in step S45, and the flow advances to step S47. Contrary to this, when the input value is smaller than 60H, YES is obtained in step S45, and the flow advances to step S46.

In step S46, it is checked if {the amplitude value (peak value) AMRL2 before AMRL1}−{the old amplitude value (peak value) AMRL1}<(1/32)×{the amplitude value (peak value) AMRL2 before AMRL1}. If YES in step S46, the flow advances to step S47, and the relative-off counter FOFR is set to be "0". If NO in step S46, the flow advances to step S74, and relative-off processing is executed. The relative-off processing will be described later.

In step S48, a period calculation is made. More specifically, (present zero-cross time t−old zero-cross time data TF) is set in the register TOTO as present period value tt. The flow then advances to step 49.

In step S49, it is checked if the present period data tt>upper limit frequency THLIM (upper limit after tone generation shart). If YES in step S49, the flow advances to step S50 (a case of NO will be described later). The upper limit frequency THLIM in step S49 is the same as the upper limit of the allowable range of the frequency (i.e., corresponding to a minimum period of a tone, pitch of which is higher by 2 to 3 halftones than that of a highest tone fret) upon triggering (starting of tone generation) used in step S36 in STEP 3 in FIG. 9.

In step S50, the following processing is executed. More specifically, the register RIV is set to be "0", the present zero-cross time t is input as the old zero-cross time data TF, the old peak value AMP(b) is input as the peak value e before the old peak value AMP(b), and the present peak value c is input as the old peak value AMP(b).

After the processing in step S50, the flow advances to step S51 to check if the lower limit frequency TLLIM>the present period data tt is established. If YES in step S51, i.e., if the value of the present period becomes smaller than the value of the lower limit pitch extraction tone range during note-on (sound generation), the flow advances to step S52. In this case, the lower limit frequency TLLIM is set to be a value lower by one octave than that of an open string note. More specifically, the allowable range is widened as compared to the lower limit frequency TTLIM (step S37) in STEP 3 shown in FIG. 9. Thus, a change in frequency upon operation of a tremolo arm can be coped with.

With the above operation, when the present period falls within the range defined by the upper and lower limit frequencies, the flow advances to step S52; otherwise, the flow returns from step S49 or S51 to the processing in step M2 in the main routine shown in FIG. 5 to wait for the next peak input.

In step S52, the period data TTP is input as period data h extracted before the old period, and the present period data tt is input as the previously extracted period data TTP.

In steps S53 and S54, a "2-wave 3-value coincidence condition" is checked. In step S53, whether or not the present period data $tt\times 2^{-7}>|$the present period data tt−period data h before the old period data | is checked. If YES in step S53, the flow advances to step S54. In step S54, whether or not the present period data $tt\times 2^{-7}>|$ the present period data tt−the content of the period register TTR | is checked. If YES in step S54, the flow advances to step S55. More specifically, for the case shown in FIG. 13, it is checked in step S53 if the present period data $tt=t_5-t_3$ (step S48) is almost equal to the old period data $h=TTP=t_3-t_1$ (step S52), and it is checked in step S54 if the present period data $tt=t_5-t_3$ is almost equal to the period $TTR=t_4-t_2$ (step S67) partially overlapping it. Note that its limit range is determined as $2^{-7}\cdot tt$, and its value is changed depending on period data. Of course, although the limit range may be fixed, a better result can be obtained when this embodiment is employed.

In step S55, an envelope control is executed. This is a most characterized process of this embodiment. This process will be described hereinafter with reference to FIGS. 10B and 10C.

Figure 10C:
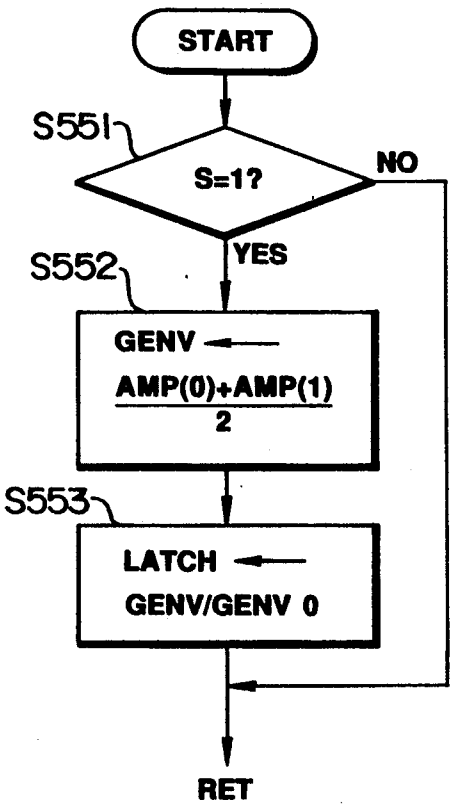

FIG. 10C shows an operation flow chart of step S55 shown in FIG. 10A representing an envelope control process. It is checked in step S551 if the flag S is 1. As the flag S has been reset in step S04 in STEP 0 shown in FIG. 6, NO is obtained and therefore nothing is executed in S55 in FIG. 10A. the above-mentioned state is continued as far as the flag S is 0 when the process of step S55 is repeatedly executed in the route ② i.e., S40 to S62. This meaning will be described later.

MCP 3 in FIG. 1 checks whether an interrupt signal INT' comes into from anyone of the musical tone generators 5 (#1 to #n) independently from the route ① and ② (including S55) shown in FIG. 10A. When an envelope of the musical tone signal generated from anyone of the musical tone generators 5 reaches the sustain point SP as has been described and shown in FIG. 12(*a*), the corresponding envelope generator ENV outputs an interrupt signal INT' to MCP 3.

Figure 10B:
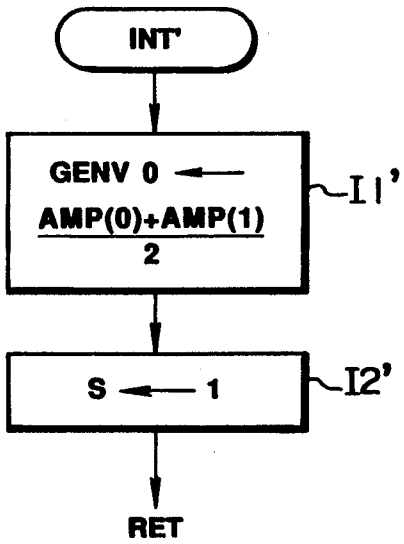

When MCP 3 detects the supplied interrupt signal INT', MCP 3 stops the process of the route ① or ② shown in FIG. 9A now executing, and executes an envelope interrupt process routine shown in FIG. 10B. At first, a mean value of the current peak value and the preceding peak value is calculated in step I1' in FIG. 10B, and then the mean value is output as an envelope data initial value GENVO. More specifically, GENVO={(AMP(0)+AMP(1)}/2 is calculated. The value GENVO will be described later. In step I2' shown in FIG. 10B, the flag S is set as "1".

Upon completion of the envelope interrupt processing, MCP 3 restarts the process of route ① or ② shown in FIG. 10A which has been stopped executing.

As a result of the processing, when the process of step S55 in FIG. 10A is executed again, the judgement of step S551 in FIG. 10C becomes YES as the flag S has been set as "1".

Therefore, the mean value of a present peak value and a preceding peak value, thereby obtaining an envelope data GENV. Namely, GENV={AMP(0)+AMP(1)}/2 is calculated.

Furthermore, in step S553, a ratio of the envelope data GENV to the envelope data initial value GENVO obtained in the interrupt process routine shown in FIG. 10B, i.e., GENV/GENVO is calculated. MCP 3 in FIG. 2 sets the value thus obtained to a latch 11 corresponding to the musical tone generator 5 which has supplied the above-mentioned interrupt signal INT'.

The routine shown in FIG. 10C is repeatedly executed when the route ② as shown steps S40 to S62 including S55 in FIG. 10A is repeatedly executed. As the result, a ratio of newly obtained envelope data GENV to the value GENVO is calculated to be set in the latch 11.

As described above, a musical tone generation processing is progressed in response to a repeatedly execution of routine of the route ① and ② shown in FIG. 10A. Until the envelope data generated from the envelope generator ENV arranged in the musical tone generator 5 shown in FIG. 2 reaches the sustain point SP shown in FIG. 12(*a*), i.e., in an attack portion of the musical tone, nothing is done in step S55 in FIG. 10A. In this operation, the corresponding latch 11 shown in FIG. 2 holds the value 1.0 which has been set in step S301 in STEP shown in FIG. 9. Therefore, in an attack portion of the musical tone, the synthesizer envelope shown in FIG. 12(*a*) is appeared as the envelope characteristic of an individual musical tone signal output from the corresponding multiplier 6 shown in FIG. 2. Therefore, the musical tone of the attack portion immediately after the start of the tone generation has characteristics of a synthesizer sound generated from the musical tone generator 5.

Continuously, in repeated processings of route ① and ② shown in FIG. 10A for musical tone generation operations, an envelope data generated from the envelope data generator ENV arranged in the musical tone generator 5 shown in FIG. 2 reaches the sustain point SP shown in FIG. 12(*a*). Consequently, at each time of the processings of step S55 shown in FIG. 10A, a ratio GENV/GENVO is calculated and stored in the latch 11, while an envelope value at the sustain point SP is served as the value GENVO. Accordingly, the input of the corresponding multiplier 6 shown in FIG. 2 varies as shown in FIG. 12(*c*) after reaching the sustain point SP so that the output sound has an envelope characteristic of the string envelope as shown a latter half portion in FIG. 12(*b*), that is a data GENV/GENVO.

Accordingly, when the player performs the muting operation to compulsorily cease the string vibration after plucking a string, as an attack portion immediately after stating of a tone generation, the sound characteristics of a synthesizer sound generated from the musical tone generator 2 are kept well. Thereafter, the envelope characteristic of string vibration after the sustain point SP is reflected well in the musical tone signal generated from the multiplier 6, in accordance with an abruptly decreasing of an envelope of the digital output D1 (string vibration) based on the muting operation, thereby a musical performance effect for the muting operation can be easily obtained.

Then, in step S56 in FIG. 10, it is checked if the no-change level NCHLV>(the peak value e before the old peak value−the present peak value c) is established. If YES in step S56, the flow advances to step S57. More specifically, if the old peak value (e=AMP(b) having the same polarity and the present peak value c are largely changed, the difference therebetween exceeds NCHLV. In this case, if a pitch is changed on the basis of the extracted period data, an unnatural change in tone pitch may occur. Therefore, if NO is obtained in step S56, the flow returns to the processing in step M2 in the main routine in FIG. 5 without executing the processing in step S57 and the subsequent steps, and the following peak input is waited for.

If YES in step S56, it is checked if the relative-off counter FOFR is "0" or not. If relative-off processing (to be described later) is performed, the relative-off counter FOFR is not "0". In this case, pitch change processing (see step S61) is not executed and NO is determined in step S55. Then, the flow returns to the processing in step M2 in the main routine of FIG. 5. If YES in step S57, the flow advances to step S58.

It is checked in step S58 if the present period data tt>the constant TTU. If YES in step S58, the flow advances to step S59 to check if the present period data tt>the constant TTW. If YES in step S59, the flow advances to step S60. A case wherein NO is obtained in step S58 or S59 will be described later.

It is checked in step S60 if the register STEP=4. If YES in step S60, the flow advances to step S61.

In step S61, the MCP 3 shown in FIG. 2 instructs the musical tone generator 5 (predetermined one of generators #1 to #n) to change a pitch (based on the present period data tt), and the flow advances to step S62.

In step S62, the time constant is changed in accordance with the present period data tt, the constant TTU is rewritten to (17/32)×the present period data tt, and the constant TTW is rewritten to (31/16)×the present period data tt.

As will be described later, only when the relative-off processing is performed, STEP=5 is established. In this case, the flow directly advances from step S60 to step S62. Thus, the time constant is changed in step S62 without a pitch change in step S61.

The time constant change processing means that the MCP 3 shown in FIG. 2 sets period data based on the value of the present period data tt in the time constant conversion register CHTRR in the time constant conversion controller 202 shown in FIG. 3. This processing is performed as has been described in Sub-section "Detailed Operation" in Section "Operation of Pitch Extraction Digital Circuit".

Upon completion of the processing in step S62, the flow returns to the processing in step M2 of the main routine shown in FIG. 5.

In the above-mentioned route ②, the following processing is executed in the case of FIG. 13. More specifically, it is determined that HNC=1, MT=1=b, and RIV=1. Operation FOFR←0, tt←t−TP=$t_5-t_3$, RIV→0, TF←t=$t_5$, e←AMP(1)=$a_1$, AMP(1)←c=$a_2$, h←TTP=tp(1)=$t_3-t_1$, TTP←tt=$t_5-t_3$, and a pitch is changed in accordance with tt when the following three conditions are satisfied:

$$TTP \approx TTR \approx tt \quad (1)$$

$$TTU < tt < TTW \quad (2)$$

$$AMP(0) - c < NCHLV \quad (3)$$

Thereafter, TTU←(17/32)×tt and TTN←(31/16)×tt are set.

With the above-mentioned operations, in the route ②, actual pitch change processing for the musical tone generator 5 (predetermined one of generators #1 to #5) is executed and also the envelope control of the output musical tone data is executed in the multiplier 6 (predetermined one of multipliers #1 to #n). Thereafter, the processing of the route ① is executed upon the next zero-cross interruption (detection of the next peak), and similarly, the processing in the route ② is executed upon the next zero-cross interruption. In this manner, in the route ①, only a period is extracted (step S67), and in the route ②, actual pitch change processing (step S61), envelope control processing (step S55) and time constant change processing (step S62) are executed.

<Relative-On Processing Operation>

After the waveform number counter HNC is counted up to exceed 3 in step S66 in the route ① in STEP 4 in FIG. 10A, YES is determined in step S40, and the flow advances to step S41 to detect a "relative-on condition".

This case occurs when c−AMP(b)>TRLRL, i.e., the present peak value c is increased to exceed the threshold value TRLRL as compared to the old peak value AMP(b). That is, this case occurs when a given string is plucked immediately after it was plucked (by, e.g., tremolo operation). In this case, YES is obtained in step S41, and the flow advances from step S41 to step S78 to execute the relative-on processing.

In step S78, the period CHTIM of the highest note fret (e.g., 22nd fret) is set in the time constant conversion register of the time constant conversion controller 202 (FIG. 3).

After the above processing, the flow advances to step S06 in STEP 0 in FIG. 6, a musical tone which is being produced is rendered note-off, and its tone generation is restarted. Accordingly to a normal performance operation, NO is determined in step S41 in STEP 4 in FIG. 10, and the flow advances to step S42. Thereafter, the control advances to the route ① or ②.

<Relative-Off Processing Operation>

Figure 17:
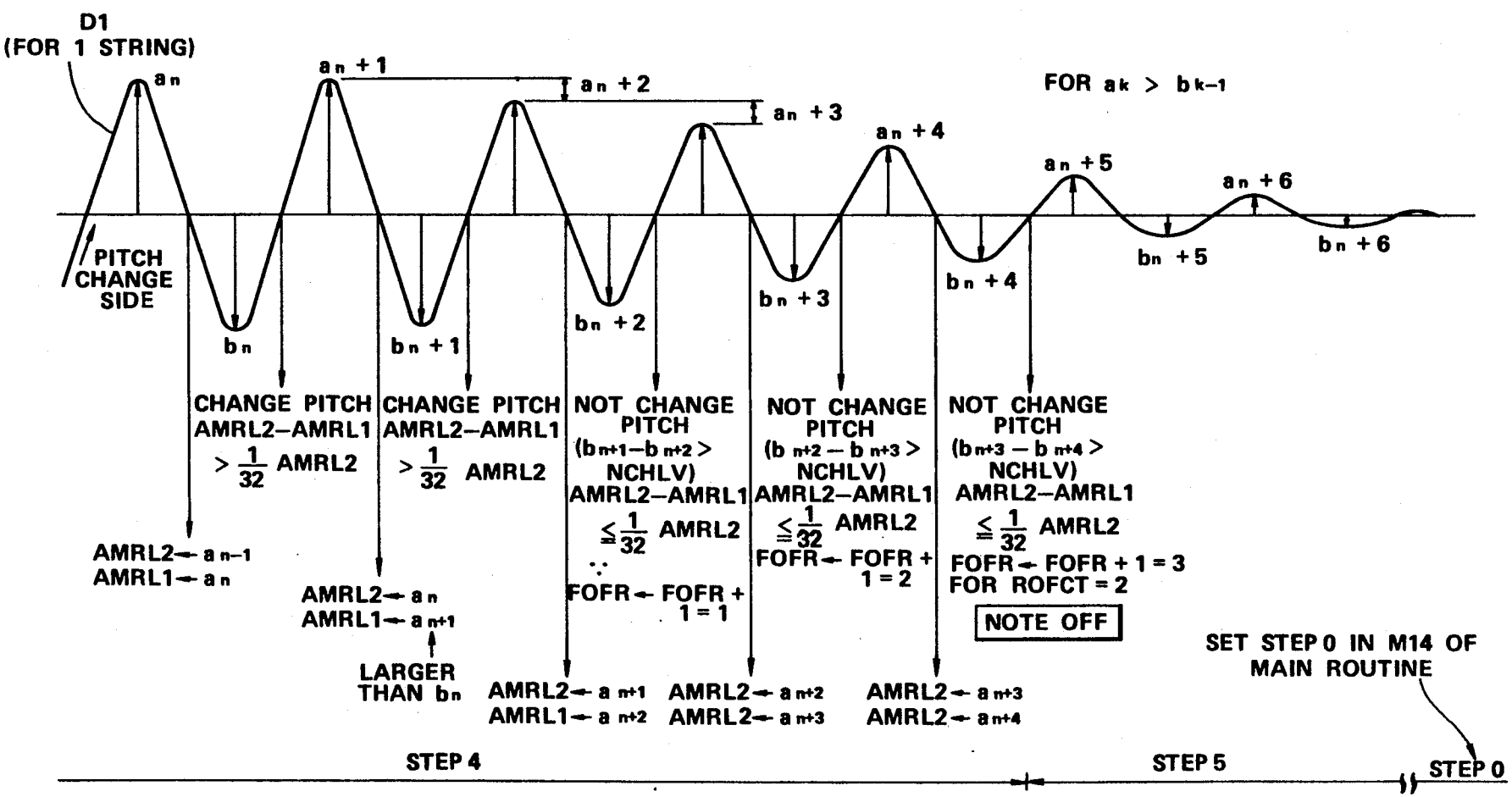
FIG. 17 is a chart for explaining relative-off processing in STEP 4.

Relative-off processing will be described below with reference to FIG. 17. In "relative-off" processing, a note-off operation is performed when a state wherein the fret operation is performed transits to an open string state without plucking the corresponding string.

In this case, the amplitude level of the waveform immediately falls, and a difference between the peak value AMRL2 before the old peak value and the old peak value AMRL1 exceeds (1/32) AMRL2. Thus, the flow advances from step S46 in STEP 4 to step S74 in FIG. 10A.

The flow then advances from step S74 to step S75 to count up until the relative-off counter FOFR exceed the constant ROFCT.

Subsequently, the flow advances from step S75 to step S48 and processing in steps S49 to S55 is executed. However, since FOFR=0 is not established, NO is obtained in step S57, and the flow returns to the processing in step M2 in the main routine of FIG. 5 without performing pitch change processing immediate before the relative-off processing.

In the route mentioned above, the envelope control is executed in step S55. Therefore, even in case that the envelope of the digital output D1 abruptly decreases in the course of the relative-off, the ratio GENV/GENVO based on the envelope is set in the corresponding latch 11 shown in FIG. 2 after the sustain point SP has been passed (refer to FIG. 12(*a*)), and therefore the envelope control of the musical tone is executed by the multiplier 6 in FIG. 2 in accordance with that operation, so that the envelope feature relating to a relative-off state can be imparted to the musical tone.

Peaks in a relative-off state are sequentially input, and NO is obtained in step S74. That is, if the value of the counter FOFR becomes 3 in FIG. 17 (ROFCT=2). the flow advances from step S74 to step S76.

Once YES is obtained in step S46, the flow advances from step S46 to step S47, and counter FOFR is rest. Therefore, unless the condition in step S46 is kept satisfied the number of times designated by the constant ROFCT, the relative-off processing is not executed. Note that as the value ROFCT, a larger value is assigned to a string having a higher pitch, so that relative-off processing can be performed for any string after the lapse of an almost predetermined period of time.

The flow then advances from step S74 to step S76. In step S76, the relative-off counter FOFR is reset, and the register STEP is set to be 5. The flow advances to step S77, and the musical tone generator 5 (predetermined of generators #1 to #n) is instructed to perform note-off. Furthermore, the flag S is reset in step S78.

When the register STEP=5, the pitch extraction processing is executed in the same manner as in STEP 4. However, since the flow advances from step S60 to step S62 without going through step S61, the musical tone generator 5 is not instructed to change a pitch. However, the MCP 3 performs the time constant change processing in accordance with the period extracted in step S62. Furthermore, as the flag S has been set to be 0, in the envelope control processing in step S55 shown in FIG. 10A, the judgement of step S551 in FIG. 10C becomes NO. Therefore, the latch 11 holds the value which has been set prior to note-off operation. Accordingly, the envelope characteristic of the musical tone signal generated from the corresponding multiplier 6 becomes a reduced one of the envelope signal which is taken by the musical tone signal generated from the corresponding musical tone generator 5.

When the register STEP=5, the relative-on processing is accepted (S41 and S78). In other cases, since a decrease in vibration level is detected in the main routine shown in FIG. 5, the register STEP is set to be "0" in step M14, and an initial state is set.

Note that AMRL1 and AMRL2 used in step S46 are formed in step S64, and a peak (one of maximum and minimum peaks) having a higher level in a period is determined as this value. A maximum peak ak in FIG. 17 is always higher than a minimum peak bk−1, and all differences between an+1 and an+2 and an+3, and an+3 and an+4 exceed a predetermined value.

In the processing of the route (2), since the minimum peaks bn+1, bn+2, and bn+3 are extremely decreased, NO is achieved in step S54. The flow then returns to the processing in step M2 of the main routine shown in FIG. 5, and the pitch change processing is not executed.

<Processing Operation When Pitch Period is Inappropriate>

Processing when a pitch period is inappropriate, that is, when overtones in an octave relationship, i.e., periods having tone pitches higher or lower by an octave are successively detected in steps S58 and S59 during pitch extraction will be described below.

The constant TTU used in step S58 in STEP 4 of FIG. 10A is set to be a minimum value "0" in step S301 in STEP 3 of FIG. 9, and the constant TTW used in step S59 is similarly set to be a maximum value MAX. When this flow is executed for the first time, YES is always determined in both steps S58 and S59. Thereafter, in step S62, (17/32)·tt (period data having a tone pitch higher by almost one octave) is set as the constant TTU, and similarly, (31/16)·tt (period data having a tone pitch lower by almost one octave) is set as the constant TTW.

Therefore, when the tone pitch is immediately increased by an octave (this is caused when a mute operation is performed to stop a vibration of a string with a finger) or when the tone pitch is immediately decreased by an octave (this is caused when the peak of the waveform fails to detect), if a pitch is changed, the resultant tone sounds unactural. Thus, the flow branches so as not to execute pitch change processing.

More specifically, if tt does not exceed TTU, i.e., tt becomes smaller than the value TTU obtained by multiplying 17/32 with the previously extracted period in step S58, the flow advances to step S76. When a tone higher by an octave is extracted, it is determined that a mute operation is performed, and the flow advances from step S58 to step S76 without outputting a tone higher by an octave, and generation of the corresponding tone is stopped by the processing in steps S76 and S77 in the same manner as in the relative-off processing already explained.

If tt does not exceed TTW, i.e., tt does not become larger than the value TTW obtained by multiplying 31/16 with the previously extracted period in step S59, the flow returns to the processing in step M2 of the main routine shown in FIG. 5 without advancing to step S60.

Figure 18:
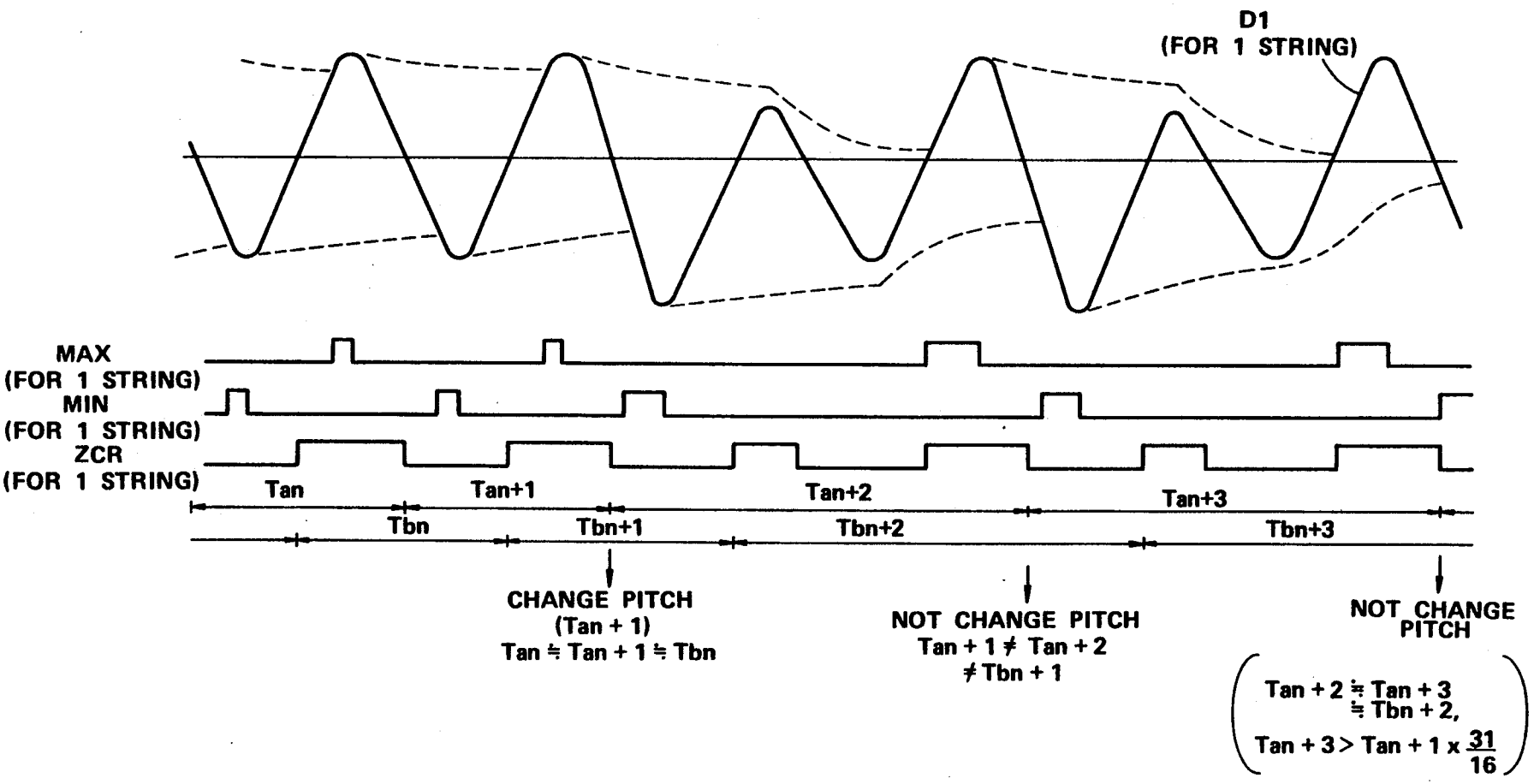
FIG. 18 is a chart for explaining a processing operation when a detected pitch is inappropriate in STEP 4.

This state is shown in FIG. 18. When a waveform is as small as note-off, another waveform is superposed due to a crosstalk of the hexa-pickup or a resonance of a body caused by plucking operation of other strings. Thus, the input waveform becomes as shown in FIG. 18, and an input waveform below one octave may be successively detected.

In this state, if no processing is performed, a tone below one octave is generated, thereby resulting in very unnatural tone generation. For this reason, even if Tan+2≈Tan+3≈Tbn+2 is detected in steps S56 and S57, since Tan+3>Tan+1×(31/16), the flow returns from step S59 to the processing in step M2 in the main routine shown in FIG. 5 without changing a pitch.

<Repetition Processing Operation>

Processing to be executed when waveforms are repetitively extracted, i.e., when peaks having the same polarity are successively detected will now be described.

In the route (1) wherein NO is obtained in step S42 in STEP 4 in FIG. 10, if YES is obtained in step S63, the flow advances to step S68 to execute the repetition processing.

More specifically, if YES in step S63, the flow advances to step S68 to check if the present peak value c>the old peak value AMP(b) having the same sign. If YES in step S68, the flow advances to step S69.

In step S69, the old peak value AMP(b) is rewritten to the present peak value c, and the flow advances to step S70.

It is checked in step S70 if the present peak value c>the old amplitude value (peak value) AMRL1. If YES in step S70, the flow advances to step S71. In step S71, the present peak value c is set as the old amplitude value (peak value) AMRL1.

If NO is determined in step S68, the flow immediately returns to the processing in step M2 of the main routine shown in FIG. 5. Only when the peak of a new input wave is high, it can be determined that the peak of an overtone is not picked up. Therefore, the peak value of the new waveform is registered.

If NO in step S70 and if the processing in step S71 is completed, the control similarly returns to the main routine.

Figure 19:
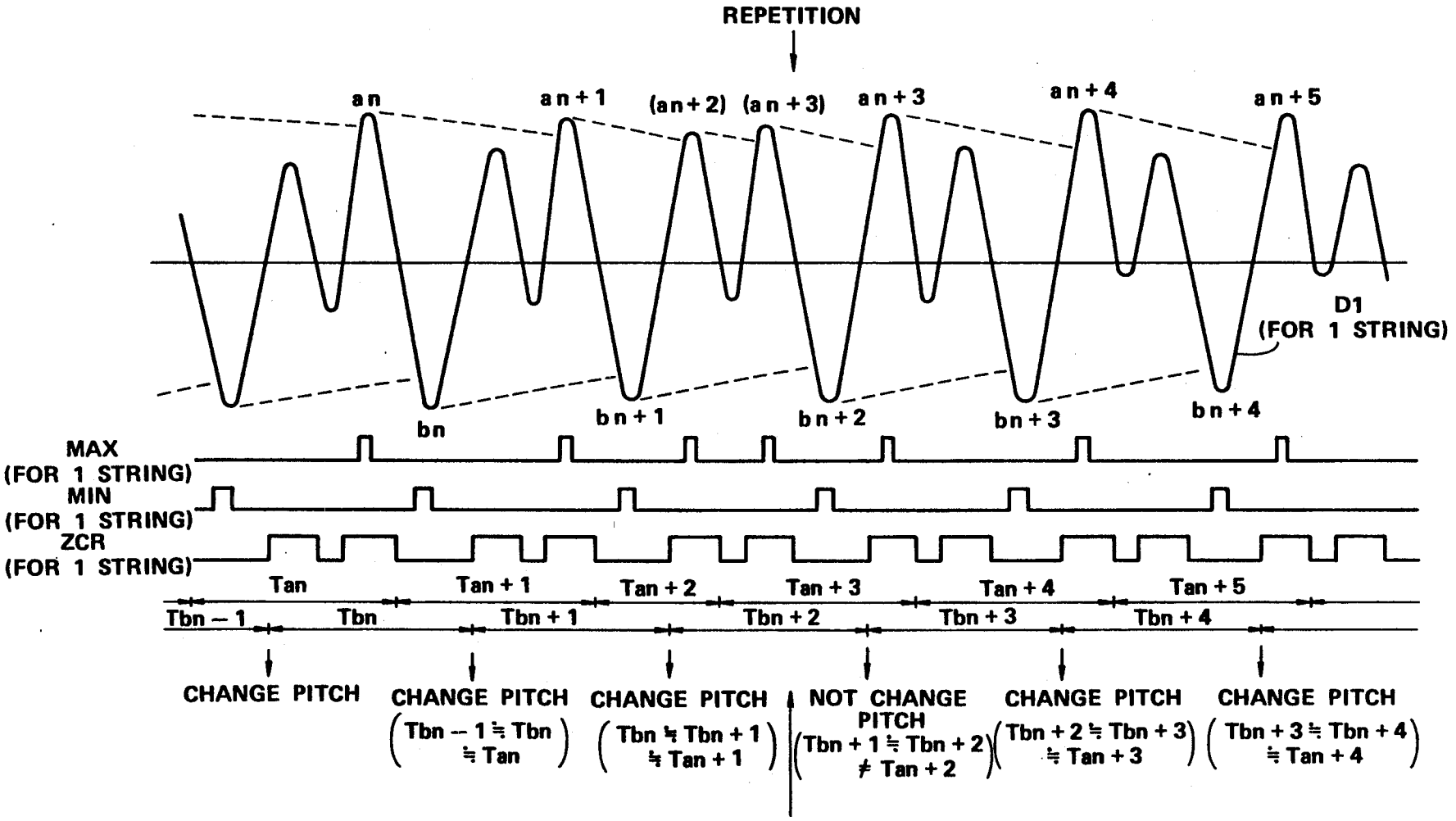
FIG. 19 is a chart for explaining repetition processing in a route ①.

FIG. 19 shows the repetition processing. In this case, MT=0, In general, since the fundamental wave period has a non-integer multiple relationship with the period of an overtone component, the phase of the overtone is gradually shifted, and a zero-cross point having the same polarity may be accidentally detected. Therefore, eroneous pitch change processing caused by the above detection must be prevented. In FIG. 19, a repetition state occurs at a position indicated by "REPETITION". In this case, the flow advances from step S42 to step S63. YES is determined in step S63, and the flow advances to step S68. In this case, (an+2) is compared with (an+3) in step S68. Only when (an+3) is larger than (an+2), the flow advances to step S69, and AMP(1) is updated. The old amplitude value (peak value) AMRL1 is compared with the present amplitude value (peak value c) in step S70. If YES in step S70, the flow advances to step S71, and the present peak value c is set as the old amplitude value (peak value) AMRL1.

In the route ② wherein YES is obtained in step S42 in STEP 4 in FIG. 10A, if NO is obtained in step S43, the flow advances to step S72, and the repetition processing is executed in the same manner as described above.

More specifically, if NO in step S43, the flow advances to step S72 to check if the present peak value c>the old peak value AMP(b) having the same sign. If YES in step S72, the flow advances to step S73, and the old peak value AMP(b) is written to the present peak value c. Thereafter, the flow returns to the processing in step M2 of the main routine shown in FIG. 5.

If NO in step S72, the flow returns to the processing in step M2 of the main routine shown in FIG. 5. In this case, only when the peak of a new input wave is high, the peak value of the new waveform is registered.

Figure 20:
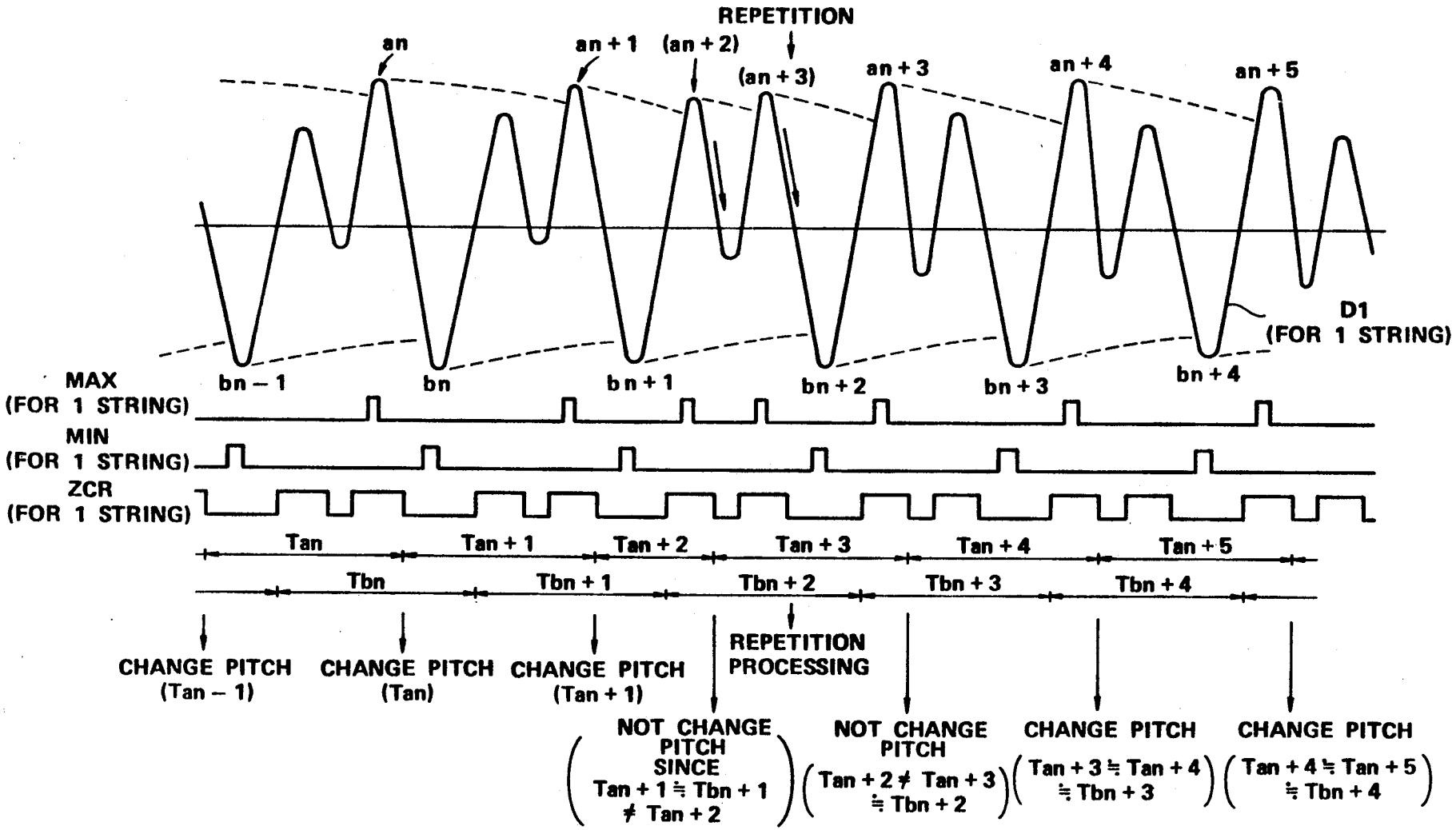
FIG. 20 is a chart for explaining repetition processing in a route ②.

FIG. 20 shows this case. In this case, MT=1. In the processing of STEP 4 at the zero-cross point indicated by "REPETITION" in FIG. 20, the flow advances from step S42 to step S43. YES is obtained in step S43, and the flow advances to step S72. In this case, (an+3) is compared with (an+2) in step S72. If (an+3) is larger than (an+2), YES is determined in step S72, and (an+3) is set in AMP(1); otherwise, no change processing is executed.

In the repetition processing, extracted time data is not used. Therefore, period data Tan+3 is left unchanged. Pitch change processing based on the period data is not executed, either.

{Modifications}

As described above, in this embodiment, the average value of the peak value at every timing and the preceding or old peak value is calculated and the musical tone data is multiplied by the ratio of the calculated average value to the average value obtained similarly at the sustain point SP (FIG. 12(*a*)) as the envelope data. In this manner, after the sustain point SP, the envelope is prevented from unnaturally changing due to the variation (sway) of the peak value and the level difference between the positive peak and the negative peak is rectified. However, the present invention is not limited to this. The peak value at every timing can be used without being modified. In this case, in step S552 in FIG. 10C, the following processing is executed: GENV←AMP(1) or GENV←AMP(0). Furthermore, in other case, running averages of three and more peak values or averages having a hysteresis characteristic can be used.

Furthermore, in the embodiment the threshold point (start point) for reflecting the envelope of the digital output D1 on the musical tone signal is chosen as the sustain point SP. However, the present invention is not limited to this. Any of the envelope control for maintaining the feature of the attack portion can be employed. For example, a timing when a constant time is elapsed from the start of sound generation can be selected for the threshold point.

In the embodiment, the musical tone data output from the musical tone generator 5 is multiplied by the envelope data by the multiplier 6 and thereby the envelope of the musical tone is controlled. However, the envelope data can be input to the musical tone generator 5 to directly control the same. Any of a digital multiplication and an analog multiplication can be employed for the envelope multiplication.

In the above embodiment, the present invention is applied to an electronic guitar in which a pitch is extracted from the waveform of the string vibration and thereby a musical tone is controlled. However, the present invention is not limited to this. The present invention can be applied to any type of electronic musical instruments in which an envelope is extracted from the input waveform signal to control the musical tone to be generated. The present invention is not limited to an application to the electronic musical instrument in which the pitch is extracted from the input waveform signal.

Furthermore, not only the envelope of tone volume of the musical tone but the envelope of the timbre variation can be controlled. In this case, an envelope of each spectrum component is extracted and the level of each component can be controlled to change in accordance with the extracted envelope in the same manner as described in the embodiment.

According to the present invention, in an attack portion, i.e., a time interval from the start of the genertion of a musical tone signal from the musical tone generator till a predetermined timing (e.g., sustain point), the musical tone output from the musical tone generator maintains its original sound characteristics, and after the predetermined timing the envelope of the musical tone signal generated from the musical tone generator can be controlled in accordance with the envelope signal of an input waveform signal.

Accordingly, for example, in an electronic guitar, when the player performs the muting operation to compulsorily cease the string vibration after plucking a string, the musical tone signal generated from the musical tone signal generating means maintains its original sound characteristics (i.e., timbre and the like) of the synthesizer sound (or synthesized sound) in an attack time immediately after the start of tone generation, and thereafter the envelope characteristic of an input waveform representing the string vibration is well reflected on the musical tone signal by the envelope control means after a predetermined timing in accordance with abruptly decreasing of the input waveform signal based on the muting operation. Thus, the player can easily impart the performance effect based on the muting operation and the like to the musical tone to be generated.

{Arrangement of the Second Embodiment of the Present Invention}

The second embodiment of the present invention will be described hereinafter.

In this embodiment, six metal strings are kept taut on a body, and a desired string is plucked while pressing a fret (finger board) arranged below the metal strings so as to make a performance.

Figure 21:
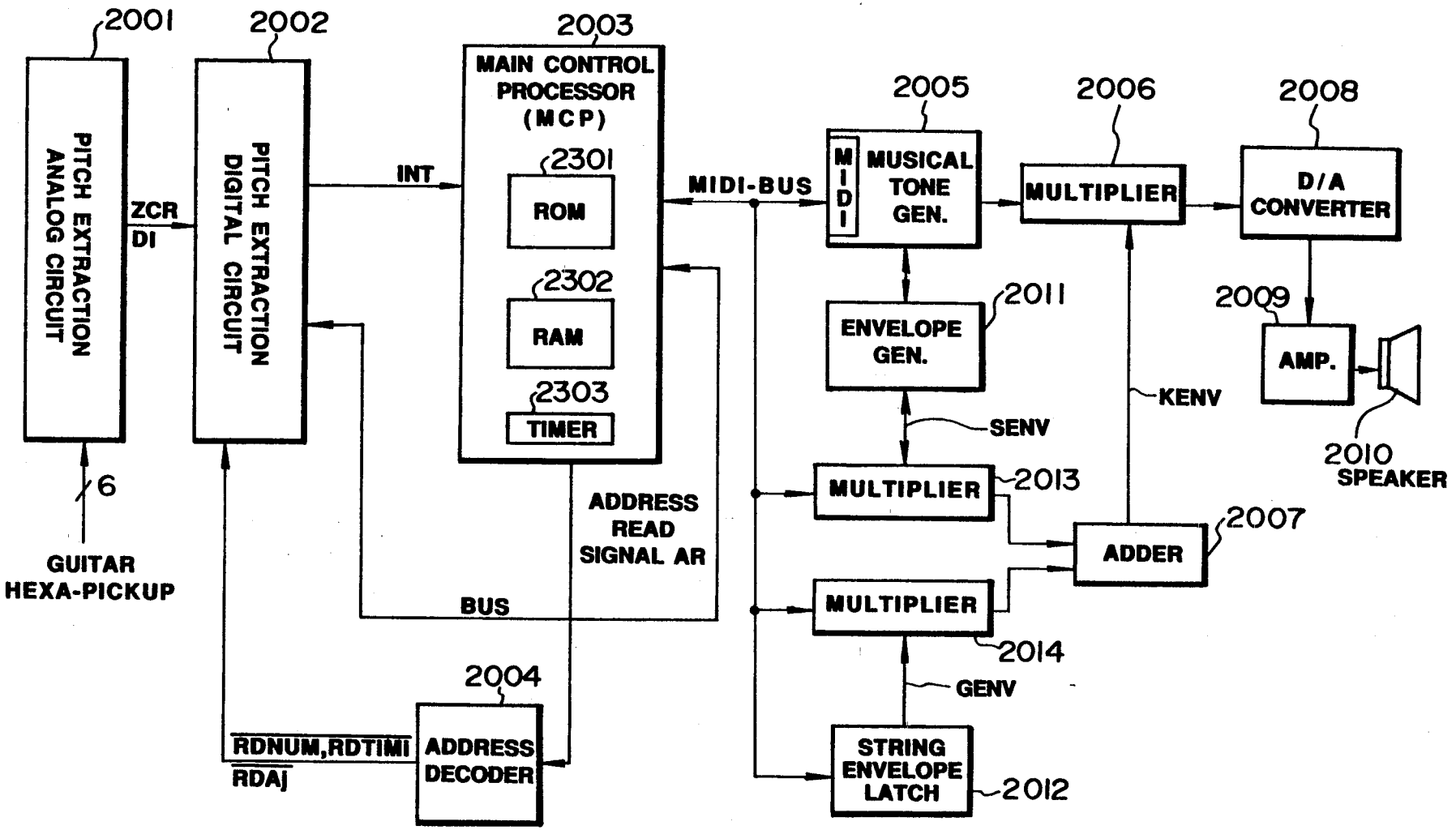
FIG. 21 is a block diagram showing the overall arrangement of second embodiment of the electronic musical instrument according to the present invention.

FIG. 21 shows a block diagram of the overall arrangement of the embodiment.

The construction of this embodiment is similar to that of the first embodiment shown in FIG. 2, therefore explanations of the same portion will be omitted.

A musical tone generator 2005 is provided with an interface MIDI (Musical Instrument Digital Interface) at its input side and is connected to the MCP2003 through a bus MIDI-BUS for transmitting a musical tone control information. The musical tone generator 2005 can generate a plurality of musical tone signals by a time divisional multiplexing operation.

An envelope generator 2011 is provided for generating a plurality of envelope data (hereinafer called as synthesizer envelope data or synthe-envelope data SENV) in synchornism with the operation of the musical tone generator 2005. The data SENV is multiplied with a factor supplied through the MIDI-BUS from the MCP2003 and set in a multiplier 2013.

On the other hand, a string envelope data GENV is sequentially set in an string envelope latch 2012 supplied through the MIDI-BUS from MCP2003 after start of the musical tone generation. The data GENV is multiplied with a factor previously supplied through the MIDI-BUS from MCP2003 and set in a multiplier 2014.

Both outputs from the multipliers 2013 and 2014 are added in an adder 2007 to generate a mixed envelope data KENV. The data KENV is multiplied with a musical tone signal from the musical tone generator 2005 by a multiplier 2006 so as to impart an envelope characteristic based on the mixed envelope data KENV to the musical tone signal.

The output from the multiplier 2006 is supplied to a D/A converter 2008 for Digital to analog conversion. An analog musical tone signal generated from the D/A converter 2008 is supplied to an amplifier 2009, and thereafte is output through a speaker 2010.

{General Operation of This Embodiment}

In this embodiment, a pitch extraction processing as has been explained with reference to FIG. 11 is executed. More specifically, the pitch periods $T_0$ to $T_5$ and the like shown in FIG. 11 are extracted in real time, so that the MCP 2003 generates corresponding tone pitch data and causes the musical tone generator 2005 shown in FIG. 21 to generate a musical tone signal having a corresponding pitch. Therefore, when a player changes a tension of the string using a tremolo arm (not shown), the pitch period (fundamental period) of the digital output D1 is changed accordingly. Therefore the tone pitch data is also changed accordingly, and an abundant expression can be imparted to a musical tone.

In this embodiment, peak values $a_0$ to $a_3$ or $b_0$ to $b_3$ of the digital output D1 shown in FIG. 11 are detected, and particularly, the MCP 3 of FIG. 21 generates tone volume control data based on the maximum peak value $a_0$ at the leading edge (upon plucking a string) and transfers the tone volume data to the musical tone generator 2005. Thus, a musical tone having tone volume corresponding to a string plucking strength can be generated.

The envelope control of a musical tone is most important feature of the present embodiment, and hereinafter the control will be described. Each musical tone signal generated from the musical tone generator 2005 shown in FIG. 21 is multiplied with a mixed envelope data KENV supplied from the adder 2007 by the multiplier 2006 to control the envelope characteristic. The mixed envelope data KENV is obtained by mixing the synthe-envelope data SENV output from the envelope generator 2011 and the string envelope data GENV set in the string envelope latch 2012 supplied from the MCP 2003. In this case, the synthe-envelope data SENV is an envelope data set for representing a synthesizer sound or synthesized sound, and therefore has a characteristic of such sound. On the other hand, the string envelope data GENV sequentially set in the string envelope latch 2012 is an extracted envelope data obtained from the digital output D1 (refer to FIG. 11), and supplied from the MCP 2003 as a result of an operation of the pitch extraction digital interface 2002. Therefore, the string envelope data GENV corresponds to directly an envelope characteristic of a string vibration changed in real time basis.

Furthermore, in this embodiment, a mixing operation of the synthe-envelope data SENV and the string envelope data GENV at a desired ratio is executed by the multipliers 2013 and 2014 and the adder 2007 for adding their outputs. The mixing ratio is determined in accordance with factors set in the multipliers 2013 and 2014 from the MCP 2003. An example for combinations of the factors is shown in FIG. 22B. The performer can set any one of the values 0 to 5 by operating a set switch (not shown) prior to a musical performance. According to this setting operation, MCP 2003 sets a selected combination of factors as shown in FIG. 22B and based on the set value to the multipliers 2013 and 2014.

Figure 22A:
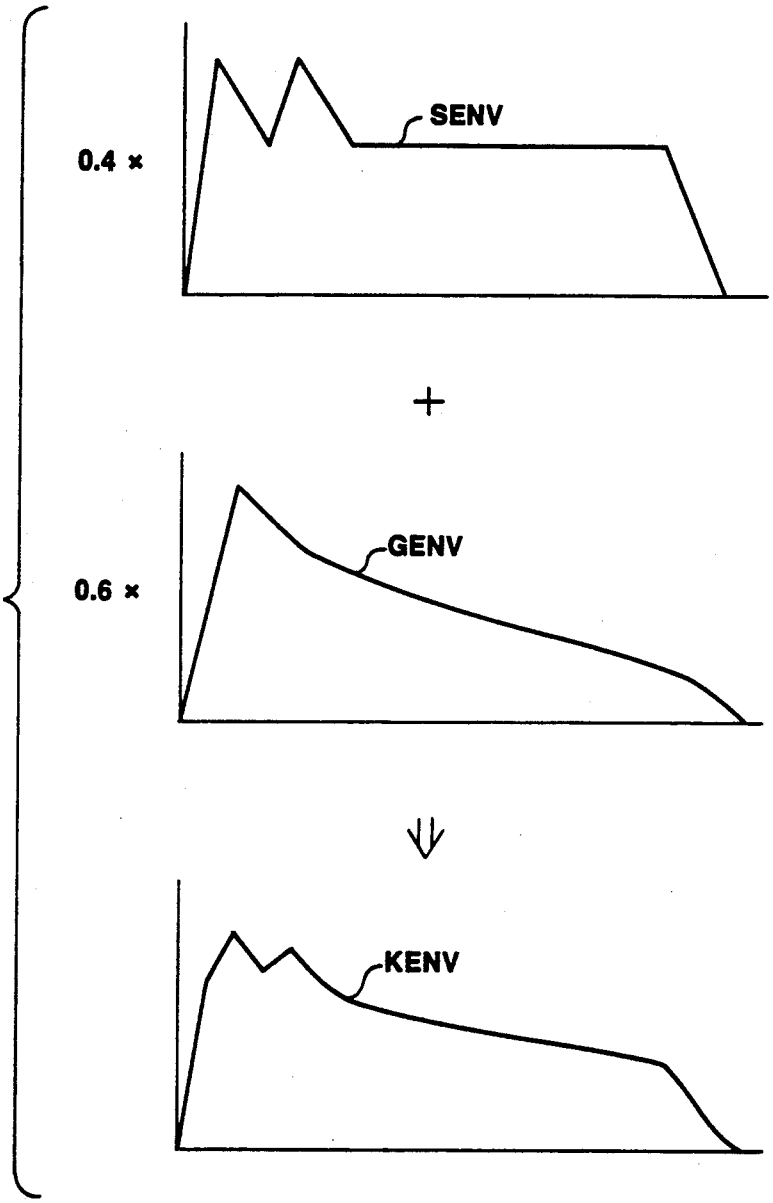

For example, the synthe-envelope data SENV generated from the envelope generator 11 shown in FIG. 21 has a characteristic shown at SENV in FIG. 22A (the horizontal axis represents a time and the longitudinal axis represents an amplitude). On the other hand, the string envelope data GENV detected by the pitch extraction digital circuit 2002 shown in FIG. 21 and successively set in the string envelope latch 2012 by the MCP 2003 has a characteristic shown at GENV in FIG. 22A. If the player has selected "3" as the above-mentioned set value, a factor 0.4 is set to the multiplier 2013 and a factor 0.6 is set to the multiplier 2014 in accordance with a table shown in FIG. 22B. Therefore, the adder 2007 shown in FIG. 21 outputs a mixed envelope data KENV by mixing the synthe-envelope data SENV and the string envelope data GENV at a 0.4–0.6 ratio as shown at KENV in FIG. 22A. The envelope characteristic is imparted to the musical tone signal generated from the musical tone generator 2005 by the multiplier 2006.

As has been understood, the player can change the envelope of the musical tone to be generated from the envelope peculiar to the synthesizer sound to the string envelope representing a string vibration of a guitar at several steps by selecting a desired set value. In the example shown in FIG. 22B, the player can obtain a synthesizer sound by setting "0" as the set value, a sound entirely controlled by the envelope of the string vibration by setting "5" as the set value, and furthermore a sound having a desired mixed characteristic by setting any one of "1" to "5" as the set value.

Since the above-mentioned operation is achieved by time-divisional processing for the time-divisional digital output D1 for the six strings of the guitar, the musical tone generator 2005, envelope generator 2011, string envelope latch 2012, multiplier 2006, 2013, 2014 and adder 2007 and the like are operated on a time division basis. Thus, the speaker 2010 shown in FIG. 21 acoustically generates musical tones for the six strings at the same time. These musical tones can be set to have desired tone volumes and timbres, and various effects can be electronically imparted thereto. Therefore, a great performance effect can be imparted.

{Operation of MCP}

In this embodiment, the operation of the MCP 2003 is very similar to that of the first embodiment as described above. Therefore, the deference between this embodiment and the first embodiment will be explained especially.

Figure 23A:
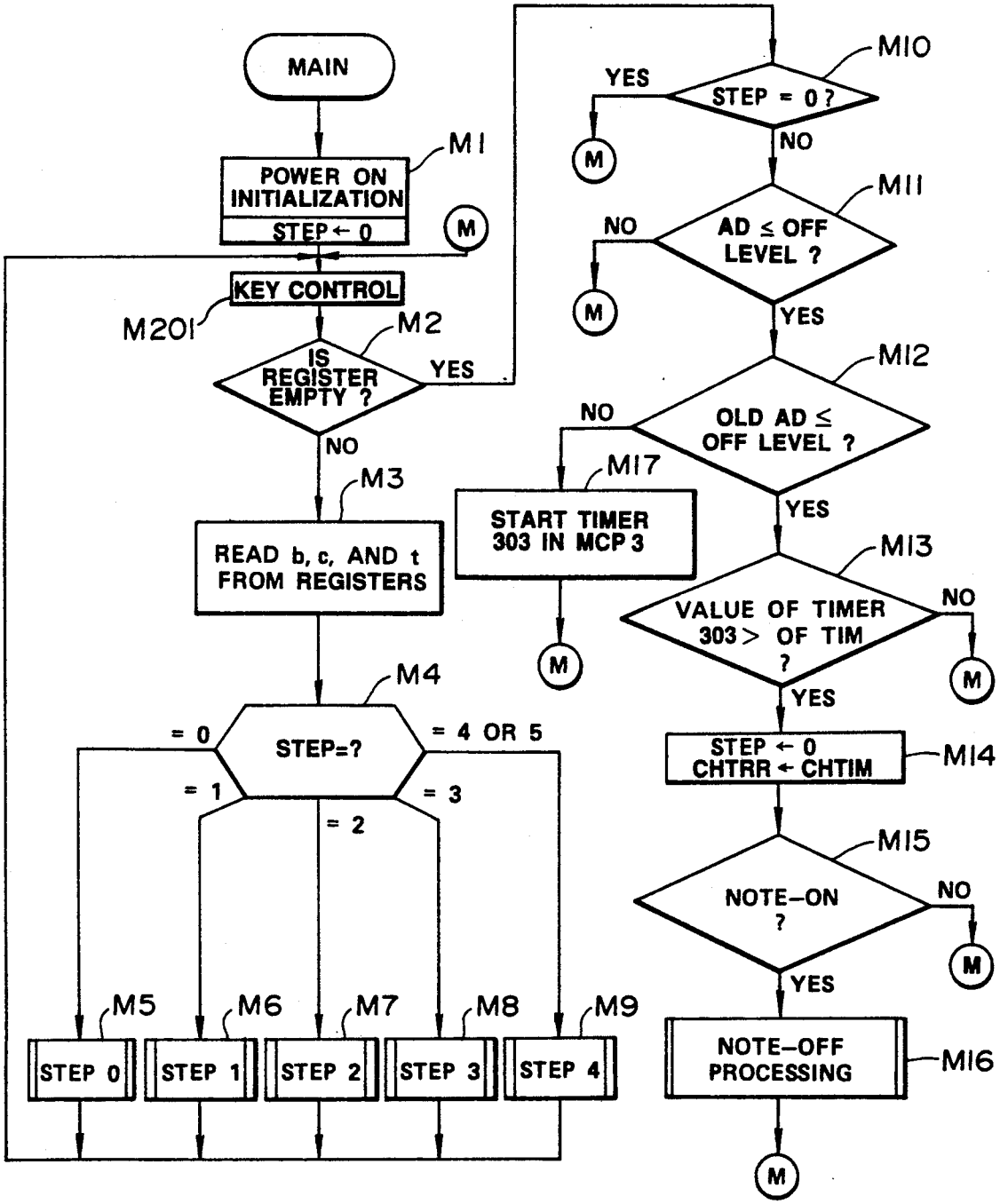
FIGS. 23A and 23B are operational flow charts of a main routine of MCP.
Figure 23B:
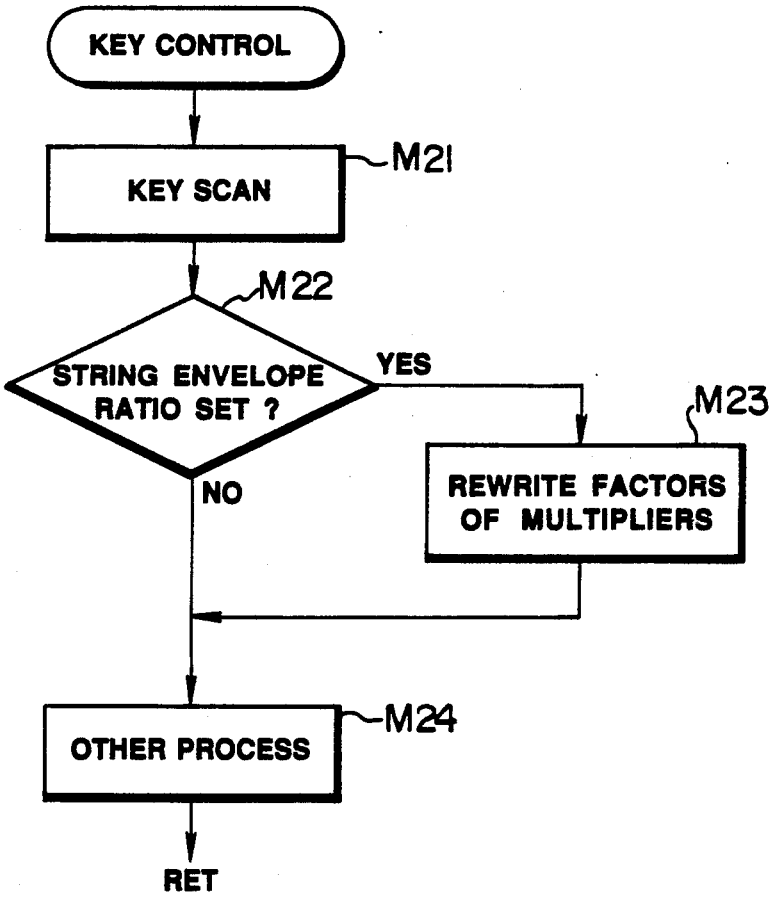
Figure 24:
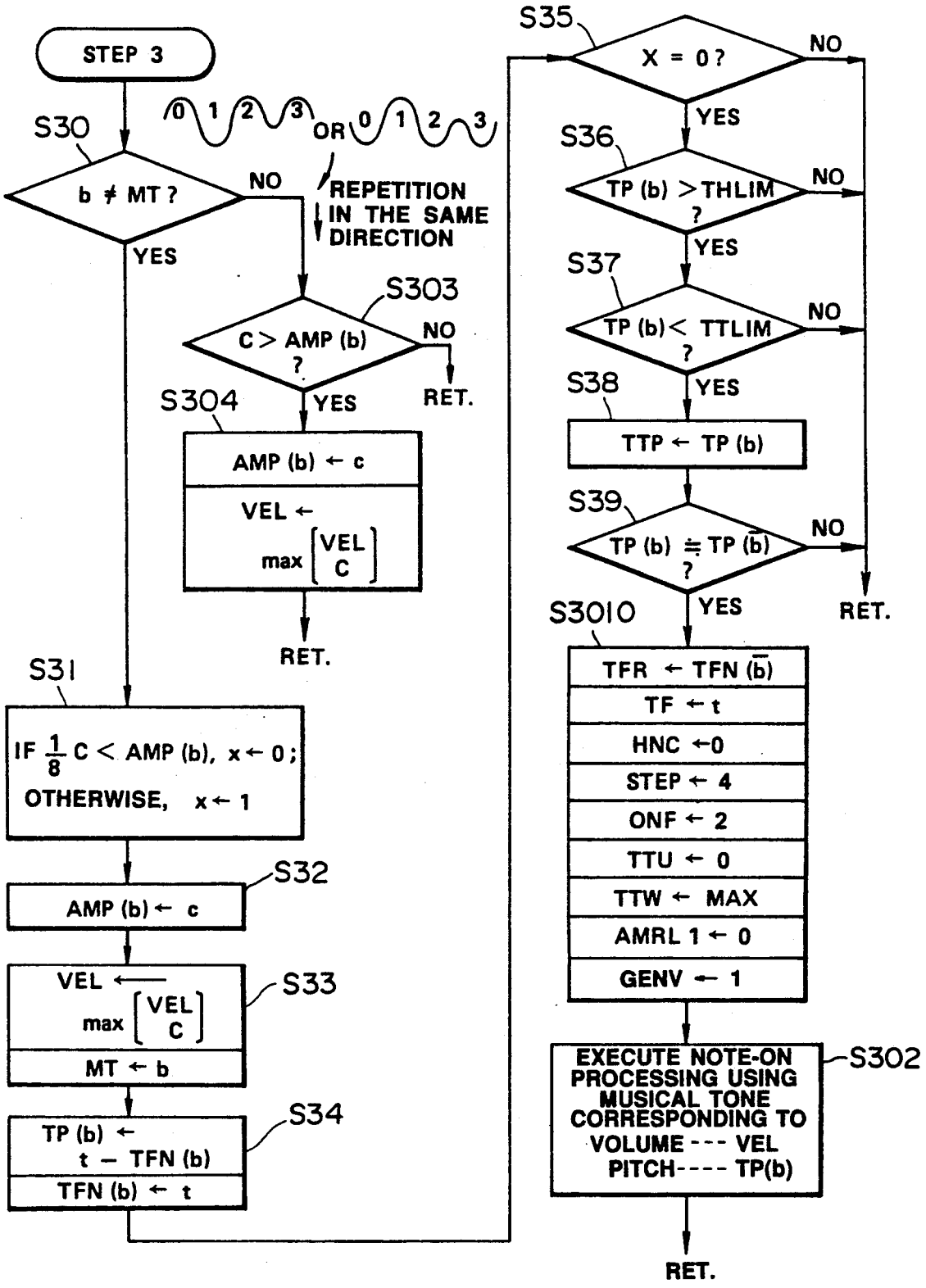
FIG. 24 is an operational flow chart of processing STEP 3 shown in FIG. 23A.
Figure 25:
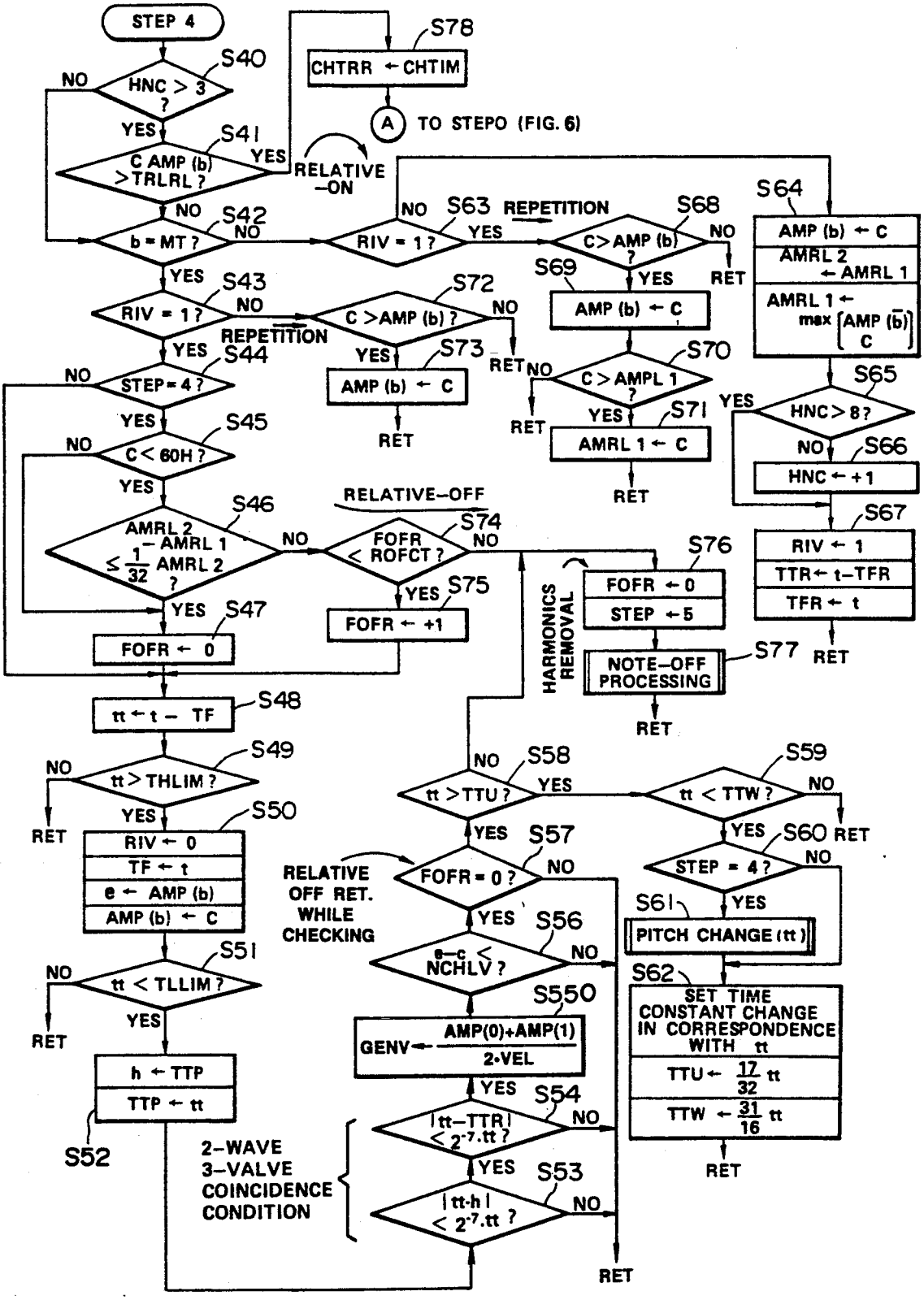
FIG. 25 is an operational flow chart of processing STEP 4 shown in FIG. 23A.

Note that, the correspondence of operational flow charts as has been explained as to the first embodiment and the flow charts of MCP 2003 of this embodiment is as follows:

| First Embodiment | Second Embodiment |
|---|---|
| FIG. 4 (interrupt routine) | The same (omitted) |
| FIG. 5 (main routine) | Changed as FIGS. 23A and 23B |
| FIG. 6 (STEP0) | The same (omitted) |
| FIG. 7 (STEP1) | The same (omitted) |
| FIG. 8 (STEP2) | The same (omitted) |
| FIG. 9 (STEP3) | Changed as FIGS. 24 |
| FIGS. 10A to 10C(STEP4) | Changed as FIG. 25 |

Furthermore, the modification of variables used in this embodiments is as follows:

GENV . . . string envelope data
KENV . . . mixed envelope data
SENV . . . synthe-envelope data Therefore, the difference from the first embodiment is appeared in the main routine as shown in FIGS. 23A and 23B. More specifically, in step M201 in FIG. 23A a key control processing is executed. The detail of the step M201 is shown in FIG. 23B. The MCP 2003 scans a plurality of function switches (not shown) in step M21. If a key operation for setting a mixing ratio for the string envelope data GENV and the synthe-envelope data SENV as described in Section "General Operation of This Embodiment" is detected, the judgement of step M22 becomes YES. Thus, the MCP 2003 sets factors according to a combination shown in FIG. 22B to the multipliers 2013 and 2014 (step M23 shown in FIG. 23B).

Thereafter, other processing for other keys not shown is executed (M24 in FIG. 23B) by the MCP 2003 and the key control operation processing is finalized. If NO in step M22, the processing of step M24 is executed without executing the process of step M23.

FIG. 24 shows the operation of STEP 3. In this embodiment, the data GENV is set as "1" in step 3010 shown in FIG. 24.

Figure 26:
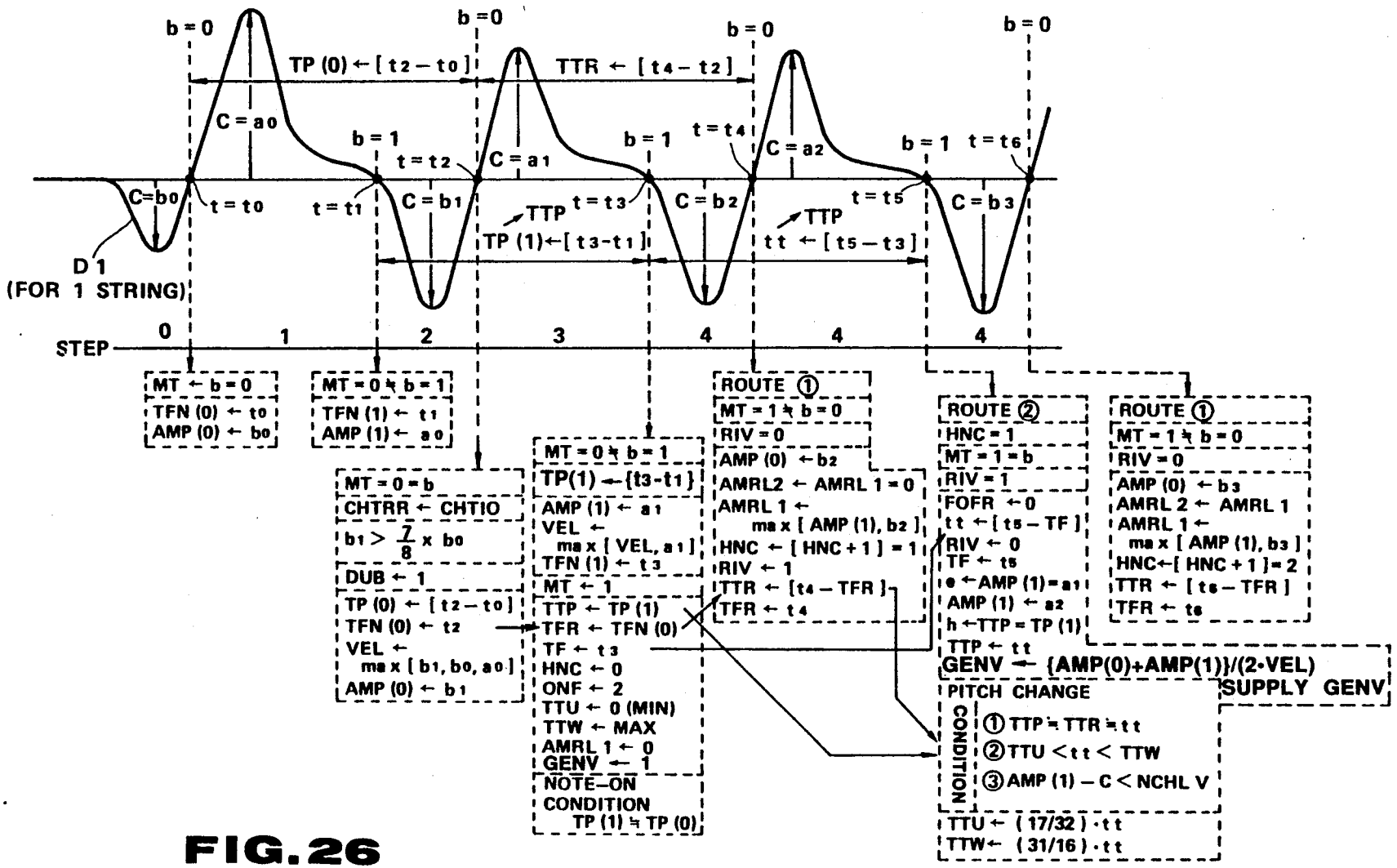
FIG. 26 is a chart for explaining a basic operation of this embodiment.

Furthermore, FIG. 25 shows the operation of STEP 4. In this embodiment, an envelope control is executed in step S550. This processing is most characterized in the embodiment. More specifically, in step S550, a string envelope data GENV is obtained by calculating a mean value of the present peak value and the old peak value and thereafter calculating a ratio of the mean value thus calculated to velocity data VEL. That is, $GENV=\{AMP(0)+AMP(1)\}/(2\cdot VEL)$ is calculated. Now, in FIG. 26, AMP(0) is a negative peak value $b_2$, and AMP(1) is a positive peak value $a_2$ (both absolute values). Therefore, a ratio of the mean value of the both values to the velocity data VEL is a string envelope data representing damping level of the current digital output D1 to the maximum peak value thereof at the leading time. In this embodiment, a musical tone envelope control is executed in accordance with the obtained string envelope data GENV as will be described hereinafter.

More specifically, when the string envelope data GENV is calculated as has been described above, the data GENV is supplied from the MCP 2003 shown in FIG. 21 to the string envlope latch 2012 to be set. The operation is repeatedly executed at a time when the route ② (i.e., the routine from step S42 to S62) is executed. As a result, new string envelope data GENV is repeatedly calculated and is supplied to the string envelope latch 2012.

Furthermore, in parallel to the processing the envelope generator 2011 generates the synthe-envelope data SENV.

As has been described above, the route ① or route ② shown in FIG. 25 is repeatedly executed, thereby the tone generation operations are progressed. In the meanwhile, a mixed envelope data KENV is generated by multiplying the string envelope data GENV successively set in the string envelope latch 2012 with a preselected factor by the multiplier 2013, multiplying the synthe-envelope data SENV generated from the envelope generator 2011 with another preselected factor by the multiplier 2014 and adding both calculated envelope data by the adder 2007 for the envelope control of the musical tone produced from the tone generator 2005 through the multiplier 2006 shown in FIG. 21. In this case, the factors multiplied by the multipiers 2013 and 2014 has been set in the key control processing in step M201 in FIG. 23A (i.e., in step M23 shown in FIG. 23B). Accordingly, a mixed envelope data KENV is obtained by mixing the synthe-envelope data SENV shown at SENV in FIG. 22A and the string envelope data GENV (shown at GENV in FIG. 22A) successively set in the string envelope latch 2012 detected and provided by the pitch extraction digital circuit 2002 and MCP 2003 at a selected and desired ratio by the player. The mixed envelope data is output as shown at KENV in FIG. 22A from the adder 2007.

Since the envelope characteristic is imparted to the musical tone signal output from the musical tone generator 2005, the player can change the envelope of the musical tone at several steps from the envelope peculiar to the synthesizer sound to an envelope representing a string vibration of a guitar.

{Modifications}

As described above, in this embodiment, the average value of the peak value at every timing and the preceeding or old peak value is calculated, a string envelope data is calculated as a ratio of the average value to the velocity data VEL, and a mixed envelope data KENV is obtained by mixing the string envelope data SENV thus calculated and a synthesizer envelope data SENV at a desired ratio. In this manner, the envelope is prevented from unnaturally changing due to the variation (sway) of the peak value and the level difference between the positive peak and the negative peak is rectified. However, the present invention is not limited to this. The peak value at every timing can be used without being modified. In such a case, in step S550 shown in FIG. 25, the following processing is executed: GENV←AMP(1) or GENV←AMP(0). Furthermore, in other case, running averages of three and more peak values or averages having a hysteresis characteristic can be used.

In the embodiment, the musical tone signal output from the musical tone generator 2005 is mutliplied by the envelope data by the multiplir 2006 and thereby the envelope of the musical tone is controlled. However, the envelope data can be input to the musical tone generator 2005 to directly control the same. Any of a digital multiplication and an analog multiplication can be employed for the envelope multiplication.

In the above embodiment, the present invention is applied to an electronic guitar in which a pitch is extracted from the waveform of the string vibration and thereby a musical tone is controled. However, the present invention can be applied to any type of electronic musical instruments in which an envelope is extracted from the input waveform signal to control the musical tone to be generated. The present invention is not limited to an application to the musical instrument in which the pitch is extracted from the input waveform signal.

Furthermore, not only the envelope of tone volume of the musical tone but the envelope of timbre variation can be controlled. In this case, an envelope of each spectrum component is extracted and the level of each component can be controlled to change in accordance with the extracted envelope in the same manner as described in the embodiment.

Accordingly to the present invention, an envelope control of the musical tone signal is executed by a mixed characteristic obtained by combining an envelope characteristic of the input waveform, for example, directly corresponding to the variation of the string vibration of the electronic stringed musical instrument, and an envelope characteristic preset as the synthesizer sound characteristic at a desired ratio obtained by a mixing means.

Accordingly, the player can change the envelope of the musical tone to be generated from the envelope peculiar to the synthesizer sound to the string envelope representing a string vibration of, for example, a guitar at several steps by setting a desired mixing ratio of the two kinds of the envelope signal combined by the mixing means. Thus, an electronic musical instrument is realized in which a desired musical performance is easily executed by a player and an abundant performance effect can be obtained.

What is claimed is:

1. An electronic musical instrument, comprising:

envelope extraction means for extracting an envelope signal from an input waveform signal;

musical tone generation means including means for generating a musical tone signal, and preset envelope generation musical tone generation means including means for generating a musical tone signal, and preset envelope generation means for generating a preset envelope signal to impart an envelope characteristic to the generated musical tone signal;

envelope control means for (a) imparting, between a generation start timing and a sustain state start timing of the musical tone signal, a constant value to the musical tone signal to which the preset envelope signal has been imparted and (b) imparting, from said sustain start timing of the musical tone signal, the envelope signal extracted by said envelope extraction means to the musical tone signal to which the preset envelope signal has been imparted;

wherein said envelope extraction means includes:

(a) peak value detection means for sequentially detecting peak values for a digital waveform signal obtained by digitizing said input waveform signal after the sustain start timing of the musical tone signal;

(b) average value calculation means for calculating average values of a present peak value detected by said peak value detection means and at least one previous peak value; and (c) envelope signal calculating means for calculating ratios as said extracted envelope signal by dividing the average values successively output from said average value calculation means by the average value at the sustain start timing, and said constant value which is imparted to the musical tone signal between the generation start timing and the sustain start timing being equal to the ratio at the sustain start timing.

2. An electronic musical instrument, comprising:

envelope extraction means for extracting an envelope signal from an input waveform signal;

musical tone generation means including means for generating a musical tone signal, and preset envelope generation means for generating a preset envelope signal to impart an envelope characteristic to the generated musical tone signal;

envelope control means for (a) imparting, between a generation start timing and a sustain state start timing of the musical tone signal, constant value to the musical tone signal to which the preset envelope signal has been imparted and (b) imparting, from said sustain start timing of the musical tone signal, the envelope signal extracted by said envelope extraction means to the musical tone signal to which the preset envelope signal has been imparted;

wherein said envelope extraction means includes:

(a) peak value detection means for sequentially detecting peak values of a digital waveform signal obtained by digitizing said input waveform signal after the sustain start timing of the musical tone signal; and (b) envelope signal calculating means for calculating ratios as said extracted envelope signal by dividing the peak values successively output from said peak value detection means by the peak value at the sustain start timing, and said constant value which is imparted to the musical tone signal between the generation start timing and a sustain start timing being equal to the ratio at the sustain start timing.

3. An electronic musical instrument, comprising:

envelope extraction means for extracting an envelope signal from an input waveform signal;

musical tone generation means for generating a musical tone signal;

preselected envelope signal generation means for generating a preselected envelope signal;

selecting means for enabling a performer to select a mixing ratio of envelope signals;

mixing means coupled to said envelope extraction means and to said preselected envelope signal generation means for mixing the envelope signal representing an envelope of said input waveform signal and the preselected envelope signal generated from said preselected envelope signal generation means at a desired mixing ratio selected by said selecting means; and envelope control means for imparting a mixed envelope signal obtained from said mixing means to the musical tone signal generated from said musical tone generation means;

wherein said envelope extraction means includes;

(a) maximum peak value detection means for detecting a maximum peak value of a digital waveform signal at its start timing, said digital waveform signal being obtained by digitizing the input waveform signal;

(b) peak value detection means for sequentially detecting peak values of the digital waveform signal after its start timing;

(c) envelope signal calculating means including means for calculating an average value of a present peak value detected sequentially by said peak value detection means and at least one previous peak value, means for sequentially calculating a ratio of the average value to the maximum peak value detected by said maximum peak value detection means, and means for sequentially outputting the calculated ratio as the extracted envelope signal.

4. The electronic musical instrument according to claim 3, wherein said mixing means includes:

first multiplying means for multiplying the envelope signal extracted by said envelope extraction means with a preselected first factor;

second multiplying means for multiplying the envelope signal generated by said envelope signal generator means with a preselected second factor; and adding means for adding outputs from said first and second multiplying means to generate said mixed envelope signal; and wherein said envelope control means includes multiplying means for multiplying the musical tone signal generated from said musical tone generation means with said mixed envelope signal.

5. An electronic stringed instrument in which a string vibration is detected, a pitch is extracted from the detected string vibration and a musical tone having a corresponding tone pitch is generated, comprising:

envelope extraction means for extracting an envelope signal from an input waveform signal representing the string vibration;

musical tone generation means including means for generating a musical tone signal, a pitch of the musical tone signal being determined by a pitch extracted from said input waveform signal, and preset envelope generation means for generating a preset envelope signal to impart an envelope characteristic to the generated musical tone signal;

envelope control means for (a) imparting, between a generation start timing and a sustain state start timing of the musical tone signal, a constant value to the musical tone signal to which the preset envelope signal has been imparted and (b) imparting, from said sustain start timing of the musical tone signal, the envelope signal extracted by said envelope extraction means to the musical tone signal to which the preset envelope signal has been imparted;

wherein said envelope extraction means includes:

(a) peak value detection means for sequentially detecting peak values of a digital waveform signal obtained by digitizing said input waveform signal after the sustain start timing of the musical tone signal; and (b) average value calculation means for calculating an average value of a present peak value detected by said peak value detection means and at least one previous peak value; and (c) envelope signal calculating means for calculating ratios as said extracted envelope signal by dividing the average values successively output from said average value calculation means by the average value at the sustain start timing, and said constant value which is imparted to the musical tone signal between the generation start timing and the sustain start timing being equal to the ratio at the sustain start timing.

6. An electronic stringed instrument in which a string vibration is detected, a pitch is extracted from the detected string vibration and a musical tone having a corresponding tone pitch is generated, comprising:

envelope extraction means for extracting an envelope signal from an input waveform signal representing the string vibration;

musical tone generation means including means for generating a musical tone signal, a pitch of the musical tone signal being determined by the pitch extracted from said input waveform signal, and preset envelope generation means for generating a preset envelope signal to impart an envelope characteristic to the generated musical tone signal;

envelope control means for (a) imparting, between a generation start timing and a sustain state start timing of the musical tone signal, a constant value to the musical tone signal to which the preset envelope signal has been imparted and (b) imparting, from said sustain start timing of the musical tone signal, the envelope signal extracted by said envelope extraction means to the musical tone signal to which the preset envelope signal has been imparted;

wherein said envelope extraction means includes:

(a) peak value detection means for sequentially detecting peak values of a digital waveform signal obtained by digitizing said input waveform signal after the sustain start timing of the musical tone signal; and (b) envelope signal calculating means for calculating ratios as said extracted envelope signal by dividing the peak values successively output from said peak value detection means by the peak value at the sustain start timing, and said constant value which is imparted to the musical tone signal between the generation start timing and a sustain start timing being equal to the ratio at the sustain start timing.

7. An electronic stringed instrument in which a string vibration is detected, a pitch is extracted from the detected string vibration and a musical tone having a corresponding tone pitch is generated, comprising:

envelope extraction means for extracting an envelope signal from an inputwaveform signal representing the string vibration;

musical tone generation means for generating a musical tone signal whose pitch is determined by the extracted pitch from said input waveform signal;

preselected envelope signal generation means for generating a preselected envelope signal;

selecting means for enabling a performer to select a mixing ratio of envelope signals;

mixing means coupled to said envelope extraction means and to said preselected envelope signal generation means for mixing the envelope signal representing the envelope of said input waveform signal and the preselected envelope signal generated from said preselected envelope signal generation means at a desired mixing ratio selected by said selecting means; and envelope control means for imparting a mixed envelope signal obtained by said mixing means to the musical tone signal generated from said musical tone generation means;

wherein said envelope extraction means includes:

(a) maximum peak value detection means for detecting a maximum peak value of a digital waveform signal at its start timing, said digital waveform signal being obtained by digitizing the input waveform signal;

(b) peak value detection means for sequentially detecting peak values of the digital waveform signal after its start timing;

(c) envelope signal calculating means including means for calculating an average value of a present peak value detected sequentially by said peak value detection means and at least one previous peak value, means for sequentially calculating a ratio of the average value to the maximum peak value detected by said maximum peak value detection means, and means for sequentially outputting the calculated ratio as the extracted envelope signal.

8. The electronic musical instrument according to claim 7, wherein said mixing means includes:

first multiplying means for multiplying the envelope signal extracted by said envelope extraction means with a preselected first factor;

second multiplying means for multiplying the envelope signal generated by said envelope signal generator means with a preselected second factor; and adding means for adding outputs from said first and second multiplying means to generate said mixed envelope signal; and wherein said envelope control means includes multiplying means for multiplying the musical tone signal generated from said musical tone generation means with said mixed envelope signal.

* * * * *

UNITED STATES PATENT AND TRADEMARK OFFICE

CERTIFICATE OF CORRECTION

PATENT NO. : 5,147,970

DATED : September 15, 1992

INVENTOR(S) : Katsuhiko OBATA

It is certified that error appears in the above-identified patent and that said Letters Patent is hereby corrected as shown below:

Column 45, lines 48-50 (claim 1), delete the following:

"musical tone generation means including means for generating a musical tone signal, and preset envelope generation".

Column 45, line 68 (claim 1), replace "for" with --of--.

Column 48, line 55 (claim 7), replace "inputwaveform" with --input waveform--.

Signed and Sealed this

Twelfth Day of October, 1993

*Attest:*

*Attesting Officer*

Bruce Lehman

BRUCE LEHMAN

*Commissioner of Patents and Trademarks*